US006416374B1

(12) United States Patent
Mitome et al.

(10) Patent No.: US 6,416,374 B1
(45) Date of Patent: Jul. 9, 2002

(54) ELECTRON SOURCE MANUFACTURING METHOD, AND IMAGE FORMING APPARATUS METHOD

(75) Inventors: Masanori Mitome, Tsukuba; Masato Yamanobe, Machida; Fumio Kishi, Aikawa-machi; Hitoshi Oda, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/153,883

(22) Filed: Sep. 16, 1998

(30) Foreign Application Priority Data

| | | |
|---|---|---|
| Sep. 16, 1997 | (JP) | 9-250594 |
| Sep. 16, 1997 | (JP) | 9-250595 |
| Oct. 29, 1997 | (JP) | 9-297105 |
| Sep. 16, 1998 | (JP) | 10-261508 |

(51) Int. Cl.[7] ..... H01J 9/02
(52) U.S. Cl. ..... 445/6; 445/24; 445/59
(58) Field of Search ..... 445/6, 1, 3, 4, 445/10, 11, 13, 14, 24, 51, 59; 313/495, 496

(56) References Cited

U.S. PATENT DOCUMENTS

| | | | | |
|---|---|---|---|---|
| 5,066,883 | A | 11/1991 | Yoshioka et al. | 313/309 |
| 5,591,061 | A | 1/1997 | Ikeda et al. | 445/3 |
| 5,622,634 | A | 4/1997 | Noma et al. | 216/40 |
| 6,060,113 | A | 5/2000 | Banno et al. | 427/78 |

FOREIGN PATENT DOCUMENTS

| | | | | |
|---|---|---|---|---|
| EP | 0 660 357 | | 6/1995 | |
| EP | 0 660 359 | | 6/1995 | |
| EP | 0 692 809 | | 1/1996 | |
| EP | 0 785 564 | A1 | 7/1997 | |
| EP | 0 788 130 | | 8/1997 | |
| EP | 0660357 | * | 12/1997 | 445/24 |
| JP | 64-31332 | | 2/1989 | |
| JP | 1-283749 | | 11/1989 | |
| JP | 2-257552 | | 10/1990 | |
| JP | 7-235255 | | 9/1995 | |
| JP | 7-235275 | | 9/1995 | |
| JP | 8-162015 | | 6/1996 | |
| JP | 8-171849 | | 7/1996 | |
| JP | 9-69334 | | 3/1997 | |
| JP | 9-330654 | | 12/1997 | |
| JP | 9330654 | A * | 12/1997 | 445/24 |
| JP | 11339662 | A * | 12/1999 | 445/24 |
| KR | 95-20856 | | 7/1995 | |
| KR | 96-5740 | | 2/1996 | |
| KR | 97-60294 | | 8/1997 | |

OTHER PUBLICATIONS

W.P. Dyke, et al., "Field Emission", Advances in Electronics and Electron Physics, vol. 8, (1956) pp. 89–185.

C.A. Spindt, et al., "Physical Properties of Thin–Film Field Emission Cathodes with Molybdenum Cones", J. Appl. Phys., vol. 47, No. 12, Dec. 1976, pp. 5248–5263.

C.A. Mead, "Operation of Tunnel–Emission Devices", J. Appl. Phys., vol. 32, No. 4, (1961) pp. 646–652.

M.I. Elinson, et al., "The Emission of Hot Electrons and the Field Emission of Electrons from Tin Oxide", Radio Engineering and Electronic Physics, No. 7, Jul. 1965, pp. 1290–1295.

(List continued on next page.)

*Primary Examiner*—Kenneth J. Ramsey
(74) *Attorney, Agent, or Firm*—Fitzpatrick, Cella, Harper & Scinto

(57) ABSTRACT

A method of manufacturing an electron source with electron emitting elements is provided. The method has a process of depositing a deposit substance in an area including at least an area of the electron emitting element from which area electrons are emitted. The depositing process is performed in an atmosphere of a gas containing at least a source material of the deposit substance, the gas having a mean free path allowing the gas to take a viscous flow state.

24 Claims, 28 Drawing Sheets

OTHER PUBLICATIONS

G. Dittmer, "Electrical Conduction and Electron Emission of Discontinuous Thin Films", Thin Solid Films, vol. 9, (1972) pp. 317–328.

M. Hartwell, et al., "Strong Electron Emission from Patterned Tin–Indium Oxide Thin Films", I.E.D.M. Technical Digest, (1975) pp. 519–521.

H. Araki, et al., "Electroforming and Electron Emission of Carbon Thin Films", Journal of the Vacuum Society of Japan, vol. 26, No. 1, (1956) pp. 22–29. (English Abstract included).

Yamaguchi, et al. "6.2: A 10–in. Surface–Conduction Election–Emitter Display", May 13, 1997, SID International Symposium Digest of Technical Papers, Boston, May 13–15, 1997, Nr. vol. 28, pp. 52–55, Society for Information Display.

* cited by examiner

ELECTRON SOURCE MANUFACTURING METHOD, AND IMAGE FORMING APPARATUS METHOD

BACKGROUND OF THE INVENTION

1. Field of the Invention

The present invention relates to a method of manufacturing an electron source with an electron emitting element, a method of manufacturing an image forming apparatus, and apparatuses for manufacturing these electron source and image forming apparatus.

2. Related Background Art

Two types of electron emitting elements are known as roughly classified into a thermal electron emitting element and a cold cathode electron emitting element. The types of a cold cathode electron emitting element include a field emission type (hereinafter called an FE type, a metal/insulator/metal type (hereinafter called an MIM type), a surface conduction type electron emission type, and the like.

Examples of the FE type are disclosed in "Field emission", by W. P. Dyke & W. W. Dolan, Advance in Electron Physics, 8, 89 (1956), "Physical properties of thin-film field emission cathodes with molybdenum cones", by C. A. Spindt, J. Appl. Phys., 47, 5248 (1976) and other papers.

Examples of the MIM type are disclosed in "Operation of Tunnel-Emission Devices", by C. A. Mead, J. Appl., Phys., 32, 646 (1961) and other papers.

Examples of the surface conduction type electron emission element are disclosed in Recio Eng. Electron Phys., by M. I. Elinson, 10, 1290 (1965) and other papers.

The surface conduction type electron emitting element utilizes the phenomenon that when current is flowed in a thin film having a small area formed on a substrate in parallel to the film surface, electron emission occurs. Reported thin films for a surface conduction type electron emitting element include an $SnO_2$ thin film by Elinson, an Au thin film ("Thin Solid Films", 9, 317 (1972)), an $In_2O_3/SnO_2$ thin film ("IEEE Trans. ED conf.", by M. Hartwell and C. G. Fonstad, 519 (1975)), a carbon thin film ("Vacuum", by Hisashi ARAKI, et al. vol. 26, No. 1. p. 22 (1983)), and the like.

As a typical example of a surface conduction type electron emitting element, the structure of an element proposed by M. Hartwell is schematically shown in FIG. 16. In FIG. 16, reference numeral 1 represents a substrate, and reference numerals 2 and 3 represent element electrodes. Reference numeral 4 represents a conductive thin film which is made of a metal oxide thin film having an H-character shape formed by sputtering. An electron emitting area 5 is formed in the conductive thin film by a power conduction process called a power conduction forming process to be described later. A distance L1 between the element electrodes is 0.5 to 1 mm, and a width W of the conductive thin film 4 is 0.1 mm.

Conventionally, the electron emitting area 5 of a surface conduction type electron emitting element is generally formed in the conductive thin film 4 by the power conduction process called the power conduction forming process, before electron emission is enabled. With the power conduction forming process, a d.c. voltage or a voltage rising very gently, e.g., at about 1 V/min is applied across the electrodes of the conductive thin film 4 to locally break, deform, or decompose to form the electron emitting area 5 having a high electric resistance.

Cracks or the like are formed in the electron emitting area 5 of the conductive thin film 4 and electrons are emitted from the cracks and nearby areas. When a voltage is applied to the conductive thin film 4 of a surface conduction type electron emitting element subjected to the power conduction forming process and current is flowed therethrough, electrons are emitted from the electron emitting area 5.

Since the structure of a surface conduction type electron emitting element is simple and the manufacture thereof is easy, a number of elements can be disposed in a large area. By utilizing this advantageous feature, various applications have been studied. For example, the surface conduction type electron emitting element may be used for a charged beam source, a display device, and the like. As will be later described, as an example of disposing a number of surface conduction type electron emitting elements, an electron source is known which has a number of rows disposed in parallel each having a plurality of surface conduction type electron emitting elements each having both terminals being connected by wiring patterns (also called common wiring patterns) (e.g., JP-A-64-031332, JP-A-1-283749, JP-A-2-257552, or the like).

A flat panel type display device using liquid crystal has recently been prevailed as an image forming apparatus in place of a CRT. However, since the flat panel type display device using liquid crystal is not of a self-light emission type so that a back light becomes necessary. Developments on a display device of a self-light emission type have long been desired. As a self-light emission type display device, an image forming apparatus is known which is a combination of an electron source with a number of surface conduction type electron emitting elements and a fluorescent body capable of radiating visible rays upon application of electrons emitted from the electron source (e.g., U.S. Pat. No. 5,066,883).

The present applicant has proposed a surface conduction type electron emitting element having the structure schematically shown in FIGS. 2A and 2B and an image forming apparatus using such electron emitting elements. The details of the structure of the electron emitting element and image forming apparatus and the manufacture methods thereof are described, for example, in JP-A-7-235255, JP-A-7-235275, JP-A-8-171849, and the like.

This surface conduction type electron emitting element is constituted of a pair of element electrodes 2 and 3 facing each other on a substrate 1, and a conductive film 4 having an electron emitting area 5 connected between the element electrodes 2 and 3. The electron emitting area 5 is a high electric resistance area formed by locally breaking, deforming or decomposing the conductive film 4. Cracks or the like are formed in the electron emitting area 5 of the conductive thin film 4. Electrons are emitted from the nearby area of the cracks. The electron emitting area and its nearby area is formed with a deposit film containing at least carbon.

The conductive film is preferably made of conductive fine particles in order to form the electron emitting area of a proper performance by the power conduction process (forming process) to be later described.

The manufacture process will be described briefly with reference to FIGS. 4A to 4C.

First, element electrode 2 and 3 are formed on a substrate 1 by suitable methods such as printing, vacuum deposition, and photolithography techniques (FIG. 4A).

Next, a conductive film 4 is formed. The conductive film 4 may be deposited by vacuum deposition, sputtering or the like and patterned, or it may be formed by coating liquid which contains source material of the conductive film.

For example, solution of metal organic compound is coated and thermally decomposed to form a metal or metal oxide. In this case, a fine particle film can be formed under the proper film forming conditions.

After the conductive film is formed, it may be patterned to a desired shape. Alternatively, as described in JP-A-9-69334, source material liquid may be coated by an ink jet apparatus or the like to make it have a desired shape, and thereafter it is thermally decomposed to form a conductive film having a desired shape without using a patterning process.

Next, an electron emitting area 5 is formed. This area may be formed by applying a voltage across the element electrodes 2 and 3 and flowing current through the conductive film to locally deform or decompose the conductive film (power conduction forming process). The voltage is preferably a pulse voltage. Waveforms of the pulse voltage may have a constant peak value as shown in FIG. 5A, a peak value gradually increasing with time as shown in FIG. 5B, or a combination of these. It is desired that while a forming pulse is not applied (during a period between pulses), a pulse having a sufficiently low peak value is inserted to measure a resistance value, and that when the resistance value of the electron emitting area increases sufficiently, e.g., when it exceeds 1 MΩ, the pulse application is stopped.

For this process, generally, the electron emitting element is placed in a vacuum chamber which may be evacuated by an evacuator, into which oxidizing gas may be introduced, or into which reducing gas may be introduced. A proper state is selected in accordance with the conditions such as the material quality of the conductive film or the like.

Next, an activating process is performed. This process deposits material containing at least carbons near on the electron emitting area formed by the forming process, to thereby increase the amount of electrons to be emitted. Generally, this process of depositing material containing at least carbon is performed by placing an electron emitting element in a vacuum chamber, evacuating the inside of the chamber, and applying a pulse voltage across a pair of element electrodes to thereby decomposing and polymerizing organic material present in the vacuum at a low partial pressure. The organic material may be introduced directly into the vacuum chamber after it is evacuated, or it may be diffused into the vacuum chamber by using a proper apparatus such as an oil diffusing pump.

It is preferable to perform a stabilizing process after the activating process. This process is performed in order to sufficiently remove organic material molecules attached to the electron emitting element, its nearby area, and the inner wall of a vacuum housing of the electron emitting element, to thereby prevent material containing carbon from being thereafter deposited during the operation of the element and stabilize the characteristics of the element.

More specifically, for example, an electron emitting element is placed in a vacuum chamber (which may be the same chamber as used in the activating process), and the electron emitting element and vacuum chamber are heated while the vacuum chamber is evacuated by an oil-free evacuator such as an ion pump. This heating is performed in order to detach and sufficiently remove organic material molecules attached on the electron emitting element and on the inner wall of the vacuum chamber. At the same time, or after the heating is stopped, if a drive voltage is applied to the electron emitting element while the inside of the vacuum chamber is evacuated, the electron emission effect may be improved in some cases. Depending upon the kind of organic material introduced during the activating process, the electron emission effect may be improved by driving the electron emitting element in a high vacuum state of the vacuum chamber. The stabilizing process is therefore performed by a method most suitable for respective conditions.

A typical example of the operation characteristics of the surface conduction type electron emitting element manufactured by the above-described method is shown in the graph of FIG. 7. This graph shows a relation between a current (element current) If flowing through the element upon application of a voltage Vf and an emission current Ie. Ic is very small as compared to If so that they are shown by arbitrary scales which are both linear scales. As seen from FIG. 7, the emission current Ie is non-linear having a threshold value (Vth) relative to Vf. If Vf is Vth or smaller, Ie is substantially 0, whereas if Vf exceeds Vth, Ie rises abruptly. In the example shown in FIG. 7, similar to Ie, If has also a threshold value relative to Vf and monotonously increases (MI characteristics) above Vf equal to or higher than the threshold value. However, depending upon the manufacture processes and measurement conditions, If may have a voltage controlled type negative resistance (VCNR characteristics). If the element has the VCNR characteristics, If-Vf characteristics are not stable, and although Ie has the MI characteristics, the characteristics are not stable. The stable MI characteristics may be obtained by performing the stabilizing process as disclosed, for example, in JP-A-7-235275.

Since the relation between Vf and Ie is non-linear having a definite threshold value, it is possible to emit electrons from a desired one of a plurality of electron emitting elements disposed on a substrate in a matrix form and wired together. A simple matrix drive is therefore possible.

An image forming apparatus using an electron source constituted of electron emitting elements has the electron source and an image forming member housed in a vacuum housing made of glass or the like. This electron source can be formed basically by the same method as above. In this case, instead of using a vacuum chamber, the vacuum housing made of glass and containing the electron source with conductive films and the image forming member may be used for the forming, activating, and stabilizing processes by evacuating the inside of the vacuum housing. Since a specific vacuum chamber for manufacturing an image forming apparatus is not necessary, the apparatus can be manufactured with a simple manufacture system.

Such an image forming apparatus has a great number of electron emitting elements integrated together. Highly sophisticated techniques are therefore required to manufacture with high yield an electron source whose all electron emitting elements operate normally. If each process is performed by using the vacuum housing containing the electron source and a defective element is formed during the process, it is impossible to repair it. Therefore, in manufacturing a large type or high precision type image forming apparatus having a great number of electron emitting elements, it is advantageous in some cases to perform each process by using a large vacuum chamber and thereafter house the electron source and image forming member in a vacuum housing.

Depending upon respective conditions, one of the above-described two methods, or an intermediate method of performing some processes by using a vacuum chamber and performing the remaining processes by housing the electron source and image forming material in a vacuum housing.

As schematically shown in FIG. 13, an electron source wired in a ladder shape may be used to form an image forming apparatus such as schematically shown in FIG. 14.

In this case, grid electrodes are provided for modulating the amount of electron rays reaching the image forming member.

JP-A-9-330654 discloses a process of activating surface conduction type electron emitting elements by using a mixture gas of organic material and carrier gas.

SUMMARY OF THE INVENTION

It is an object of the present invention to provide techniques regarding the manufacture of an electron source with an electron emitting element, capable of lowering a manufacture cost, shortening a manufacture time, and improving the characteristics of a manufactured electron emitting element.

According to one aspect of the present invention, a method of manufacturing an electron source with an electron emitting element is provided which comprises the steps of: depositing a deposit substance in an area including at least an area of the electron emitting element from which area electrons are emitted, wherein the depositing step is performed in an atmosphere of a gas containing at least a source material of the deposit substance, the gas having a mean free path allowing the gas to take a viscous flow state.

According to another aspect of the invention, a method of manufacturing an electron source with an electron emitting element is provided which comprises the steps of: depositing a deposit substance in an area including at least an area of the electron emitting element from which area electrons are emitted, wherein the depositing step is performed in an atmosphere of a gas containing at least a source material of the deposit substance, the gas atmosphere having a pressure of 1 Pa or higher.

In the first and second aspects of the invention, the deposit substance area from which electrons are emitted may be an area from which electrons can be emitted before the depositing step.

The gas may be a gas made of a source material of the deposit substance diluted with dilution gas such as inert gas.

The gas may be a gas containing a source material of the deposit substance, and a gas of nitrogen, helium, or argon.

The gas may be a gas containing carbon or carbon compound, and a gas of nitrogen, helium, or argon.

The depositing step may deposit the deposit substance by applying a voltage across the area from which electrons are emitted, under the atmosphere.

The area from which electrons are emitted may be near at a first gapped area between conductive materials facing each other, and the depositing step may deposit the deposit substance over the facing conductive materials to form a second gapped area narrower than the first gapped area.

The first and second aspects of the invention may further comprise a first gapped area forming step of forming the first gapped area. The first gapped area forming step may the first gapped area by supplying a power to the conductive film where the first gapped area is formed.

The first gapped area forming step may be performed at a pressure nearly equal to the pressure used for the depositing step.

The first gapped area forming step and the depositing step may be performed at an approximately atmospheric pressure.

In the first and second aspects of the invention, the first gapped area forming step may be performed in an inert gas, in an oxidizing gas or a mixture gas containing oxidizing gas, or in a reducing gas or a mixture gas containing reducing gas.

In the first and second aspects of the invention, the depositing step may be performed in a container capable of being evacuated into the atmosphere.

The container may be a product housing the electron emitting element therein, an envelope of an image forming apparatus to be described later, or a manufacture system including a chamber different from an electron source or a product such as an image forming apparatus using the electron source. In this case, a step after the depositing step is completed may be performed by using a container different from the container used during the depositing step.

The container used during the depositing step may be provided with means for diffusing the gas. The diffusing means may be a mesh.

The depositing step may be performed by introducing the gas into the container, or by flowing the gas through the container. A method of introducing or flowing the gas into or through the container may use positive introducing means such as propellers and pumps.

The depositing step may be performed in a container having an inlet port and an outlet port for the gas. During the depositing step, the gas drained from the container may be again introduced into the container. Means for again introducing the gas may be positive introducing means (circulating means) such as propellers and pumps. Before the gas is again introduced into the container, unnecessary substances may be reduced from the gas drained from the container.

After the depositing step, moisture in the gas may be reduced.

The electron emitting element is preferably a cold cathode electron emitting element. It may be used properly as a surface conduction type electron emitting element.

The invention is particularly effective for forming a number of electron emitting elements.

According to a third aspect of the invention, a method of manufacturing an image forming apparatus having an electron source and an image forming member for forming an image by using electrons radiated from the electron source is provided which comprises the step of integrating the image forming member with an electron source manufactured by the above-described manufacture method.

According to a fourth aspect of the invention, a manufacture apparatus for manufacturing an electron source with an electron emitting element is provided which comprises: a container capable of introducing a gas thereinto; and means for introducing the gas in the container, the gas containing at least a source material of a deposit substance deposited in an area at least including an area of the electron emitting element from which electrons are emitted, wherein the introducing means introduces the gas in a viscous flow state.

According to a fifth aspect of the invention, a manufacture apparatus for manufacturing an electron source with an electron emitting element is provided which comprises: a container capable of introducing a gas thereinto; and means for introducing the gas in the container, the gas containing at least a source material of a deposit substance deposited in an area at least including an area of the electron emitting element from which electrons are emitted, wherein the introducing means introduces the gas at 1 Pa or higher of the atmosphere in the container.

In the third to fourth aspects of the invention, the introducing means may be an inlet port and an outlet port mounted on the container, a gas source such as a bomb containing a gas or a source material of the gas such as liquid, or introducing pipes.

The manufacture apparatuses may further comprise circulating means for introducing the gas drained from the container again into the container, or pipe means for introducing the gas drained from the container again into the container. The manufacture apparatuses may further comprise means for removing moisture in the gas to be again introduced into the container.

The container may cover a member such as the substrate including at least the area where the deposit substance is formed.

The manufacture apparatuses may include transport means for transporting a member containing at least the area where the deposit substance is formed, into the container.

DETAILED DESCRIPTION OF THE PREFERRED EMBODIMENTS

Embodiments of the invention will be described with reference to the accompanying drawings.

First Embodiment

The outline of embodiments of the invention will be described first.

[Outline Structure of Manufacture System]

Figure 1:
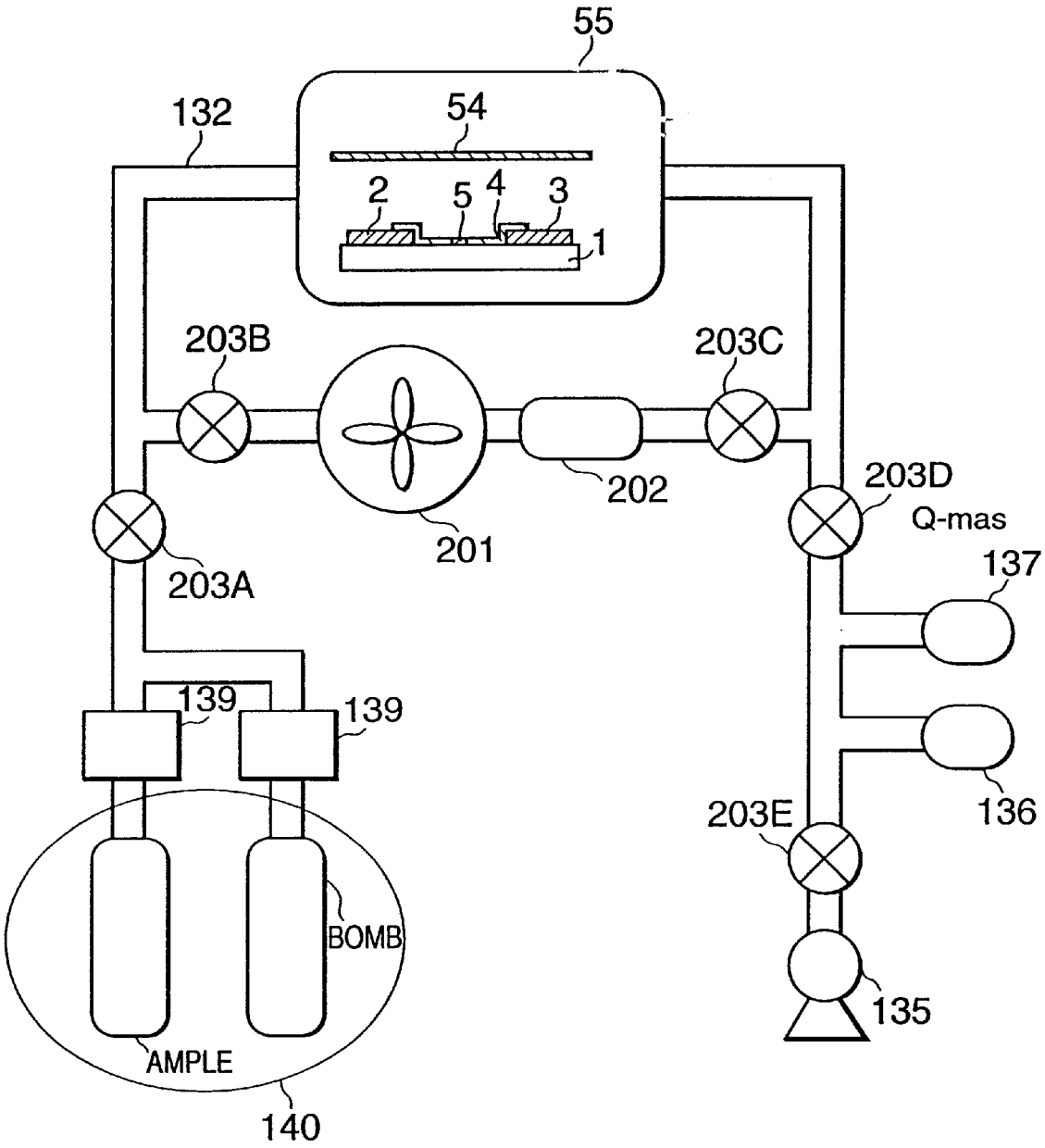
FIG. 1 is a schematic diagram showing an example of a surface conduction type electron emitting element manufacture system according to the invention.

FIG. 1 is a schematic diagram showing an example of a manufacture system for a surface conduction type electron emitting element.

In FIG. 1, reference numeral 1 represents a substrate, reference numerals 2 and 3 represent element electrodes, reference numeral 4 represents a conductive thin film, reference numeral 54 represents an anode electrode for capturing electrons emitted from an electron emitting area of the element, reference numeral 55 represents a vacuum chamber, reference numeral 132 represents a pipe, reference numeral 135 represents an evacuator, reference numeral 136 represents a pressure gauge, reference numeral 137 represents a quadrature mass spectrometer, reference numeral 139 represents a dose control means, reference numeral 140 represents a substance source, reference numeral 201 represents a circulator, reference numeral 202 represents a moisture absorber, and reference numeral 203 represents a valve.

Gas to be used for activation is introduced from the substance source 140 into the vacuum chamber 55 via the dose control means 139.

Figure 6:
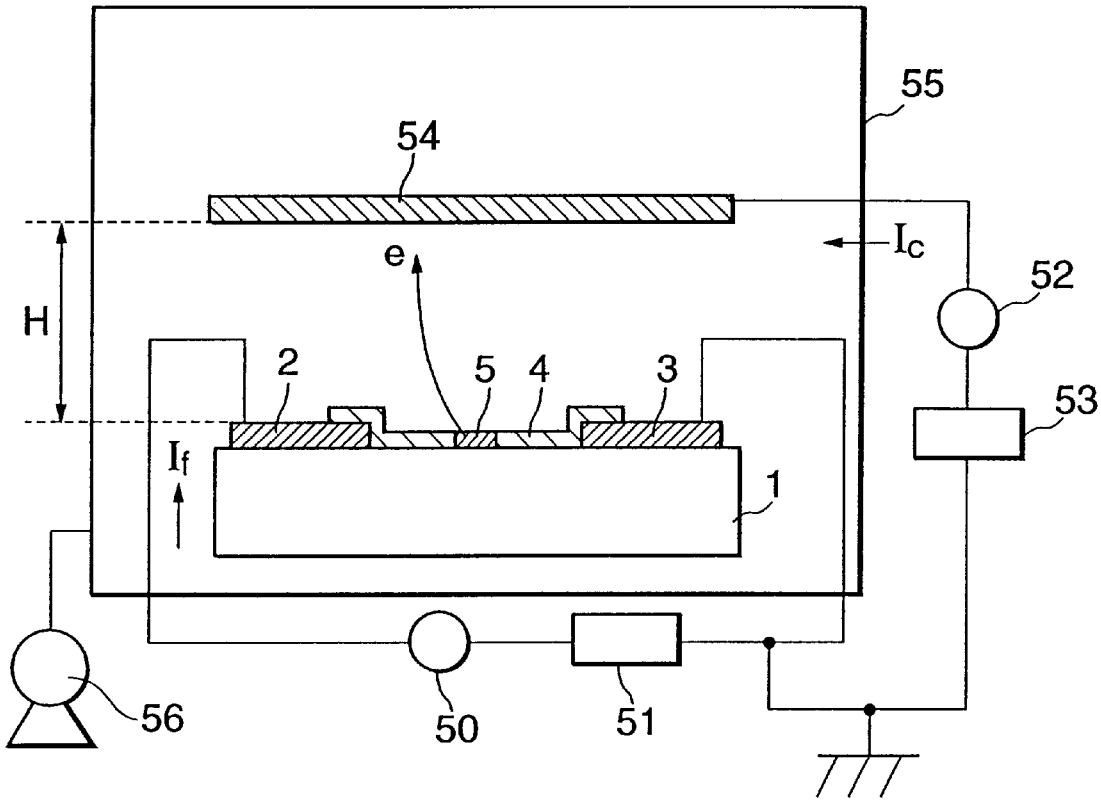
FIG. 6 is a schematic diagram showing an example of a vacuum process system provided with a measurement/evaluation function.

Although not shown, power sources to be later described with reference to FIG. 6 are connected to the element electrodes 2 and 3 and anode electrode 54 in the vacuum chamber 55.

During the activating process, only valves 203B and 203C connected to the circulator and moisture absorber are opened, and other valves 203A and 203D are closed. Therefore, the activating process can be performed while a pressure distribution in the vacuum chamber is maintained constant, and moisture produced in the vacuum chamber can be efficiently removed.

The fundamental structure of a surface conduction type electron emitting element applicable to the invention is roughly classified into a horizontal type and a vertical type.

[Horizontal Type Electron Emitting Element]

First, a horizontal type surface conduction electron emitting element will be described.

Figure 2A:
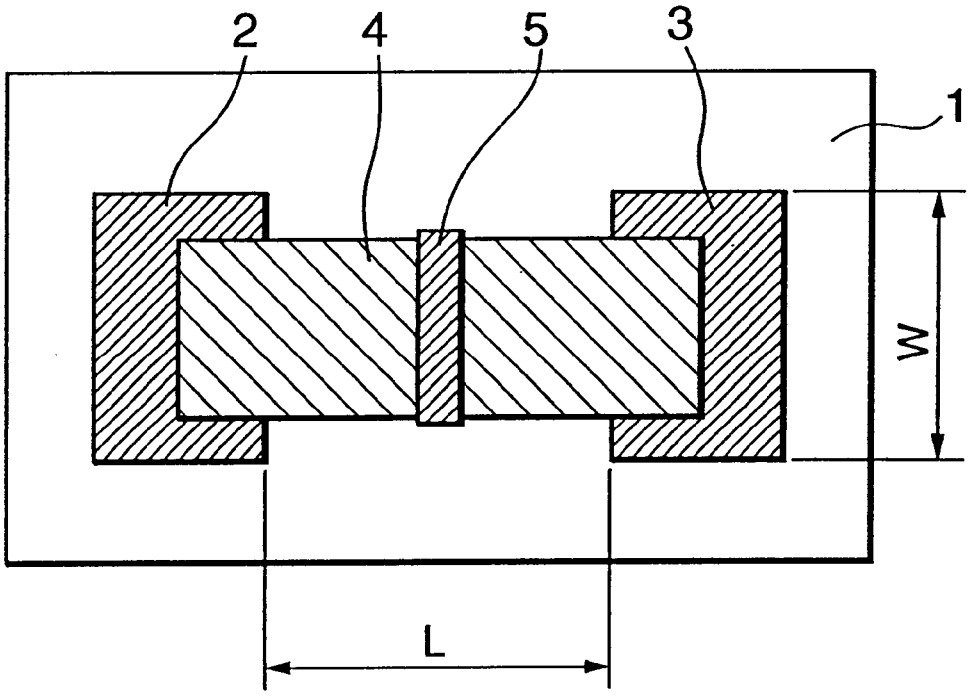
FIGS. 2A and 2B are a schematic plan view and cross sectional view showing the structure of a surface conduction type electron emitting element applicable to the invention.
Figure 2B:
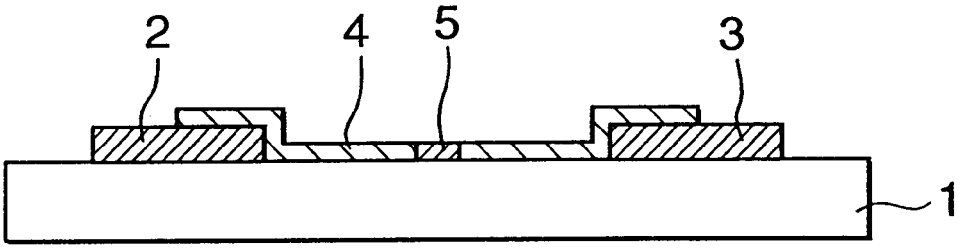

FIGS. 2A and 2B are schematic plan and cross sectional views showing the structure of a horizontal type surface conduction electron emitting element applicable to the invention.

In FIGS. 2A and 2B, reference numeral 1 represents a substrate, reference numerals 2 and 3 represent element electrodes, reference numeral 4 represents a conductive thin film, and reference numeral 5 represents an electron emitting area.

[Substrate]

The substrate 1 may be made of quartz glass, glass with a reduced concentration of impurities such as Na, blue plate glass, $SiO_2$ laminated through sputtering or the like, ceramics such as alumina, Si, or the like.

[Element Electrode]

General conductive material may be used as the material of a pair of facing element electrodes 2 and 3. For example, the material may be selected as desired from: metal such as Ni, Cr, Au, Mo, W, Pt, Ti, Al, Cu, and Pd or alloy thereof; printed conductive material constituted of metal or metal oxide such as Pd, Ag, Au, $RuO_2$, and Pd—Ag, glass and the like; transparent conductive material such as $In_2O_3$—$SnO_2$; and conductive material made of semiconductor material such as polysilicon.

An element electrode space L, an element electrode length W, a shape of the conductive thin film 4, and the like are designed depending upon application fields. The element electrode space L is preferably in a range from several hundreds nm to several hundreds $\mu$m, or more preferably in a range from several number $\mu$m to several tens $\mu$m.

The element electrode length W may be in a range from several number $\mu$m to several hundreds $\mu$m, by taking into account the element resistance value and electron emission characteristics. A film thickness d of the element electrodes 2 and 3 may be in a range from several tens nm to several number $\mu$m.

Instead of the structure shown in FIGS. 2A and 2B, a structure of a conductive thin film 4 and facing element electrodes 2 and 3 sequentially laminated in this order on a substrate 1 may also be used.

[Conductive Thin Film]

It is preferable that the conductive thin film 4 is made of a fine particle film containing fine particles.

The thickness of the conductive thin film 4 is set as desired, by taking into account the step coverage relative to the element electrodes 2 and 3, the resistance value between the element electrodes 2 and 3, forming process conditions to be described later, and the like. Generally, the thickness is preferably set in a range from a multiple of 0.1 nm by several times to several hundreds nm, or more preferably in a range from 1 nm to 50 nm.

The resistance value Rs of the conductive film is $10^2$ to $10^7$ Ω/□. Rs is defined by R=Rs(l/w) where R is a resistance of a thin film having a thickness t, a width w, and a length l.

In this specification, a power conduction process is described illustratively as the forming process. The forming process is not limited only to the power conduction process, but the forming process is intended to include any other process which can form cracks in the film and produce a high resistance.

The material of the conductive thin film 4 may be selected as desired from: metal such as Pd, Pt, Ru, Ag, Au, Ti, In, Cu, Cr, Fe, Zn, Sn, Ta, W, and Pd; oxide such as PdO, $SnO_2$, $In_2O_3$, PbO, and $Sb_2O_3$; boride such as $HfB_2$, $ZrB_2$, $LaB_6$, $CeB_6$, $YB_4$, and $GdB_4$; carbide such as TiC, ZrC, HfC, TaC, SiC, and WC; nitride such as TiN, ZrN, and HfN; semiconductor such as Si and Ge; carbon; and the like.

[Fine Particles]

A fine particle film is intended herein to mean a film made of an aggregation of a plurality of fine particles. In this fine structure of the fine particle film, fine particles are distributed in a dispersed manner, disposed adjacent to each other, or superposed upon each other (including an island structure of fine particles). The diameter of a fine particle is in a range from a multiple of 0.1 nm by several times to several hundreds nm, or preferably in a range from 1 nm to 20 nm.

The meaning of the term "fine particles" often used in this specification will be described.

It is prevailing that a small particle is called a "fine particle", a partial smaller than this is called an "ultra fine particle", and a particle smaller than the "ultra fine particle" having several hundreds atoms or less is called a "cluster".

The boundaries among these terms are not strictly determined, and change based upon the quality to which attention is paid. The "fine particle" and "ultra fine particle" are collectively called "fine particle" in some cases. This specification conforms with this definition.

The following description is found in "Experimental Physics Lecture 14, Surface·Fine Particles", edited by Kunio KISHITA, Kyoritsu Shuppan, published on Sep. 1, 1986.

"In this discussion, it is intended that the term "fine particle" means a particle having a diameter from about 2 to 3 $\mu$m to about 10 nm, and the term "ultra fine particle" used where applicable means a particle having a diameter from about 10 nm to about 2 to 3 nm. Both the fine particle and ultra fine particle are collectively called simply a fine particle in some cases, and the discrimination between these terms is not strict, but these terms are used to roughly discriminate therebetween. If the number of atoms constituting a particle is two to about several tens to several hundreds, the particle is called a cluster." (page 195, rows 22 to 26). For reference sake, the smallest particle diameter of the "ultra fine particle" defined by "HAYASHI·Ultra Fine Particle Project", New Technology Development Institute is smaller than the above definition, and the following description is found.

"In the "Ultra Fine Particle Project" by Creative Science and Technology Propagation System (1981 to 1986), a particle having a diameter in a range of about 1 to 100 nm is called an "ultra fine particle". With this definition, one ultra fine particle is an aggregation of 100 to $10^8$ atoms. From the viewpoint of atomic scale, the ultra fine particle is a large particle or a giant particle." (Ultra Fine Particles—Creative Science and Technology—", edited by Chikara HAYASHI, Ryouji UEDA, Akira TAZAKI, Mita Shuppan, 1988, page 2, rows 1 to 4). "A particle smaller than an ultra fine particle, i.e., one particle having several atoms to several hundreds atoms is generally called a cluster." (Same Publication, page 2, rows 12 and 13).

Basing upon the general terminology described above, the term "fine particle" used in this specification is intended to mean an aggregation of a number of atoms and molecules having a smallest particle diameter of a multiple of 0.1 nm by several times to about 1 nm and a largest particle diameter of about several number $\mu$m.

[Electron Emitting Area]

The electron emitting area 5 has high resistance cracks and the like locally formed in the conductive thin film 4. The characteristics of the electron emitting area 5 depend on the thickness, quality, and material of the conductive thin film 4, a power conduction forming process to be described later, and other factors. The electron emitting area 5 has in some cases conductive fine particles having a diameter in a range from a multiple of 0.1 nm by several times to several tens nm. The conductive fine particle contains some or all elements constituting the material of the conductive thin film 4. After an activating process, the electron emitting area has a deposit substance of carbon, carbon compound, or both. This deposit substance exists also on the conductive thin film 4 near the electron emitting area 5.

[Vertical Type Surface Conduction Electron Emitting Element]

Next, a vertical type surface conduction electron emitting element will be described.

Figure 3:
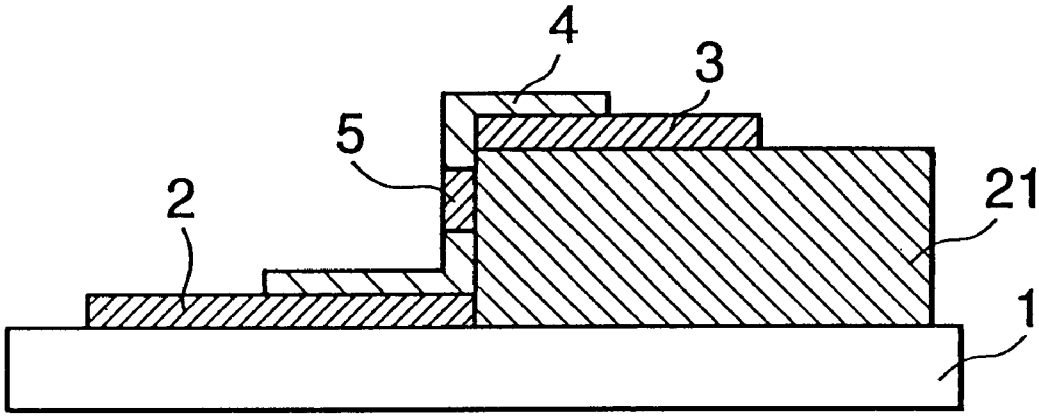
FIG. 3 is a schematic diagram showing the structure of a vertical surface conduction type electron emitting element applicable to the invention.

FIG. 3 is a schematic diagram showing an example of a vertical type surface conduction electron emitting element to which a surface conduction type electron emitting element of the invention is applicable.

In FIG. 3, like elements to those shown in FIG. 2 are represented by identical reference numerals.

Reference numeral 21 represents a step forming member. A substrate 1, element electrodes 2 and 3, a conductive thin film 4, and an electron emitting area 5 can be formed by using the same materials as those of the horizontal type surface conduction electron emitting element described above. The step forming member 21 may be made of insulating material such as $SiO_2$ through vacuum deposition, printing, sputtering or the like. A thickness of the step forming member 21 may be in a range from several hundreds nm to several tens $\mu$m, corresponding to the element electrode space L of the horizontal type surface conduction electron emitting element. The thickness of the step forming member 21 is preferably in a range from several tens nm to several number $\mu$m, which thickness is determined by taking into account the manufacture method for the step forming member and a voltage applied across the element electrodes.

After the element electrodes 2 and 3 and step forming member 21 are formed, the conductive thin film 4 is laminated upon the element electrodes. In FIG. 3, although the electron emitting area 5 is formed on the side wall of the step forming member 21, the shape and position of the electron emitting area 5 are not limited only thereto, but may be changed based upon the step forming conditions and power conduction forming process conditions.

[Manufacture Method of Surface Conduction Electron Emitting Element]

Figure 4A:
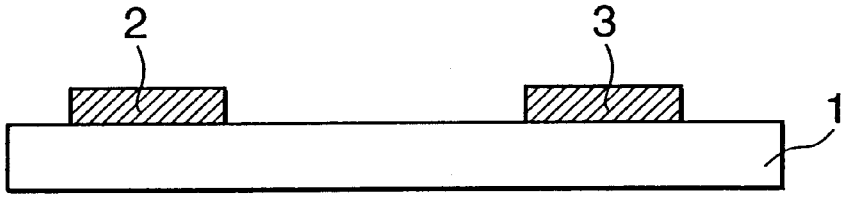
FIGS. 4A, 4B and 4C are schematic diagrams illustrating an example of a manufacture method for a surface conduction type electron emitting element applicable to the invention.
Figure 4B:
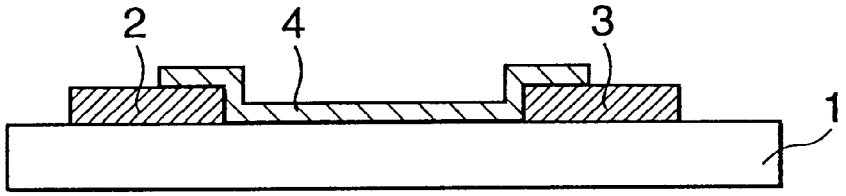
Figure 4C:
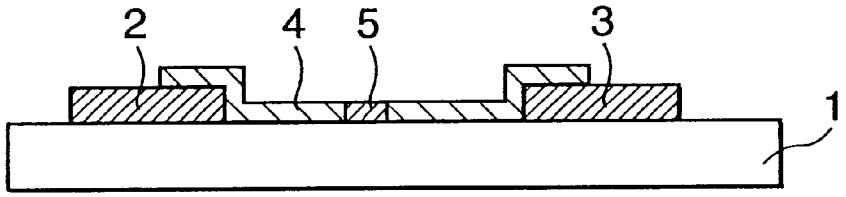

There are various methods of manufacturing a surface conduction type electron emitting element. One of the methods are schematically shown in FIGS. 4A to 4C.

An example of the manufacture method will be described with reference to FIGS. 2A and 2B and FIGS. 4A to 4C. In FIGS. 4A to 4C, like elements to those shown in FIGS. 2A and 2B are represented by using identical reference numerals.

1) The substrate 1 is fully cleaned with rinsing liquid, pure water, organic solvent and the like. Element electrode material is deposited on the substrate 1 through vacuum deposition, sputtering or the like and patterned through photolithography to form the element electrodes (FIG. 4A).

2) Organic metal solution is coated on the substrate 1 with the element electrodes 2 and 3 to form an organic metal thin film. The organic metal solution may be a solution of organic metal compound containing as its main compositions the metal material of the conductive film 4 described earlier. The organic metal thin film is heated and cured, and thereafter patterned through lift-off, etching and the like to form the conductive thin film 4 (FIG. 4B). The conductive thin film 4 may be formed not only by coating organic metal solution but by vacuum deposition, sputtering, chemical vapor deposition, dispersion coating, dipping, spinner or the like. Solution of the organic metal compound may be applied to a desired surface area of the substrate 1 as droplets from an ink jet printer. In this case, the patterning process by lift-off, etching and the like is not necessary.

3) [Forming process] Next, the forming process is performed. As an example of the forming process, a power conduction process will be described. As power is supplied from an unrepresented power source between the element electrodes 2 and 3, the electron emitting area 5 with a changed internal structure is formed in the conductive thin film 4 (FIG. 4C). With the power conduction forming process, the conductive thin film 4 is locally broken, deformed, or decomposed to form the changed internal structure of the conductive thin film 4 which constitutes the electron emitting area 5.

Figure 5A:
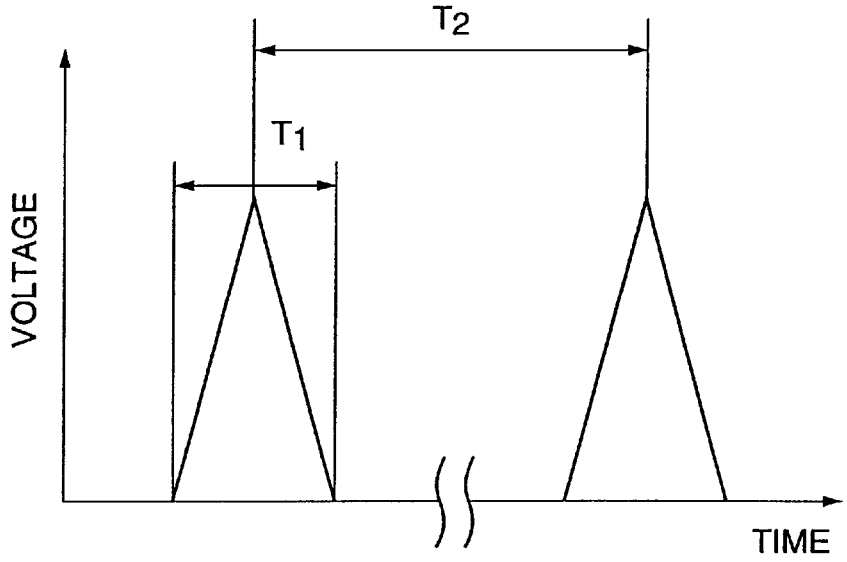
FIGS. 5A and 5B are schematic diagrams showing example of the voltage waveform usable by a power conduction forming process of a manufacture method for a surface conduction type electron emitting element applicable to the invention.
Figure 5B:
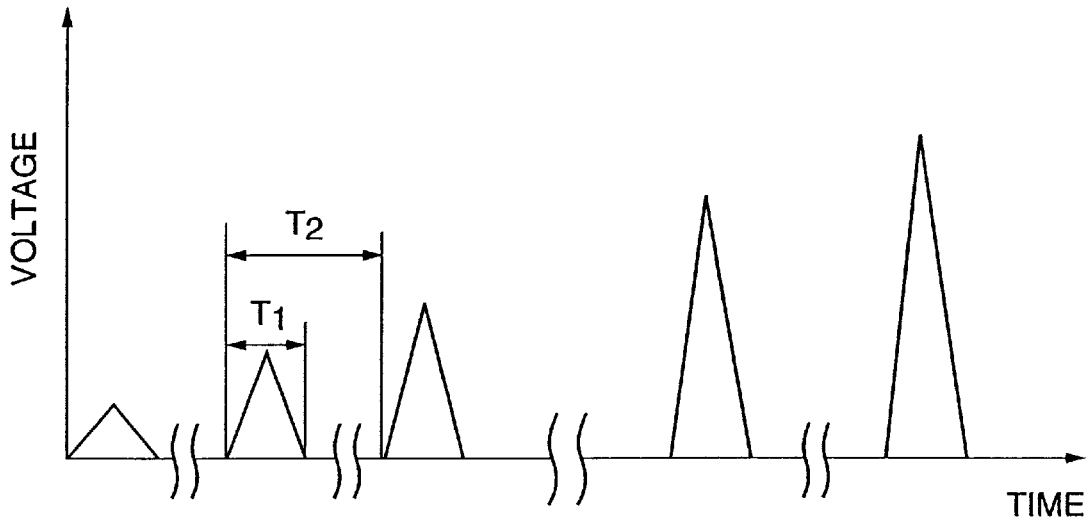

Examples of the voltage waveform used by the power conduction forming process are shown in FIGS. 5A and 5B. A voltage waveform is preferably a pulse waveform. Voltage pulses having a constant peak voltage are sequentially applied as shown in FIG. 5A, or voltage pulses gradually rising its peak voltage are applied as shown in FIG. 5B.

T1 and T2 shown in FIG. 5A are a pulse width and a pulse interval of the voltage pulses. Generally, T1 is set in a range from 1 $\mu$sec to 10 msec, and T2 is set in a range from 10 $\mu$sec to several hundreds msec. The peak value of a triangular wave (peak voltage during the power conduction forming process) is selected as desired in accordance with the type of a surface conduction type current emitting element. Voltage pulses are sequentially applied for several seconds to several tens minutes under such conditions. The pulse voltage waveform is not limited only to a triangular wave, but other waveforms such as a rectangular wave may also be used.

T1 and T2 shown in FIG. 5B may be set similar to those shown in FIG. 5A. The peak value of a triangular wave (peak voltage during the power conduction forming process) may be incremented, for example, by about 0.1 V step.

A completion of the power conduction forming process can be detected by applying a voltage during the interval T2 between pulses and measuring a current, the applied voltage not locally breaking and deforming the conductive thin film 2. For example, a voltage of about 0.1 V is applied and an element current is measured to calculate the resistance value. If the resistance value of 1 MΩ or higher is detected, the power conduction forming process is terminated.

In addition to the above forming process, other forming processes may also be applied if they can properly form an electron emitting area.

4) [Activating Process] A process called an activating process is performed for the element after the forming process. With the activating process, the element current If and emission current Ie can be changed considerably.

An example of the system usable by the activating process is shown in FIG. 1.

Similar to the power conduction forming process, the activating process of this embodiment sequentially applies pulse voltages under an atmosphere of a mixture gas of an inert gas such as nitrogen and helium and a gas containing organic material.

[Pressure for Introducing Mixture Gas for Forming Viscous Flow Region]

A pressure for introducing the mixture gas is set so that the mean free path λ of gas molecules constituting the mixture gas is sufficiently shorter than a typical size of the inner space in which an electron emitting element is placed (e.g., shorter than an inner diameter of a vacuum chamber, a distance between a substrate and a face plate of an image forming apparatus to be described later. This realizes a so-called viscous flow region. Specifically, if the mixture gas contains nitrogen and the typical size is 5 mm, the pressure for introducing the mixture gas is about 1 Pa. This pressure is only illustrative and the other pressure may be adopted if the viscous flow region can be realized. Generally, the pressure is preferably in a range from 100 Pa to about atmospheric pressure.

[Approximately Atmospheric Pressure]

An "approximately atmospheric pressure" is a pressure in a range from about 0.5 atmospheric pressure to about 1.5 atmospheric pressure, or more preferable in a range of 1 atomic pressure +/− 20%, which ranges do not require very severe air tightness or mechanical strength of the process system in order to maintain the atmosphere of the process system.

[Technical Meaning Why Activating Process is Performed at Approximately Atmospheric Pressure]

The technical meaning why the activating process is performed at an approximately atmospheric pressure will be described. The activating process is considered as a king of CVD (chemical vapor deposition) for generating deposit substance by polymerizing or decomposing organic material by electron collision or Joule heat. A general CVD includes an atmospheric pressure CVD and a low pressure CVD. The atmospheric pressure CVD forms a deposit film through thermal decomposition or the like by introducing source gas into a chamber, whereas the low pressure CVD forms a deposit film through thermal decomposition or the like under a low pressure by introducing source gas after the inside of the chamber is made in a vacuum state.

The pros and cons of the atmospheric CVD and low pressure CVD will be described.

The cons of the atmospheric CVD are:

1) Source gas is likely to become excessive, and the deposit film may become high polymer (containing C);
2) Dilution gas may be contained in a deposit film depending upon a selection of dilution gas, e.g., if $N_2$ is used as dilution gas, N is contained in the deposit film; and
3) A distribution in composition of a deposit film is likely to occur because the gas concentration distributes from a gas inlet port to a gas outlet port as gas is consumed.

The pro of the atmospheric CVD is a large deposition rate.

The cons of the low pressure CVD are:

1) A deposition rate is low; and
2) Dilution gas may be contained in a deposit film depending upon a selection of dilution gas, e.g., if $N_2$ is used as dilution gas, N is contained in the deposit film.

A con of the low pressure CVD is that source gas does not become excessive, and the deposit film in a high polymer (containing C) is rare.

As above the atmospheric pressure CVD and low pressure CVD have advantages on one side and disadvantages on the other side.

The present inventors have found that if the activating process is performed by the atmospheric pressure CVD, the cons of the general atmospheric pressure CVD will not occur.

The reasons why the cons of the atmospheric pressure CVD do not occur even if the activating process is performed at an atmospheric pressure, may be ascribed to the following:

1) High polymer is hard to be produced, because the temperature near at the cracks during the activating process is high and activated materials are not changed to high polymer but thermally decomposed to produce graphite or the like;
2) A distribution in composition of a deposit film is small, because although a general atmospheric pressure CVD decomposes introduced gas with a heated filament and deposits precursor, the activating process decomposes only molecules attached to the cracks of the electron emitting area and produces graphite or the like so that the introduced source gas is consumed less; and
3) Dilution gas is hard to be contained in a deposit film because graphite or the like is produced from the same reason as 1).

During the activating process, the deposition rate is faster at the atmospheric pressure than at the low pressure. This is because an amount of attached gas is determined by an introduced gas pressure and the like and the speed of producing graphite and the like increases during the activating process.

By performing the activating process at an approximately atmospheric pressure, the process system can be simplified as compared to a vacuum process system, and in addition, the time required for evacuating the vacuum process system can be omitted and a manufacture time can be shortened.

[Circulator, Moisture Absorber]

During the activating process, the circulator 201 externally mounted on the chamber is activated to uniformly transport the introduced mixture gas in the whole space of the chamber. The moisture absorber 202 is mounted on the air suction side or air drain side of the circulator to efficiently remove moisture produced in the chamber.

The circulator may be fan type propellers, mechanical pumps such as a Roots pump and a membrane pump, and the like. The moisture absorber may be drying agent such as silica gel and molecular sheaves, material deliquescence material such as $P_2O_5$, trap freezed lower to a freezing point, and the like.

A mixture partial pressure of the material to be mixed is set properly depending upon the application fields, the shape of a vacuum chamber, the kind of organic material, and the like. Generally, a mixture partial pressure is preferable set to about $1/10^6$ to bout $1/10^4$ of the total pressure.

[Source Gas]

The organic material to be mixed may be: aliphatic hydrocarbon such as alkane acid, alkene, and alkyne; aromatic hydrocarbon; alcohol; aldehyde; ketone; amine; and organic acid such as phenol; carvone; or sulfonic acid. More specifically, the organic material may be: saturated hydrocarbon typically methane, ethane and propane; unsaturated hydrocarbon having a composition $C_nH_{2n}$ or the like such as ethylene and propylene; benzene; toluene; methanol; ethanol; formaldehyde; acetaldehyde; acetone; methylethyl ketone; methylamine; ethylamine; phenol; formic acid; acetic acid; propionic acid; or a mixture thereof.

With the activating process, carbon or carbon compound is deposited derived from organic material present in the atmosphere onto the element, so that the element current If and emission current Ie change considerably.

A completion of the activating process is judged properly by measuring the element current If and emission current Ie. The pulse width, pulse interval, pulse peak value are set properly.

[Deposit Substance Containing Carbon as Its Constituent Element]

The deposit substance containing at least carbon as its constituent element may be graphite or amorphous carbon. The graphite contains so-called HOPG, PG, or GC. HOPG has a perfect graphite crystal structure. PG has a crystal structure slightly disturbed and having a crystal grain of about 200 angstroms. GC has a crystal structure more disturbed and having a crystal grain of about 20 angstroms. The amorphous carbon includes amorphous carbon itself and a mixture of amorphous carbon and fine crystals of graphite. The deposit substance is therefore made of carbon, carbon compound, or a mixture of carbon and carbon compound.

A thickness of the deposit substance is preferably 50 nm or thinner, and more preferably 30 nm or thinner.

5) [Stabilizing Process] It is preferable to perform a stabilizing process for an electron emitting element formed by the above processes. This stabilizing process is a process of draining organic material in the vacuum chamber. The evacuator for evacuating the inside of the vacuum chamber is preferably an evacuator of the type not using oil, so that the performance of the element may not be degraded by oil. Specifically, the evacuator may be a sorption pump, an ion pump or the like.

The partial pressure of organic components in the vacuum chamber is preferably $1.3\times10^{-6}$ Pa or lower, or more preferably $1.3\times10^{-8}$ Pa or lower, which partial pressures prevent carbon or carbon compound from being newly deposited. When the inside of the vacuum chamber is evacuated, it is preferable to heat the vacuum chamber so that organic material attached to the inner wall of the vacuum chamber and to the electron emitting element becomes easy to be drained. The heating conditions are 80 to 250° C. and preferably 150° C. or higher and it is desired to perform the heating process as long as possible. The heating conditions are not limited only to the above conditions, but the heating conditions may be determined as desired depending upon various conditions such as the size and shape of a vacuum chamber and the structure of an electron emitting element. It is necessary to maintain the pressure in the vacuum chamber as low as possible, and the pressure is preferable $1.35^{-5}$ Pa or lower, or more preferably $1.3\times10^{-6}$ Pa or lower.

Although the atmosphere surrounding the electron emitting element after the stabilizing process and during its operation is preferably the atmosphere at the completion of the stabilizing process, it is not limited thereto, but sufficiently stable characteristics may be retained even if the vacuum degree is degraded if organic material was sufficiently drained.

By retaining the vacuum atmosphere as above, it is possible to suppress of deposition of new carbon or carbon compound and to remove $H_2$) and $O_2$ attached to the vacuum chamber or substrate to thus stabilize the element current If and emission current Ie.

[Fundamental Characteristics of Electron Emitting Element]

The fundamental characteristics of an electron emitting element applicable to the invention obtained by the above processes will be described with reference to FIGS. 6 and 7.

FIG. 6 is a schematic diagram showing an example of a vacuum process system. This vacuum process system is also provided with a function of a measurement/evaluation system. In FIG. 6, like elements to those shown in FIGS. 2A and 2B are represented by using identical reference numerals. In FIG. 6, reference numeral 55 represents a vacuum chamber, and reference numeral 56 represents a vacuum pump. An electron emitting element is placed in the vacuum chamber 55. Reference numeral 1 represents a substrate on which an electron emitting element is formed, reference numerals 2 and 3 represent element electrodes, reference numeral 4 represents a conductive film, and reference numeral 5 represents an electron emitting area. Reference numeral 51 represents a power source for applying an element voltage Vf to the electron emitting element, reference numeral 50 represents an ammeter for measuring an element current If flowing through the conductive thin film 4, and reference numeral 54 represents an anode electrode for capturing electrons (an emission current Ie) emitted from the electron emitting area 5. Reference numeral 53 represents a high voltage source for applying a voltage to the anode electrode 54, and reference numeral 52 represents an ammeter for measuring the emission current Ie from the electron emitting area 5. For example, the anode electrode voltage may be set in a range from 1 kV to 10 kV and a distance H between the anode electrode and electron emitting element may be set in a range from 2 mm to 8 mm to conduct measurements.

Unrepresented instruments such as a vacuum meter necessary for the measurements in a vacuum atmosphere are installed in the vacuum chamber 55, so that measurement/evaluation in a desired vacuum atmosphere can be conducted. The vacuum pump 56 is constituted of a general high vacuum system such as a turbo pump and a rotary pump and an ultra high vacuum system such as an ion pump. The whole of the vacuum process system with the electron emitting element can be heated with an unrepresented heater. The power conduction forming process and following process can be performed by using this vacuum process system.

Figure 7:
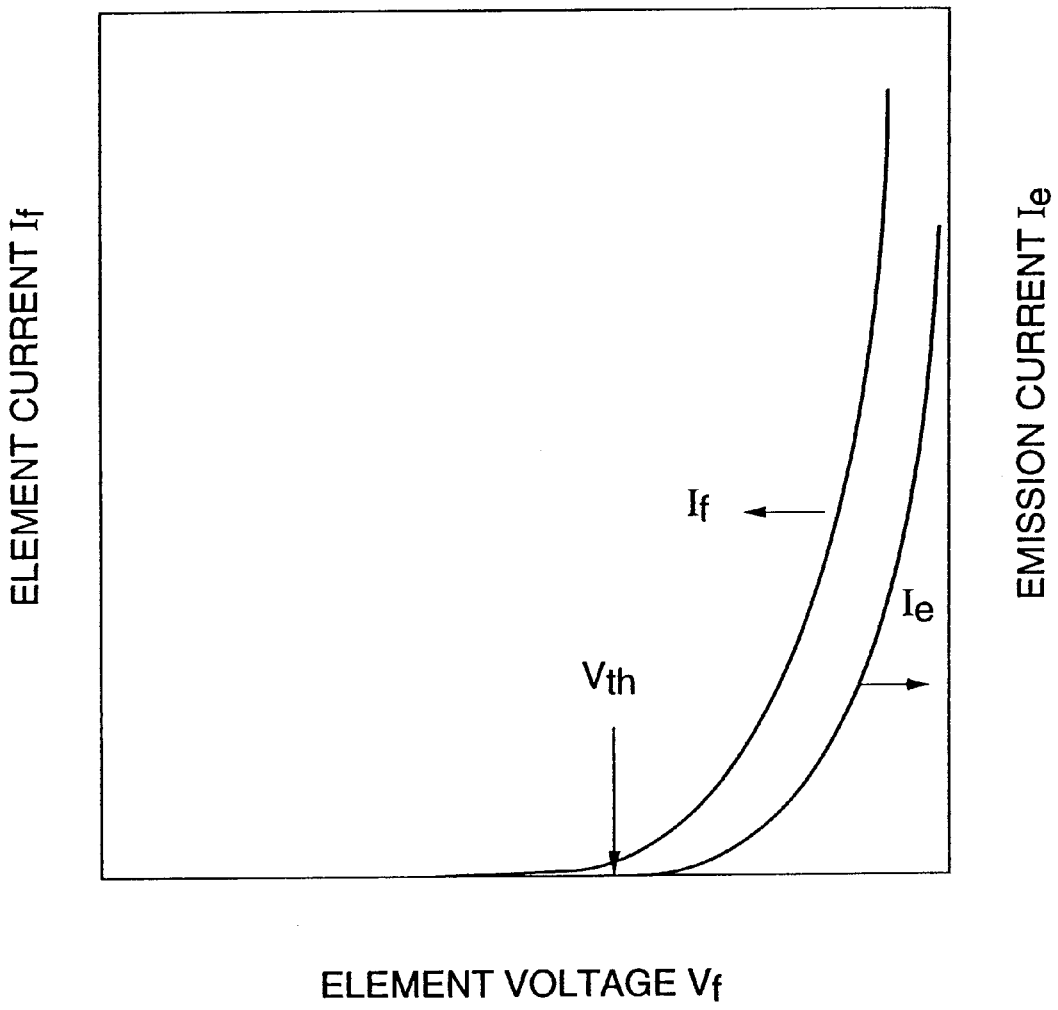
FIG. 7 is a graph showing an example of the relation among an emission current Ie, an element current If, an element voltage Vf, respectively of a surface conduction type electron emitting element applicable to the invention.

FIG. 7 is a graph showing a relation among the emission current Ie, element current If, and element voltage Vf measured with the vacuum process system shown in FIG. 6. In FIG. 7, since the emission current Ie is considerably smaller than the element current If, they are indicated by arbitrary scales. Both the ordinate and abscissa are indicated by a linear scale.

As seen from FIG. 7, the emission current Ie of a surface conduction type electron emitting element applicable to the invention has three characteristic features:

(i) If a voltage equal to or larger than a certain voltage (called a threshold voltage Vth shown in FIG. 7) is applied to the element, the emission current Ie increases abruptly, whereas if a voltage lower than the threshold value Vth is applied, the emission current hardly flows. Namely, the emission current Ie is non-linear having a threshold value (Vth) relative to Vf.

(ii) Since the emission current Ie increases monotonously with the element voltage Vf, the emission current Ie can be controlled by the element voltage Vf.

(iii) An amount of charges captured by the anode electrode 54 depends on the time while the element voltage Vf is applied. Namely, the charge amount captured by the anode electrode 54 can be controlled by the application time of the element voltage Vf.

As can be understood from the foregoing description, the electron emission characteristics of a surface conduction type electron emitting element applicable to the invention can be controlled easily by an input signal. By utilizing this feature, various application fields can be realized such as an electron source and an image forming apparatus with a plurality of electron emitting elements.

In the example shown in FIG. 7, the element current If monotonously increases relative to the element voltage Vf (hereinafter called "MI characteristics"). The element current If has in some cases a voltage controlled type negative resistance (hereinafter called "VCNR characteristics"). In this case, the stable MI characteristics can be obtained by performing the stabilizing process. These characteristics can be controlled by the above-described processes.

[Electron Source and Image Forming Apparatus]

Examples of an application of an electron emitting element applicable to the invention will be described hereinunder. If a plurality of surface conduction type electron emitting elements are disposed on a substrate, an electron source, an image forming apparatus, and the like can be configured.

Various layouts of electron emitting elements may be incorporated.

One example is a ladder type layout in which a number of rows are disposed in parallel in a row direction, each row having a plurality of surface conduction type electron emitting elements each having both terminals being connected by wiring patterns, and electrons to be emitted from the electron emitting elements are controlled by control electrodes (also called grids) disposed above the electron emitting element in a direction (column direction) perpendicular to the wiring patterns.

Another example is a simple matrix layout in which a plurality of electron emitting elements are disposed in a matrix shape in X- and Y-directions, ones of the two electrodes of respective electron emitting elements disposed at the same row are connected in common to the X-direction wiring pattern, and the others of the two electrodes of respective electron emitting elements disposed at the same column are connected in common to the Y-direction wiring pattern. The simple matrix layout will be detained hereinunder.

[Electron Source of Simple Matrix Layout]

A surface conduction type electron emitting element applicable to the invention has the characteristic features (i) and (iii) described above. Specifically, an amount of electrons emitted from a surface conduction type electron emitting element can be controlled in a range not smaller than the threshold value, in accordance with a peak value and width of a pulse voltage applied across element electrodes facing each other. In a range not larger than the threshold value, electrons are hardly emitted. According to these characteristic features, even if a number of surface conduction type electron emitting elements are disposed, the electron emission amount of each element can be selectively controlled in accordance with an input signal by applying a proper pulse voltage.

Figure 8:
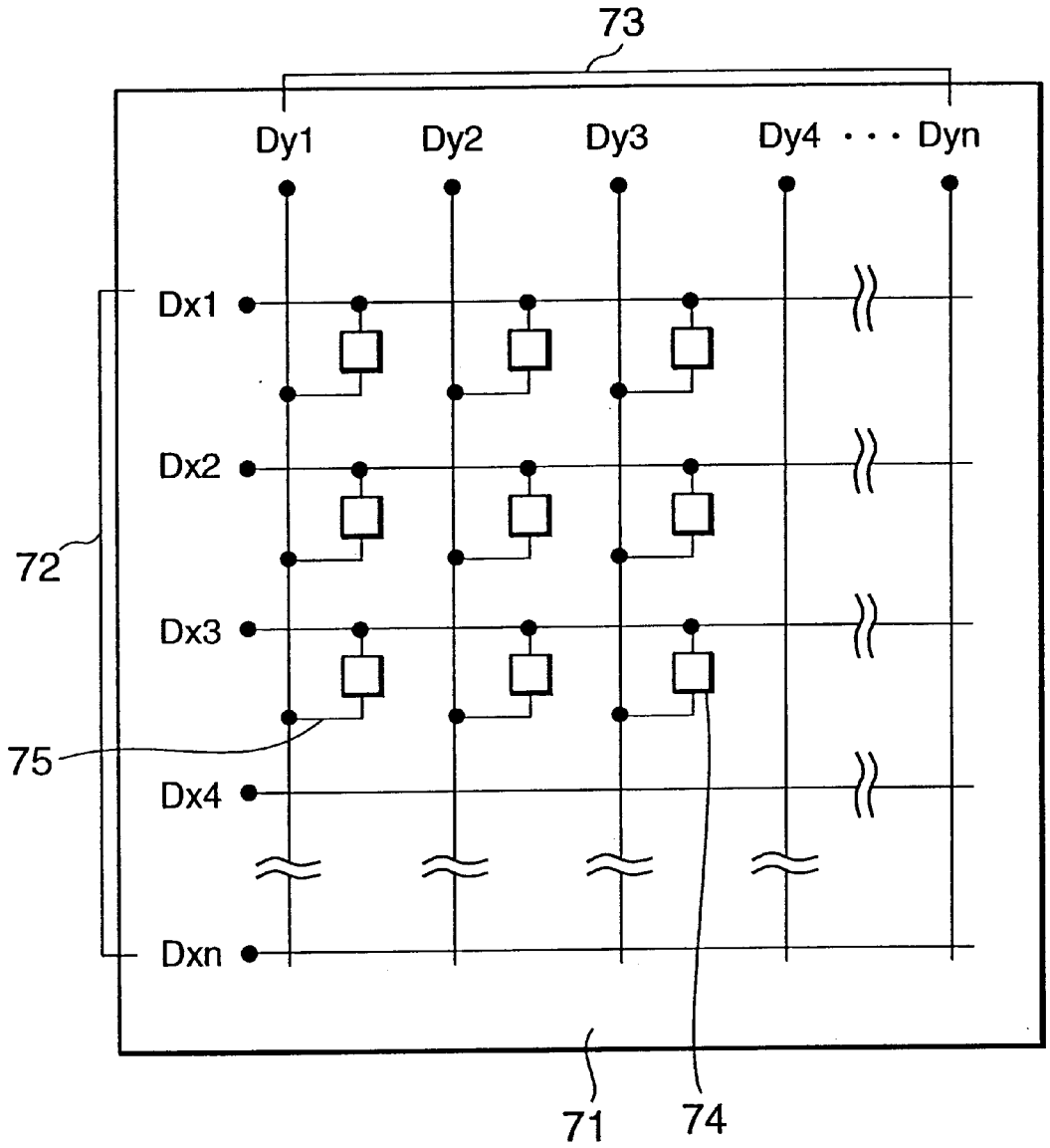
FIG. 8 is a schematic diagram showing an example of an electron source with a simple matrix layout applicable to the invention.

An electron source basing upon this operation principle and having a plurality of electron emitting elements applicable to the invention will be described with reference to FIG. 8. In FIG. 8, reference numeral 71 represents an electron source substrate, reference numeral 72 represents an X-direction wiring pattern, and reference numeral 73 represents a Y-direction wiring pattern. Reference numeral 74 represents a surface conduction type electron emitting element, and reference numeral 75 represents an interconnect pattern. Each surface conduction type electron emitting element 74 may be either a horizontal type or a vertical type described earlier.

The X-direction wiring patterns 72 include m patterns Dx1, Dx2, . . . , Dxm and may be made of conductive metal or the like formed through vacuum vapor deposition, printing, sputtering, and the like. The material, thickness, and width of the wiring pattern can be designed as desired. The Y-direction wiring patterns 73 include n patterns Dy1, Dy2, . . . , Dyn and may be formed by a method similar to that used for the X-direction wiring patterns 72. An unrepresented interlayer insulating layer is formed between the m X-direction wiring patterns 72 and n Y-direction wiring patterns 73 to thereby electrically separate those patterns (m and n are both a positive integer).

The interlayer insulating film may be made of $SiO_2$ or the like formed through vacuum vapor deposition, printing, sputtering or the like. For example, the interlayer insulating film is formed on the whole surface or partial surface of the substrate 71 with the X-direction wiring patterns 72. The film thickness, material, and process conditions are properly designed, particularly to be resistant against a potential difference at a cross point between the X- and Y-direction wiring patterns 72 and 73. The X- and Y-direction wiring patterns 72 and 73 are connected to external terminals.

A pair of element electrodes (not shown) of each surface conduction type electron emitting element 74 is connected via the interconnect wiring patterns made of conductive metal or the like to corresponding ones of the m X-direction and n Y-direction wiring patterns 72 and 73.

The wiring patterns 72 and 73, interconnect patterns 75, and element electrodes may be made of materials having the same constituent elements or different constituting elements. Proper materials are selected from those materials of the element electrodes described earlier. If the element electrodes and wiring patterns are made of the same material, the wiring pattern connected to the element electrode integrally constitutes the element electrode.

An unrepresented scan signal applying means is connected to the X-direction wiring patterns 72 to apply a scan signal and select a row of the surface conduction type electron emitting elements disposed in the X-direction. An unrepresented modulating signal generation means is connected to the Y-direction wiring patterns 73 to modulate each column of the surface conduction type electron emitting elements disposed in the Y-direction, in accordance with an input signal. A drive voltage applied to each electron emitting element is a difference voltage between the scan signal and modulation signal applied to the subject element.

With the structure described above, each element can be selected and independently driven by using simple matrix wiring patterns.

[Image Forming Apparatus with Simple Matrix Layout Electron Source]

Figure 9:
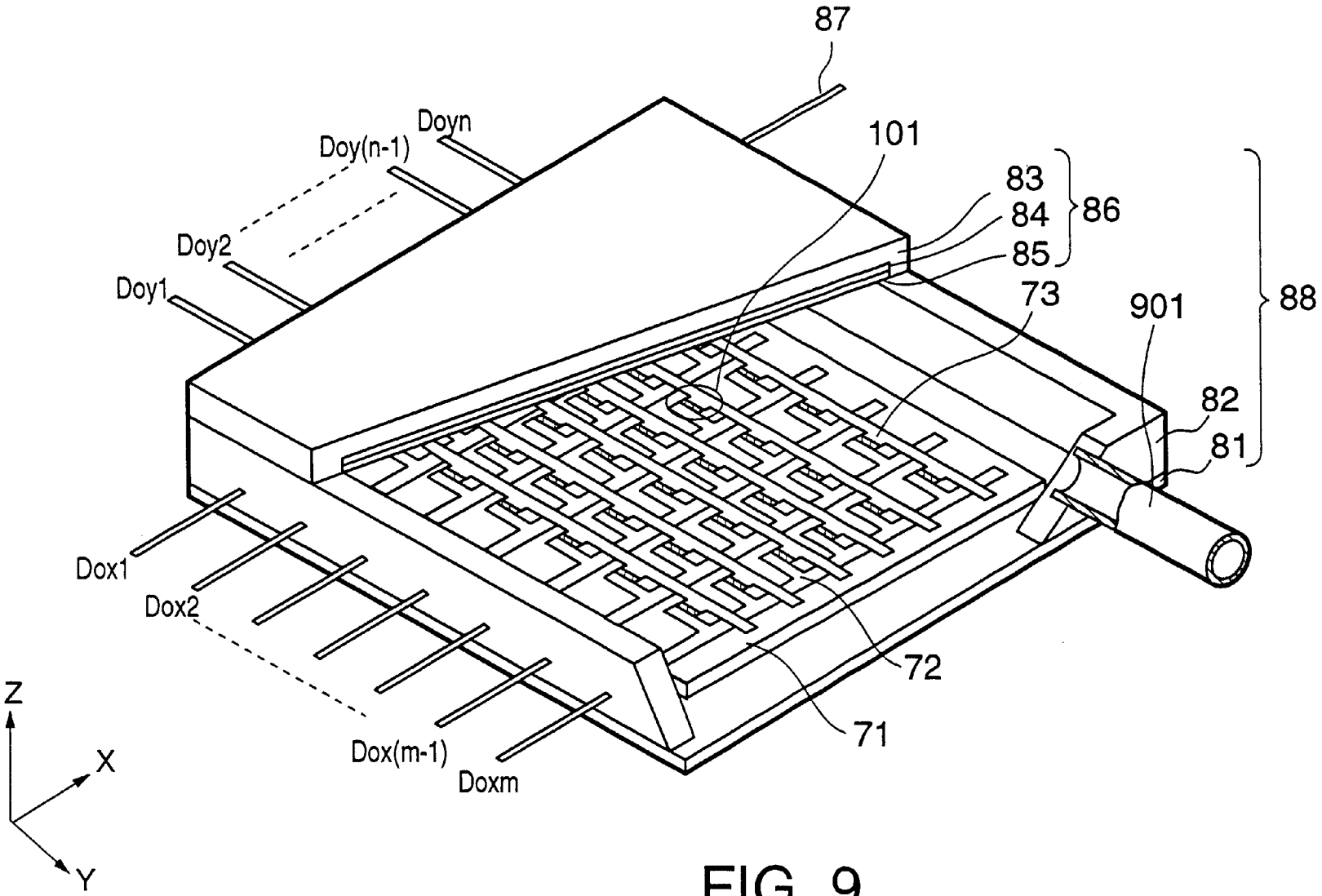
FIG. 9 is a schematic diagram showing an example of a display panel of an image forming apparatus applicable to the invention.
Figure 10A:
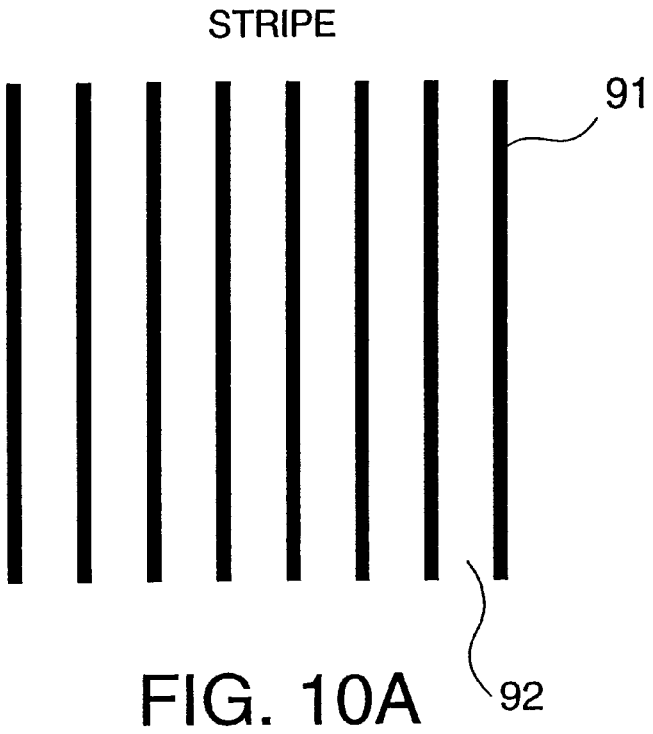
FIGS. 10A and 10B are schematic diagrams showing examples of a fluorescent film.
Figure 10B:
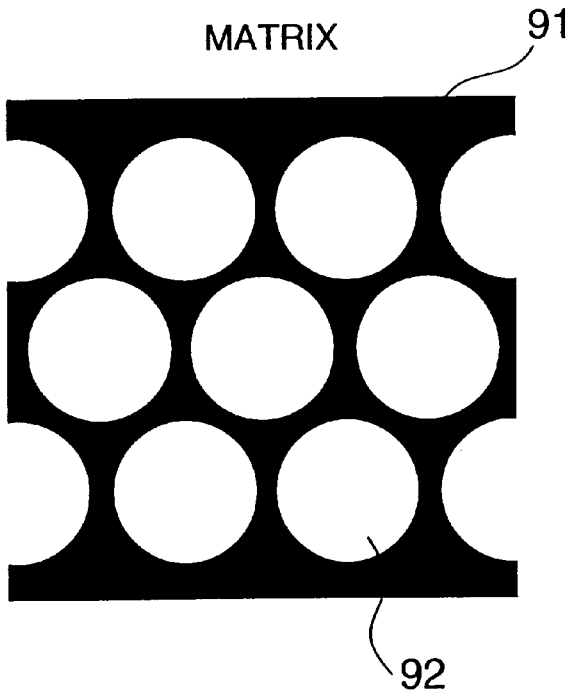
Figure 11:
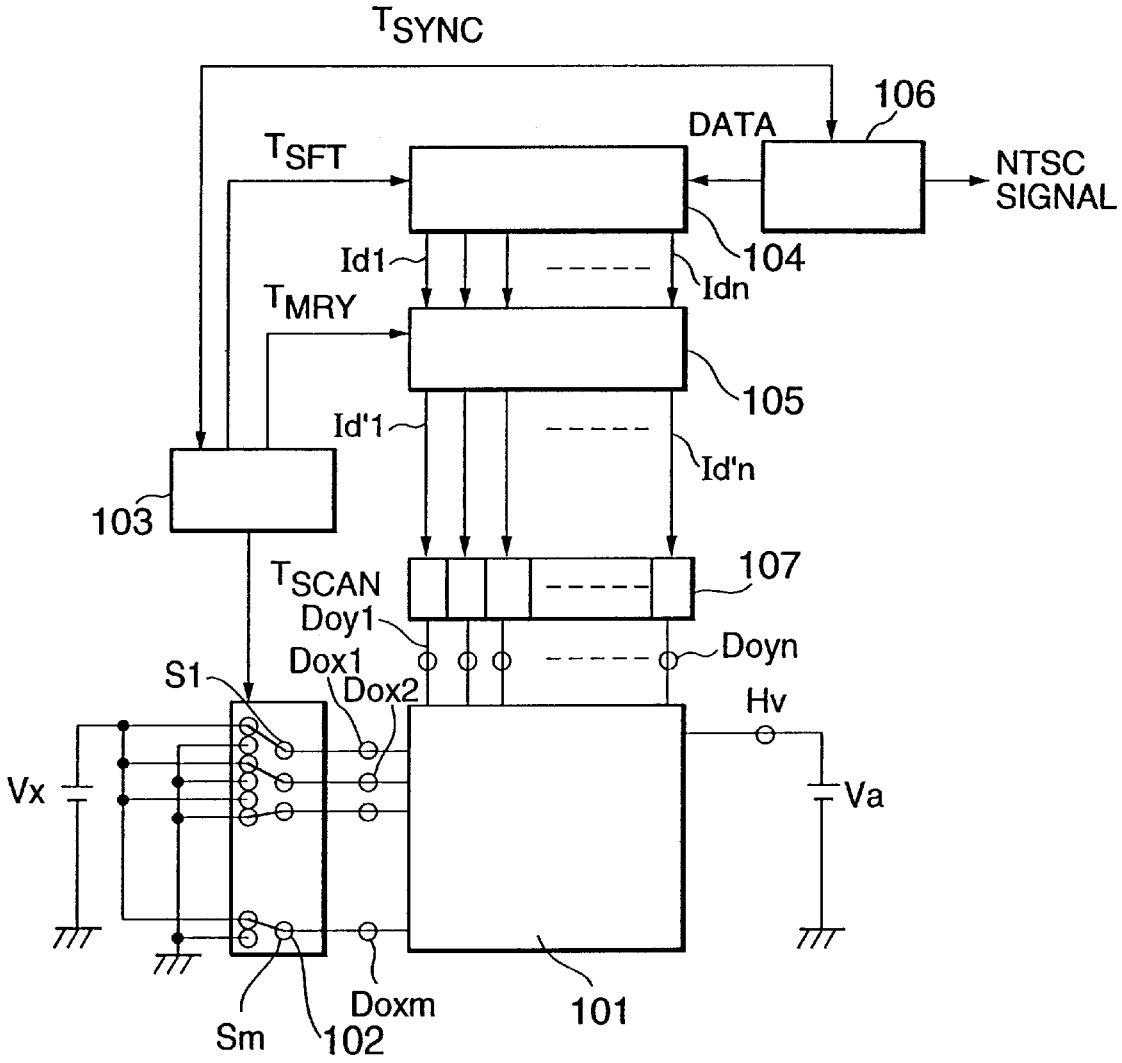
FIG. 11 is a block diagram showing an example of a drive circuit for displaying NTSC television signals on an image forming apparatus.

An image forming apparatus using an electron source with a simple matrix layout will be described with reference to FIG. 9, FIGS. 10A and 10B, and FIG. 11. FIG. 9 is a partially broken perspective view showing an example of a display panel of an image forming apparatus, and FIGS. 10A and 10B are schematic diagrams showing examples of a fluorescent film used with an image forming apparatus. FIG. 11 is a block diagram showing an example of a driver circuit for displaying NTSC television signals.

In FIG. 9, reference numeral 71 represents an electron source substrate with a plurality of electron emitting elements, reference numeral 81 represents a rear plate to which the electron source substrate 71 is fixed, and reference numeral 86 represents a face plate constituted of a glass substrate 83 whose inner surface is formed with a fluorescent film 84, a metal back 85, and the like. Reference numeral 82 represents a support frame 82 to which the rear plate 81 and face plate 86 are adhered with low melting point frit glass.

Reference numeral 74 represents an electron emitting area such as shown in FIGS. 2A and 2B. Reference numerals 72 and 73 represent X- and Y-direction wiring patterns connected to pairs of element electrodes of the surface conduction type electron emitting elements.

An outer envelope 88 is constituted of the face plate 86, support frame 82, and rear plate 81. The rear plate 81 is provided mainly for reinforcing the strength of the substrate 71. If the substrate 71 itself has a sufficient strength, the rear plate 81 may be omitted. Namely, the support frame 82 is bonded directly to the substrate 71 to constitute the outer envelope 88 with the face plate 86, support plate 82, and substrate 71. An unrepresented support called a spacer may be mounted between the face plate 86 and rear plate 81 to form the outer envelope 88 having a sufficient strength resistance to the atmospheric pressure.

FIGS. 10A and 10B are schematic diagrams showing fluorescent films. The fluorescent film 84 is made of only fluorescent material in the case of a monochrome display. In the case of a color display, black color conductive material 91 called a black stripe or black matrix and fluorescent material 92 are used. The black stripe or black matrix is provided in order to make black an area between fluorescent materials of necessary three primary colors and make color mixture or the like not conspicuous, and in order to suppress the contrast from being lowered by external light reflection at the fluorescent film 84. The material of the black stripe may be a commonly used material whose main component is black lead, or a conductive material having less light transmission and reflection.

Fluorescent material may be coated on the glass substrate 83 through precipating, printing and the like, irrespective of either a monochrome display or a color display. The metal back 85 is usually mounted on the inner surface of the fluorescent film 84. The objects of the metal back are to improve a luminance by mirror-reflecting light radiated to the inner surface from the fluorescent material toward the face plate 86 side, to use the metal back as an electrode for applying an electron beam acceleration voltage, to protect the fluorescent material from damages to be caused by collision with negative ions generated in the outer envelope, and the like. After the fluorescent film is formed, the inner surface of the fluorescent film is subjected to a smoothing process (generally called "filming") and thereafter Al is deposited through vacuum vapor deposition to form the metal back.

In order to improve the conductivity of the fluorescent film 84 of the face plate 86, a transparent electrode (not shown) may be formed on the outer surface of the fluorescent film 84.

In hermetically bonding the face plate 86, support frame 82, and rear plate 81, it is necessary to reliably align the positions of each fluorescent material and electron emitting element,

[Manufacture Method for Image Forming Apparatus]

Figure 12:
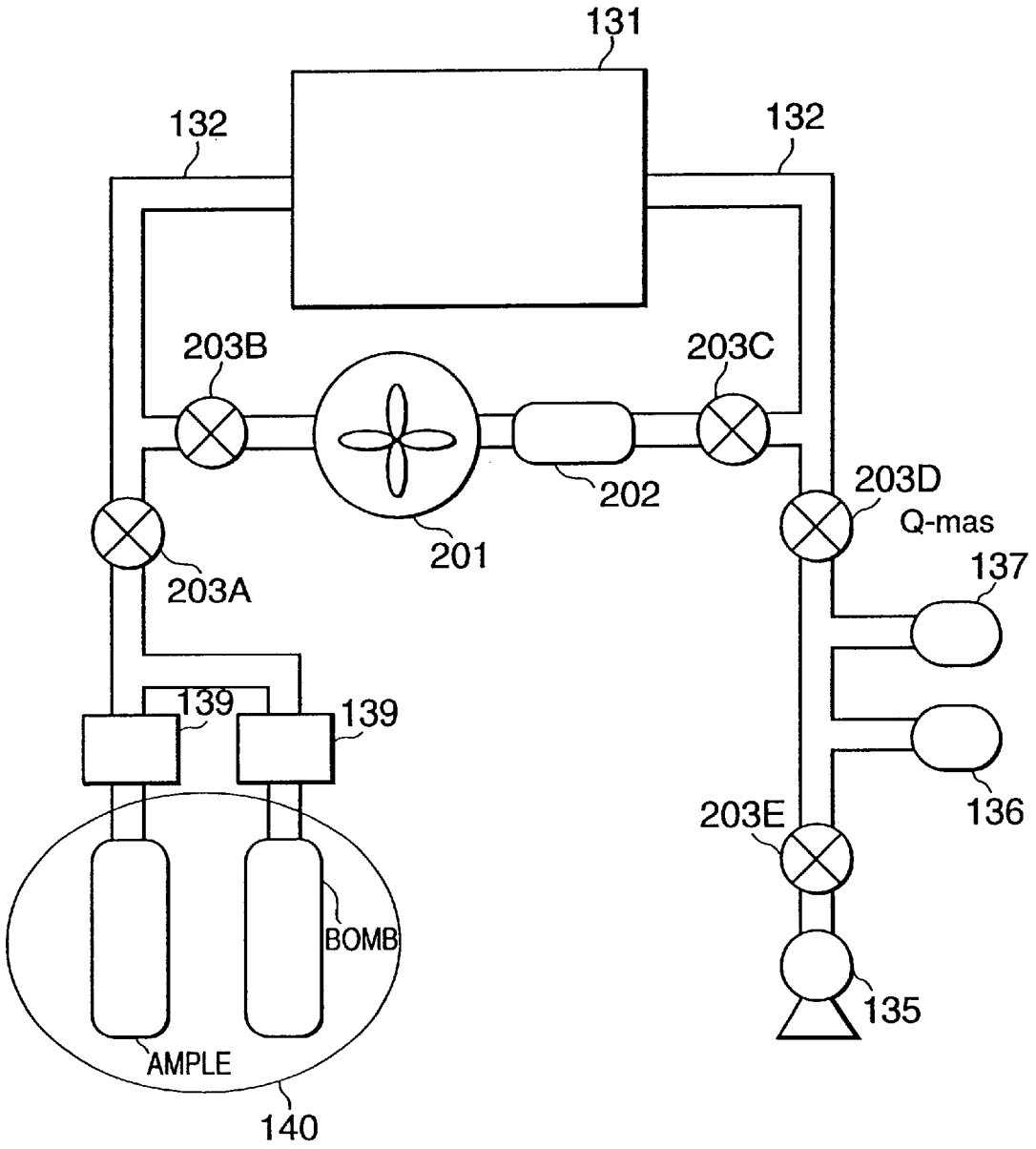
FIG. 12 is a schematic diagram showing a vacuum evacuator system used for the forming and activating processes for an image forming apparatus according to the invention.

FIG. 12 is a schematic diagram showing the outline of a system used for manufacturing an image forming apparatus. Two pipes 132 are coupled to an image forming apparatus 131, one being connected to an evacuator 135 and the other being connected to a gas supply source 140 which stores a supply gas in an ampoule, bomb or the like. The two pipes 132 are connected together via a circulator 201 and a moisture absorber 202. A supply gas amount control means 139 for controlling a supply gas rate is connected to the pipe interconnecting the image forming apparatus 131 and gas supply source 140. Specifically, the supply gas amount control means may be a slow leak valve capable of controlling a leak flow rate, a mass flow controller, or the like, although the selection of the supply gas amount control means depends on the type of a supply gas. An unrepresented power source is connected to the image forming apparatus 131.

[Forming Process]

Figure 15:
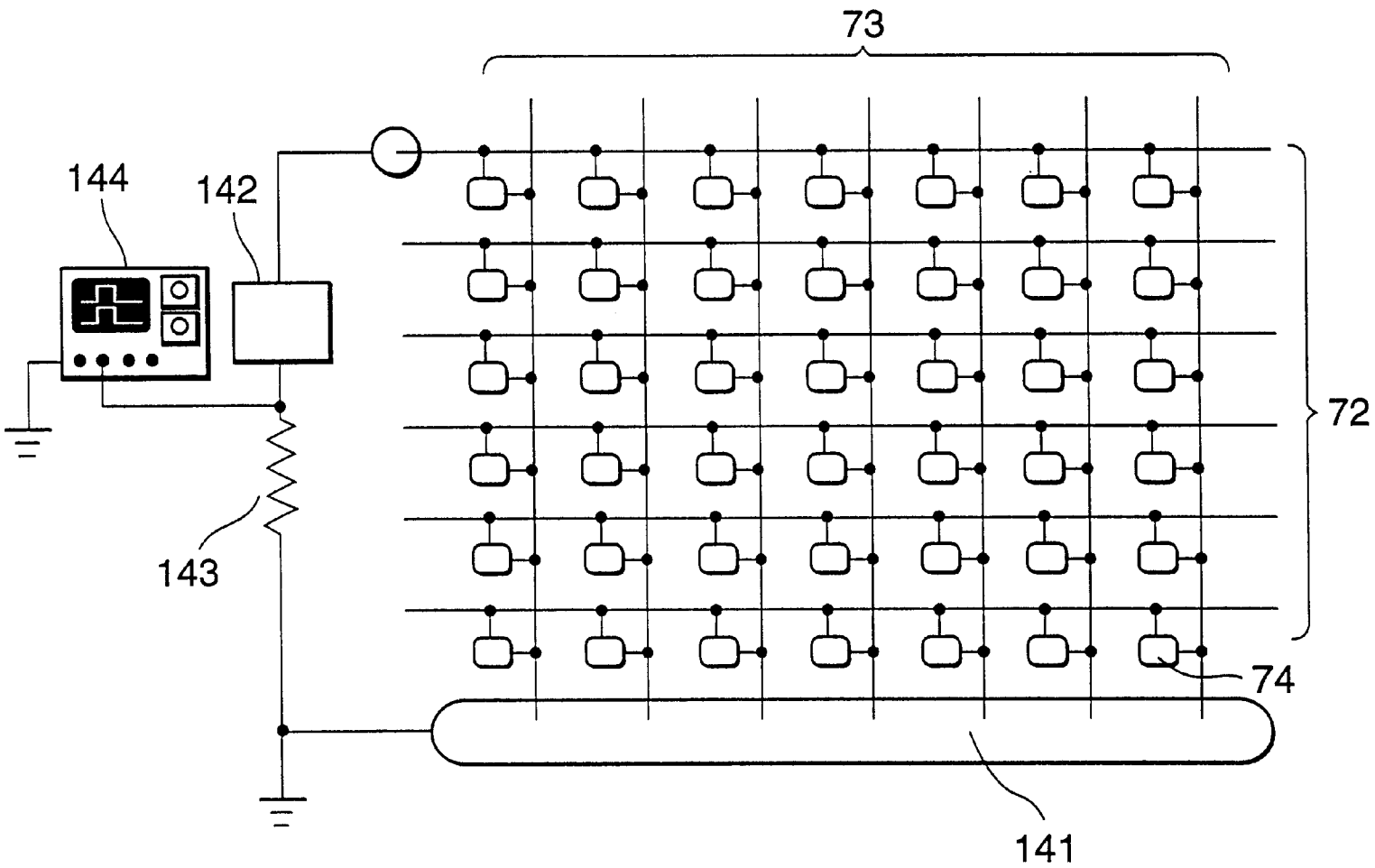
FIG. 15 is a schematic diagram illustrating a wiring method during the forming and activating processes for an image forming apparatus according to the invention.
Figure 16:
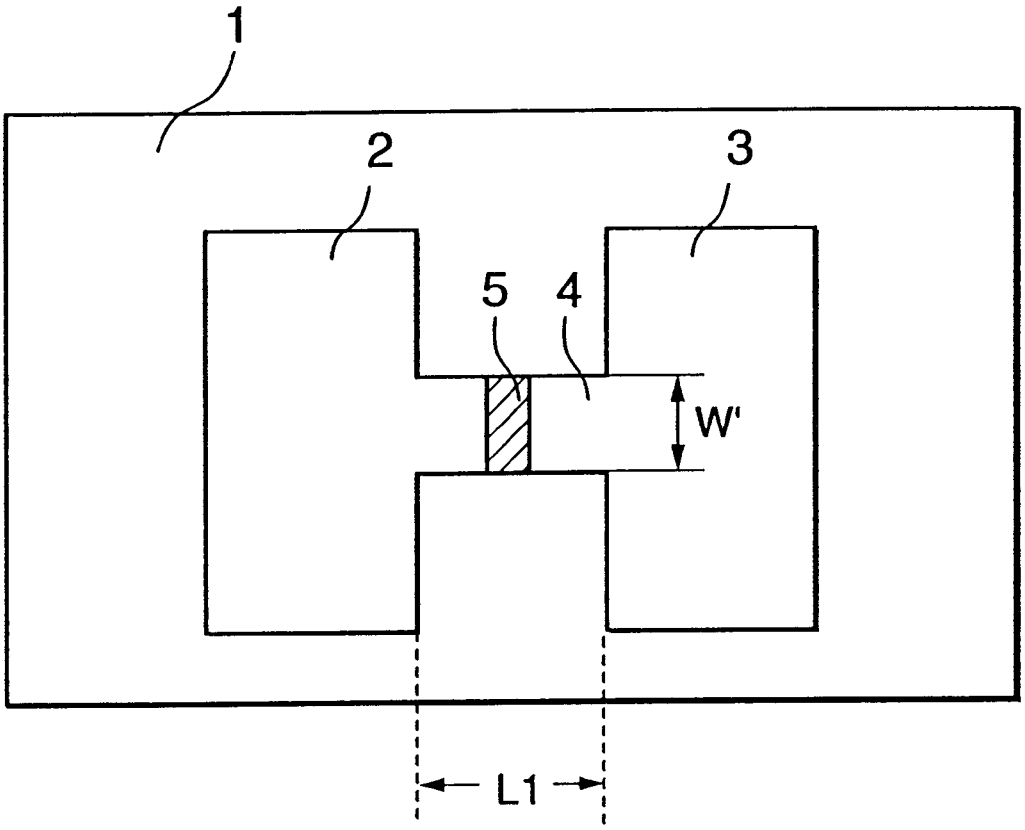
FIG. 16 is a schematic diagram showing an example of a conventional surface conduction type electron emitting element.

By using the system shown in FIG. 12, the inside of the image forming apparatus 131 is evacuated, and thereafter the forming process is performed. For example, as shown in FIG. 15, Y-direction wiring patterns 73 are connected to a common electrode 141. A voltage pulse from a power source 142 is applied at the same time to those elements connected to one X-direction wiring pattern 72, to thereby perform the forming process. The waveform of a pulse voltage and the process completion judgement conditions and the like may be determined in accordance with the methods already described with the forming process for an independent element. The forming process may be performed by sequentially applying (scrolling) pulses with shifted phases to a plurality of X-direction wiring patterns, collectively for those elements connected to the patterns. In FIG. 15, reference numeral 143 represents a current measuring resistor, and reference numeral 144 represents an oscilloscope for measuring the current.

[Activating Process]

After the forming process, the activating process is performed. After the inside of the image forming apparatus 131 is sufficiently evacuated, a mixture gas containing organic material is introduced from the gas supply source 140 into the image forming apparatus. When a pressure corresponding to a viscous flow region is obtained, all the valves are closed to seal the mixture gas. Next, only the valves to the circulator 201 and moisture absorber 202 are opened to circulate the mixture gas in the image forming apparatus 131.

In the atmosphere containing the organic material formed in the above manner, a voltage is applied to each electron emitting element to deposit carbon, carbon compound, or a mixture of them on an electron emitting area. Similar to the independent element described earlier, the electron emission amount increases drastically. Similar to the forming process, a pulse voltage is applied at the same time to those connected to one X-direction wiring pattern.

[Stabilizing Process]

Similar to the independent element, it is preferable to perform the stabilizing process after the activating process.

The image forming apparatus 131 is heated and maintained at 80 to 250° C. In this state, the inside of the image forming apparatus 131 is evacuated via the pipe 132 by the evacuator 135 not using oil such as an ion pump and a sorption pump to maintain an atmosphere with less organic material. The pipe 132 is then melted and sealed by using a burner. A getter process may be performed thereafter in order to maintain the pressure after the image forming apparatus 131 is sealed. With this getter process, a getter (not shown) disposed at a predetermined position in the image forming apparatus 131 is heated through resistance heating or high frequency heating, to thereby form a deposition film. The getter has usually Ba or the like as its main composition, and the atmosphere in the image forming apparatus 131 is maintained by the absorption function of the deposition film.

[Driver Circuit for Electron Source]

With reference to FIG. 11, an example of the structure of a driver circuit for displaying NTSC television signals on a display panel having an electron source of a simple matrix layout will be described. In FIG. 11, reference numeral 101 represents an image display panel, reference numeral 102 represents a scan circuit, reference numeral 103 represents a control circuit, and reference numeral 104 represents a shift register. Reference numeral 105 represents a line memory, reference numeral 106 represents a sync signal separation circuit, reference numeral 107 represents a modulation signal generator, and Vx and Vy are d.c. voltage sources.

The display panel 101 is connected to an external electronic circuit via terminals Dox1 to Doxm, terminals Doy1 to Doyn, and a high voltage terminal Hv. A scan signal is sequentially applied to the terminals Dox1 to Doxm to drive the electron source in the display panel, i.e., the surface conduction type electron emitting element group matrix-wired in an M rows×N columns one row (n elements) after another.

A modulation signal is applied to the terminals Doy1 to Doyn to control an output electron beam of each element of one-row surface conduction type electron emitting group selected by the scan signal. A d.c. voltage of, for example, 10 kV, is applied from a d.c. voltage source Va to the high voltage terminal Hv. This d.c. voltage is an acceleration voltage for imparting an energy sufficient for exciting the fluorescent material, to the electron beam radiated from the surface conduction type electron emitting element.

The scan circuit 102 will be described. The scan circuit 102 has M switching elements (S1 to Sm schematically shown in FIG. 11). Each switching element selects either an output voltage from a d.c. voltage source Vx or 0 V (ground level), and is electrically connected to a corresponding one of the terminals Dox1 to Doxm of the display panel 101. Each switching element S1 to Sm operates in response to a control signal Tscan output from the control circuit 103, and may be constituted of an FET switching element, for example.

The d.c. voltage source Vx is designed to output a constant voltage, in accordance with the characteristics (electron emission threshold voltage) of a surface conduction type electron emitting element, so that a drive voltage applied to an element not scanned becomes the threshold voltage or lower.

The control circuit 103 has a function of controlling each circuit so that a proper image can be displayed in accordance with an externally input image signal. The control circuit 103 supplies control signals such as Tscn, Tsft, and Tmry to each circuit synchronously with the sync signal Tsync supplied from the sync separation circuit 106.

The sync separation circuit 106 derives sync signal components and luminance signal components from an externally input NTSC television signal, and may be constituted of a general frequency separation (filter) circuit. Although the sync signal separated by the sync separation circuit 106 consists of a vertical sync signal and a horizontal sync signal, they are collectively shows as the Tsync signal in FIG. 11 for the convenience of description. The luminance signal components separated from the television signal are represented by a DATA signal also for the convenience of description. The DATA signal is supplied to the shift register 104.

The shift register 104 performs a serial/parallel conversion of the DATA signal input time sequentially and serially into parallel signals of each line of the image, and operates in response to the control signal Tsft supplied from the control circuit 103 (namely, the control signal Tsft is used as a shift clock of the shift register 104). The serial/parallel converted data (corresponding to the drive data for the n electron emitting elements) of one line of the image is output from the shift register 104 as n parallel signals Id1 to Idn.

The line memory 105 stores data of one line during a necessary time, i.e., stores the contents of Id1 to Idn, in response to the control signal Tmry supplied from the control circuit 103. The stored contents are output to the modulation signal generator 107 as signals Id'1 to Id'n.

The modulation signal generator 107 generates a signal for driving and modulating each of the surface conduction type electron emitting elements in accordance with the image data Id'1 to Id'n. The output signals are applied via the terminals Doy1 to Doyn to the surface conduction type electron emitting elements of the display panel 101.

As described earlier, the electron emitting element applicable to the invention has the following fundamental features with respect the emission current. Specifically, electron emission is associated with a. definite threshold voltage Vth, and occurs only when a voltage of Vth or higher is applied. In a range of the voltage of Vth or higher, an emission current changes with an element application voltage. Therefore, for example, in applying a pulse voltage to the element, if a voltage not higher than the electron emission threshold voltage is applied, electron emission does not occur, whereas if a voltage not lower than the electron emission threshold voltage is applied, an electron beam is radiated. In this case, the intensity of the output electron beam can be controlled by changing the pulse peak voltage Vm. The total amount of charges of the output electron beam can be controlled by changing the pulse width Pw.

Accordingly, as a method of modulating an electron emitting element in accordance with an input signal, a voltage modulation method, a pulse width modulation method, and the like can be adopted. For the voltage modulation method, a voltage modulation circuit can be used as the modulation signal generator 107 in which circuit a voltage pulse of a constant duration is generated and the peak value of a pulse is modulated by input data.

For the pulse width modulation method, a pulse width modulation circuit can be used as the modulation signal generator 107 in which a voltage pulse of a constant peak value is generated and the pulse width is modulated by input data.

The shift register 104 and line memory 105 may be either a digital signal type or an analog signal type, so long as the serial/parallel conversion and storage of an image signal can be performed in a predetermined process time.

If the digital signal type is used, it is necessary to convert the DATA signal output from the sync signal separation circuit 106 into digital signals. To this end, an A/D converter is provided at the output of the sync signal separation circuit 106. The modulation signal generator 107 is changed slightly in accordance with whether the output signal of the line memory 105 is a digital signal or an analog signal. Specifically, for the voltage modulation method using a digital signal, the modulation signal generator 107 is additionally provided with, for example, a D/A converter and an amplifier circuit if necessary. For the pulse width modulation method, the modulation signal generator 107 is replaced by, for example, a high speed oscillator, a counter for counting a wave number of an output of the oscillator, and a comparator for comparing an output of the counter with an output of the line memory 105. If necessary, an amplifier may be added for voltage-amplifying the pulse width modulated signal output from the comparator up to a drive voltage of a surface conduction type electron emitting element.

For the voltage modulation method using an analog signal, for example, an amplifier such as an operation amplifier is used as the modulation signal generator, and if necessary, a level shift circuit is added. For the pulse width modulation method, for example, a voltage controlled oscillator (VCO) is used as the modulation signal generator, and if necessary, an amplifier is added for voltage-amplifying an output of VCO up to a drive voltage of a surface conduction type electron emitting element.

In the image displaying apparatus applicable to the invention and constructed as above, electron emission occurs when voltages are applied to each electron emitting element via corresponding ones of the external terminals Dox1 to Doxm and Doy1 to Doyn. The electron beam is accelerated by applying a high voltage to the metal back 85 or transparent electrode (not shown) via the high voltage terminal Hv. The accelerated electrons collide with the fluorescent film 84 which emits light and forms an image.

The structure of the image forming apparatus described above is only one example of an image forming apparatus applicable to the invention. Various modifications are therefore possible based upon the technical concept of the invention. Instead of an NTSC input signal, other television signals may also be used, such as PAL, SECAM, and television signals (MUSE, and HDTV) having a number of scan lines larger than PAL and SECAM.

[Electron Source of Ladder Layout and Image Forming Apparatus]

Next, a ladder layout electron source and an image forming apparatus will be described with reference to FIGS. 13 and 14.

Figure 13:
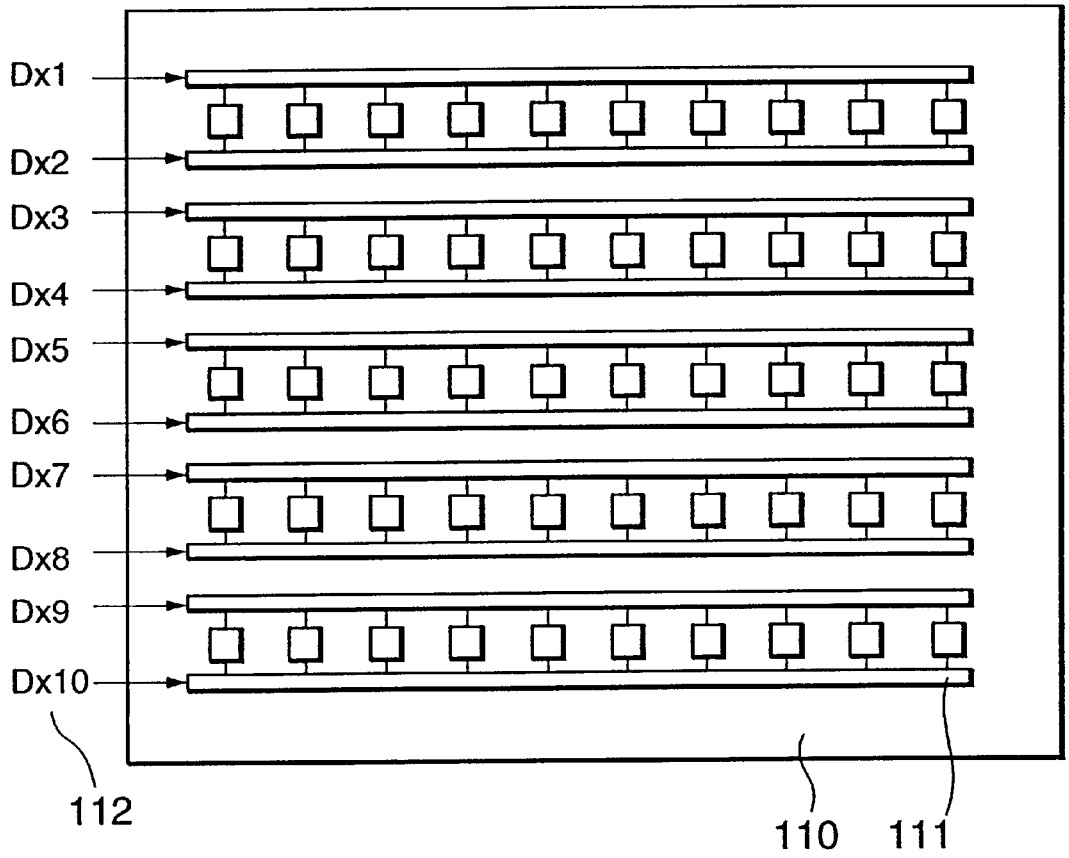
FIG. 13 is a schematic diagram showing an example of an electron source of a ladder layout applicable to the invention.

FIG. 13 is a schematic diagram showing an example of a ladder layout electron source. In FIG. 13, reference numeral 110 represents an electron source substrate, and reference numeral 111 represents an electron emitting element. Reference numeral 112 represents common wiring patterns Dx1 to Dx10 for connecting corresponding electron emitting elements. A plurality of element rows are disposed in parallel in the X-direction on the substrate 110 to constitute the electron source, each element row having a plurality of electron emitting elements 111. A drive voltage is applied between the common wiring patterns of each element row to independently drive the element row. Namely, a voltage not lower than the electron emission threshold voltage is applied to the element row from which an electron beam is desired to be radiated, and a voltage not higher than the electron emission threshold voltage is applied to the element row from which an electron beam is not desired to be radiated. Of the common wiring patterns Dx2 to Dx9, Dx2 and Dx3 for example may be formed by the same wiring pattern.

Figure 14:
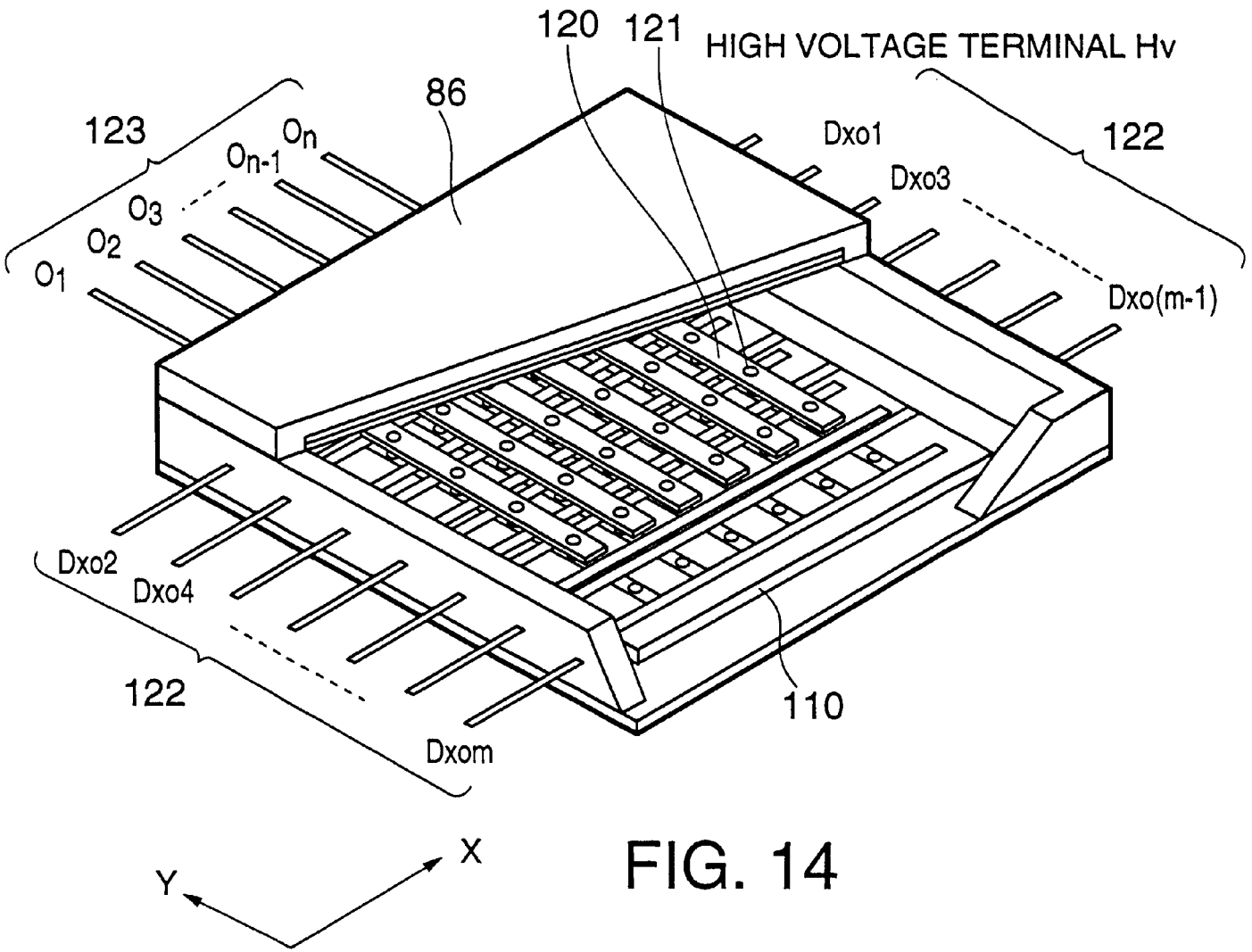
FIG. 14 is a schematic diagram showing an example of a display panel of an image forming apparatus applicable to the invention.

FIG. 14 is a partially broken perspective view showing an example of the panel structure of an image forming apparatus having an electron source of a ladder layout. Reference numeral 120 represents a grid electrode, reference numeral 121 represents a through hole through which electrons pass, and reference numeral 122 represents external terminals Dxo1, Dxo2, . . . , Dxom. Reference numeral 123 represents external terminals G1, G2, . . . , Gn connected to the grid electrodes 120, and reference numeral 110 represents an electron source substrate using the same wiring pattern for a pair of common wiring lines between element rows. In FIG. 14, like elements to those shown in FIGS. 9 and 13 are represented by using identical reference numerals. A significant difference of the image forming apparatus shown in FIG. 14 from the simple matrix layout image forming apparatus shown in FIG. 9 is a presence of grid electrodes 120 between the electron source substrate 110 and face plate 86.

Referring to FIG. 14, the grid electrodes 120 are formed between the substrate 110 and face plate 86. The grid electrode 120 is used for modulating electron beams radiated from the surface conduction type electron emitting elements. The grid electrode 120 is a stripe shaped electrode disposed perpendicular to each element row of the ladder layout, and has a circular through hole 121 per each element in order to pass the electron beam therethrough. The shape and position of the grid are not limited to those shown in FIG. 14. For example, a mesh having a number of holes may be used as the through hole 121, and the grid may be disposed around or near the surface conduction type electron emitting element.

The terminals 122 and 123 formed on the outside of the outer envelope are electrically connected to an unrepresented control circuit.

With the image forming apparatus described above, synchronously as the element rows are sequentially driven (scanned) one row after another, the modulation signals of one line of an image are applied at the same time to the grid electrode columns. In this manner, radiation of each electron beam toward the fluorescent film can be controlled and an image can be displayed one line after another.

The image forming apparatus of this invention can be used as display devices for television broadcasting, display devices for television conference systems and computers, or as an optical printer using a photosensitive drum and the like.

The embodiment will be described more specifically with reference to FIG. 1.

In this embodiment, the forming process and activating process were performed by placing a surface conduction type electron emitting element in the vacuum chamber 55. Reference numeral 1 represents a substrate constituting an electron emitting element, reference numerals 2 and 3 represent element electrodes, reference numeral 4 represents a conductive film, and reference numeral 5 represents an electron emitting area. Reference numeral 54 represents an anode electrode for capturing an emission current Ie emitted from the electron emitting area 5. The element electrodes 2 and 3 and anode electrode 54 are disposed outside of the vacuum chamber 55 and respectively connected to an element driving power source (not shown) and an emission electron measuring high voltage source (not shown).

The element placed in the vacuum chamber was manufactured by the embodiment method described above. The forming process was performed by applying a pulse voltage to the element placed in the vacuum chamber. The applied pulse had a triangular wave such as shown in FIG. 5B, with the pulse width of 1 msec and the pulse interval of 10 msec. The voltage was gradually raised during the forming process.

In the next activating process, a mixture gas of nitrogen gas and acetylene at a partial pressure of 1 Pa was used. The mixture gas was introduced into the vacuum chamber 55 in the atmospheric pressure and thereafter all the valves were closed. Thereafter, the valves to the circulator 201 and moisture absorber 202 were opened to circulate the mixture gas in the vacuum chamber by activating the circulator 201.

In this embodiment, four propellers were used as the circulator 201, and silica gel was used as the moisture absorber 202. Moisture in the vacuum chamber can therefore be removed.

The applied pulse used during the activating process had a rectangular wave and a peak value of 15 V. Under these conditions, the activating process was performed for 30 minutes. The element current If increased to 8 mA.

Thereafter, the inside of the vacuum chamber was evacuated while it was evacuated, to thereby perform the stabilizing process. The resultant electron emission characteristics of the element were If of 7 mA, Ie of 10 $\mu$A, and an electron emission efficiency $\eta$ of 0.14% under the conditions of an applied voltage of 15 V and an anode voltage of 1 kV.

Second Embodiment

The second embodiment will be described with reference to FIG. 12.

In the second embodiment, an image forming apparatus with a plurality of surface conduction type electron emitting elements being disposed was manufactured. The manufacture method was in conformity with the first embodiment method. The pipe 132 at a portion connecting to the image forming apparatus 121 is a glass tube.

In this embodiment, the forming process was performed by connecting the Y-direction wiring patterns to the common electrode and applying a voltage pulse to the elements connected to the X-direction wiring patterns. The applied pulse had a triangular wave, a pulse width of 1 msec, and a pulse interval of 16.7 msec. The voltage of the applied pulse was gradually raised.

For the activating process, a mixture gas of nitrogen gas and acetylene at a partial pressure of 1 Pa was used. The pressure of introducing the mixture gas was $5\times10^4$ Pa.

In this embodiment, a Roots pump was used as the circulator, and a cold trap cooled by refrigerant to −10° C. was used as the moisture absorber.

The applied pulse was a rectangular wave alternately changing its polarity, and had a peak value of 14 V. The pulses were applied for one hour.

After the activating process, the stabilizing process was performed while the image forming apparatus was heated and the inside thereof was evacuated. Then, the glass pipe was heated and melted by using a gas burner to hermetically seal the apparatus. Thereafter, the characteristics of each element were evaluated. The results were If of 4.1 mA, Ie of 8.3 $\mu$A, and an electron emission efficiency $\eta$ of 0.20% as an average under the conditions of an applied voltage of 14 V and an anode voltage of 5 kV. A variation of the characteristics of elements was small, and an image forming apparatus of high quality with less luminance variation could be manufactured.

In the first and second embodiments, the pressure of the mixture gas during the activating process was set to such a degree that the mixture gas was able to be used as the gas in the viscous flow region. It was therefore possible to supply necessary gas quickly. It was also possible to suppress a variation of element characteristics. Since the activating process was able to be performed without using a high vacuum evacuation system, the manufacture cost was able to be lowered.

In the first embodiment, the pressure of the mixture gas during the activating process was set to the atmospheric pressure so that necessary gas was able to be supplied quickly. In the second embodiment, the pressure of the mixture gas was set to $5\times10^4$ Pa. Accordingly, though, a processing time more than the first embodiment was necessary, within sufficiently shorter time, an activation could be achieved.

When the low manufacture cost is desired, approximately the atmospheric pressure or a pressure near the atmospheric pressure is utilized. However, if the pressure is too high, the apparatus cost rises so that it is desired to set the pressure lower than about several number atmospheric pressure.

Wherein the pressure may be set lower than the atmosphere. In such case, the pressure (total pressure in the container during the activating process) of the gas during the activating process may be 0.5 atmospheric pressure or lower, or 0.2 atmospheric pressure or lower, or most preferably 0.1 atmospheric pressure or lower. By setting the pressure lower, the characteristic improvement can be achieved. However, in order to efficiently supply the gas, the pressure (total pressure in the container during the activating process) of the gas during the activating process is preferably higher than 1 Pa, more preferably 100 Pa or higher, or most preferably 1000 Pa or higher.

In the first and second embodiments, since the gas during the activating process is circulated by using the circulator, the concentration distribution of the introduced source gas can be made uniform. The characteristics of elements can be made more similar.

Since moisture generated during the processes can be removed by the moisture absorber, adverse affects to be caused by moisture can be eliminated.

Third Embodiment

The third embodiment of the invention will be described.

Also in the activating process of the third embodiment, materials same as the first and second embodiments can be used as the organic material. As dilution gas and inert gas, rare gas such as argon and helium, and nitrogen may be used.

The mixture gas of organic material and inert gas is formed by controlling the gas flow rate, if the organic material is gas at a normal temperature. If the organic material is liquid or solid, it may be evaporated or sublimated in a container and mixed with inert gas. The mixture ratio of them can be adjusted by controlling the temperature of the container.

Figure 17A:
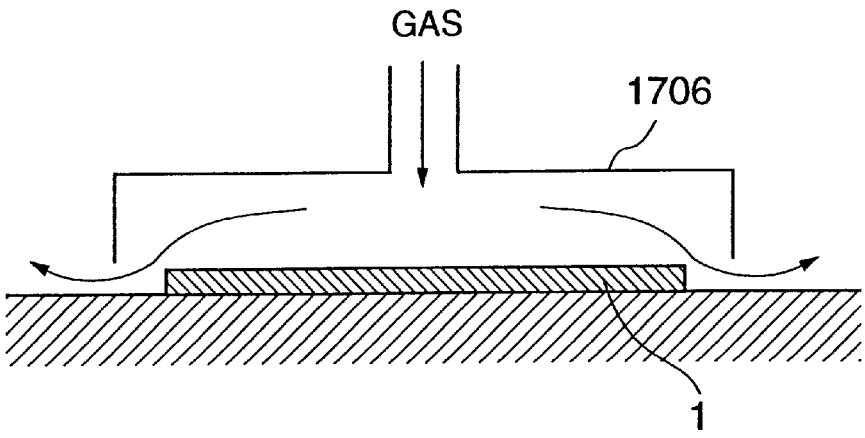
FIGS. 17A, 17B and 17C are schematic diagrams showing the process system used by the activating process of a manufacture method according to the invention.
Figure 17B:
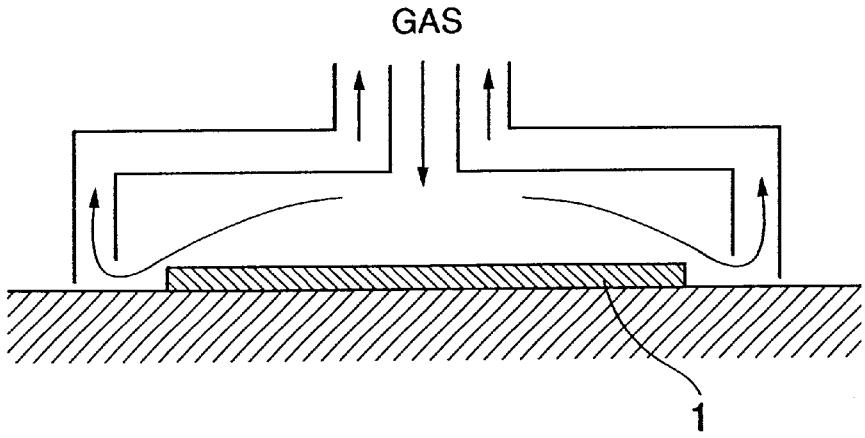
Figure 17C:
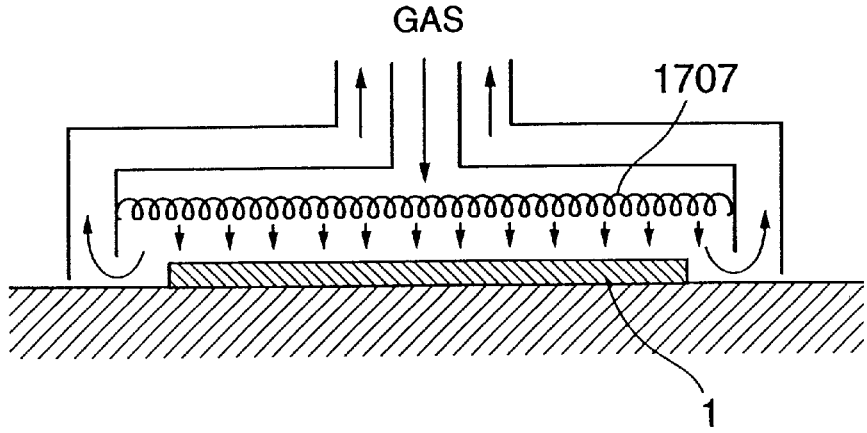

FIGS. 17A to 17C are schematic diagrams showing examples of an activating system, particularly its process container, to be used by this embodiment and by fourth to sixth embodiments. In FIGS. 17A to 17C only the element to be processed and the atmosphere are illustrated and the wiring lines, a power source, and the like for applying a pulse voltage are not shown. FIG. 17A shows the process container to be used by the third and fourth embodiments. Activating gas is introduced from the upper central portion of a container 1706. The inside of the container is at approximately an atmospheric pressure, and the gas drained from the lower edge of the container is properly processed by a local exhaust system or the like. FIG. 17B shows the system used by the fifth embodiment. An activating gas introduced into a container is not drained outside of the container, but is recycled via a circulating path. The system shown in FIG. 17C is used by the sixth embodiment. A mesh 1707 is provided in the container. With this system, a plurality of electron emitting elements are processed at the same time while the gas flow amount is prevented from being made different at positions where elements are placed, so that the activation process can be performed uniformly for each element.

In the third embodiment, judgement of a completion of the activating process is properly made by measuring the element current If. The pulse width, interval, peak value, and the like are properly set.

The partial pressure of organic material in the vacuum chamber after the stabilizing process is performed after the activating process, is preferably set to a value capable of suppressing new deposition of carbon or carbon compound, more preferably set to $1\times10^{-8}$ Torr, or most preferably set to $1\times10^{-10}$ Torr. The pressure in the vacuum chamber is desired to be as low as possible, preferably $1\times10^{-7}$ Torr or lower, or more preferably $1\times10^{-8}$ Torr or lower.

In manufacturing the image forming apparatus shown in FIG. 9, after the stabilizing process is performed, the electron source, image forming member, vacuum container forming member, and the like are bonded together by using frit glass or the like to assemble them. Then, the inside of the vacuum container is evacuated and the pipe is heated with a burner or the like to seal the apparatus. Thereafter, a getter process may be performed if necessary. The stabilizing process may be performed after the assembling process.

Figure 18:
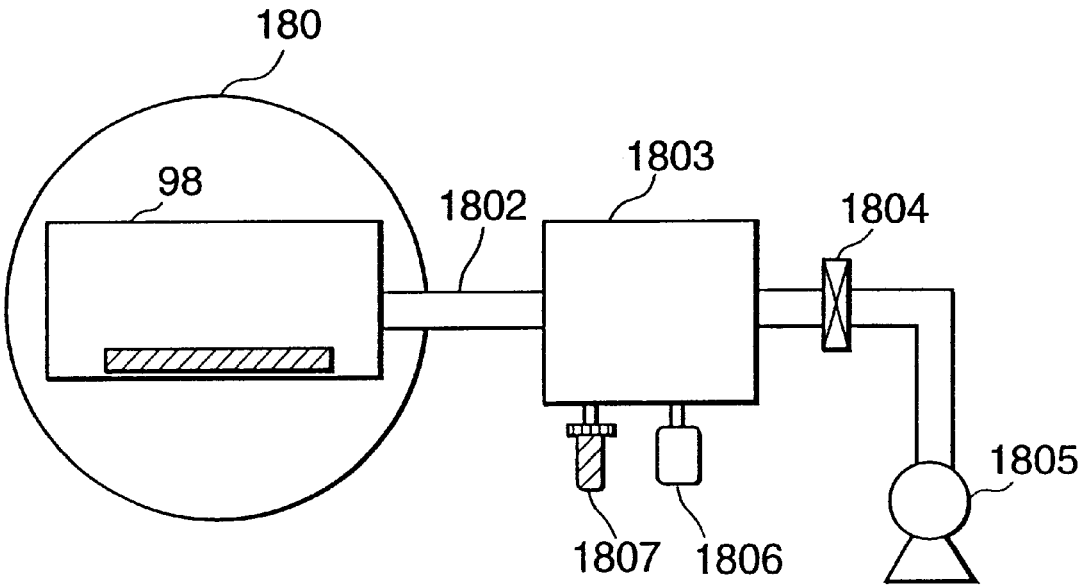
FIG. 18 is a schematic diagram showing an example of the structure of a vacuum process system used by the image forming apparatus manufacture method according to the invention.

FIG. 18 is a schematic diagram showing the outline of the system to be used when the stabilizing process is performed after the assembling process. An image forming apparatus 1801 is coupled to a vacuum chamber 1803 via an exhaust pipe 1802, and further to an air exhaust device via a gate valve 1804. A pressure gauge 1806 and a quadrature mass spectrometer 1807 are mounted on the vacuum chamber 1803 to measure the inner pressure and a partial pressure of each composition in the atmosphere of the vacuum chamber. Since it is difficult to measure the inner pressure of an outer envelope 98 of the image forming apparatus 1801, the inner pressure of the vacuum chamber 1803 is measured.

The outer envelope 98 is heated and maintained at a proper temperature of 80 to 250° C. In this state, the inside space is evacuated via the exhaust pipe 1802 by the air exhaust device 1803 not using oil such as a ion pump and a sorption pump to obtain an atmosphere with sufficiently less organic material. After this atmosphere is confirmed by the pressure gauge 1806 and quadrature mass spectrometer 1807, the exhaust pipe is heated with a burner and melted to seal the outer envelope 98. A getter process may be performed in order to maintain the pressure after sealing the outer envelope 98. With this getter process, a getter (not shown) disposed at a predetermined position in the outer envelope 98 is heated through resistance heating or high frequency heating, to thereby form a deposition film immediately before or after sealing the outer envelope 98. The getter has usually Ba or the like as its main composition, and the atmosphere in the outer envelope 98 is maintained by the absorption function of the deposition film.

The third embodiment will be described more specifically. The electron emitting element formed by this embodiment has the structure schematically shown in FIGS. 2A and 2B.

(Process A)

A substrate 1 made of quartz was cleaned with rinsing agent, pure water, and organic solvent, and thereafter, photoresist RD-2000N (manufactured by Hitachi Kasei Company) was coated (2500 rpm, 40 sec) with a spinner and pre-baked at 80° C. for 25 minutes.

Next, by using a mask pattern corresponding to element electrodes, the photoresist was exposed in a contact manner, developed with developing liquid, and post-baked at 120° C. for 20 minutes to form a resist mask.

Next, an Ni film was deposited through vacuum vapor deposition. The film forming rate was 0.3 nm/sec and the film thickness was 100 nm.

Next, the substrate was immersed in acetone to dissolve the resist mask to form element electrodes 2 and 3 of Ni through lift-off. The space between the electrodes was 2 $\mu$m and the electrode length was 500 $\mu$m (FIG. 4A).

(Process B)

The substrate with the electrodes was cleaned with acetone, isopropanol, and butyl acetate, and dried to form a Cr film to a thickness of 50 nm through vacuum vapor deposition. Next, photoresist AZ1370 (manufactured by Hext Company) was coated with a spinner at 2500 rpm for 30 seconds, and pre-baked at 90° C. for 30 minutes.

Next, an opening corresponding to a conductive film was formed in the photoresist through exposure and development using a mask, and the photoresist was post-baked at 120° C. for 30 minutes to form a resist mask.

Next, the substrate was immersed in etchant $(NH_4)Ce(NO_3)_5/HCl/H_2O$=17 g/5 cc/100 cc) for 30 seconds to etch Cr exposed in the mask opening. The resist was removed by using acetone to form a Cr mask.

Next, organic Pd compound solution (ccp-4230: manufactured by Okuno Pharmaceutical Industries Kabushiki Kaisha) was coated with a spinner at 800 rpm for 30 seconds, and cured at 300° C. for 10 minutes to form a conductive film made of PdO fine particles.

Next, the substrate was immersed in the etchant described above to remove the Cr mask and form a conductive film 4 of a desired pattern through lift-off (FIG. 4C).

(Process C)

Next, the element was placed in the system schematically shown in FIG. 6. The inside of the vacuum chamber 55 was evacuated by the vacuum pump 56. After the inner pressure was set to $1\times10^{-5}$ Torr or lower, triangular pulses gradually raising their peak values such as shown in FIG. 5B were applied between the element electrodes 2 and 3. The pulse width T1 was 1 msec and the pulse interval T2 was 10 msec. The forming process was completed at the peak value of about 5.0 V.

(Process D)

The electron emitting element was taken out of the vacuum chamber and placed in the gas introducing system schematically shown in FIG. 17A. An unrepresented moisture removing filter is mounted on the gas introducing line to remove moisture in the gas. The introduced gas was a mixture gas of $H_2$ and $C_2H_2$, and the mixture ratio was controlled by a flow controller to flow $H_2$ at 2 l/min and $C_2H_2$ at 1 cc/min. Under this gas flow, a rectangular pulse having a constant peak value was repetitively applied between the element electrodes. The peak value was 14 V, the pulse width T3 was 100 psec, and the pulse interval T4 was 10 msec.

(Process E)

This element was again placed in the system shown in FIG. 6. The element was maintained at 150° C. and the inside of the vacuum chamber was evacuated. In about 3 hours, a pressure of $1\times10^{-8}$ Torr was obtained.

Next, after the element reached the room temperature, a voltage of 1 kV was applied to the anode electrode and the pulse voltages same as those in the process D were applied to measure the element characteristics. The distance between the anode electrode and element was set to 4 mm.

The element current If was 5 mA, the emission current Ie was 7 $\mu$A, and the electron emission efficiency $\eta$ (=Ie/If) was 0.14%.

With the manufacture method of this embodiment of the invention, the time required for the activating process and stabilizing process was sufficiently very short as compared to conventional processes.

Fourth Embodiment

Acetone was used in the process D instead of acetylene. Acetone in a bubbler container was bubbled by using nitrogen gas, and a gas containing acetone vapor was introduced into the system shown in FIG. 17A to perform the process similar to the process D. The other processes are the same as the third embodiment.

Figure 19:
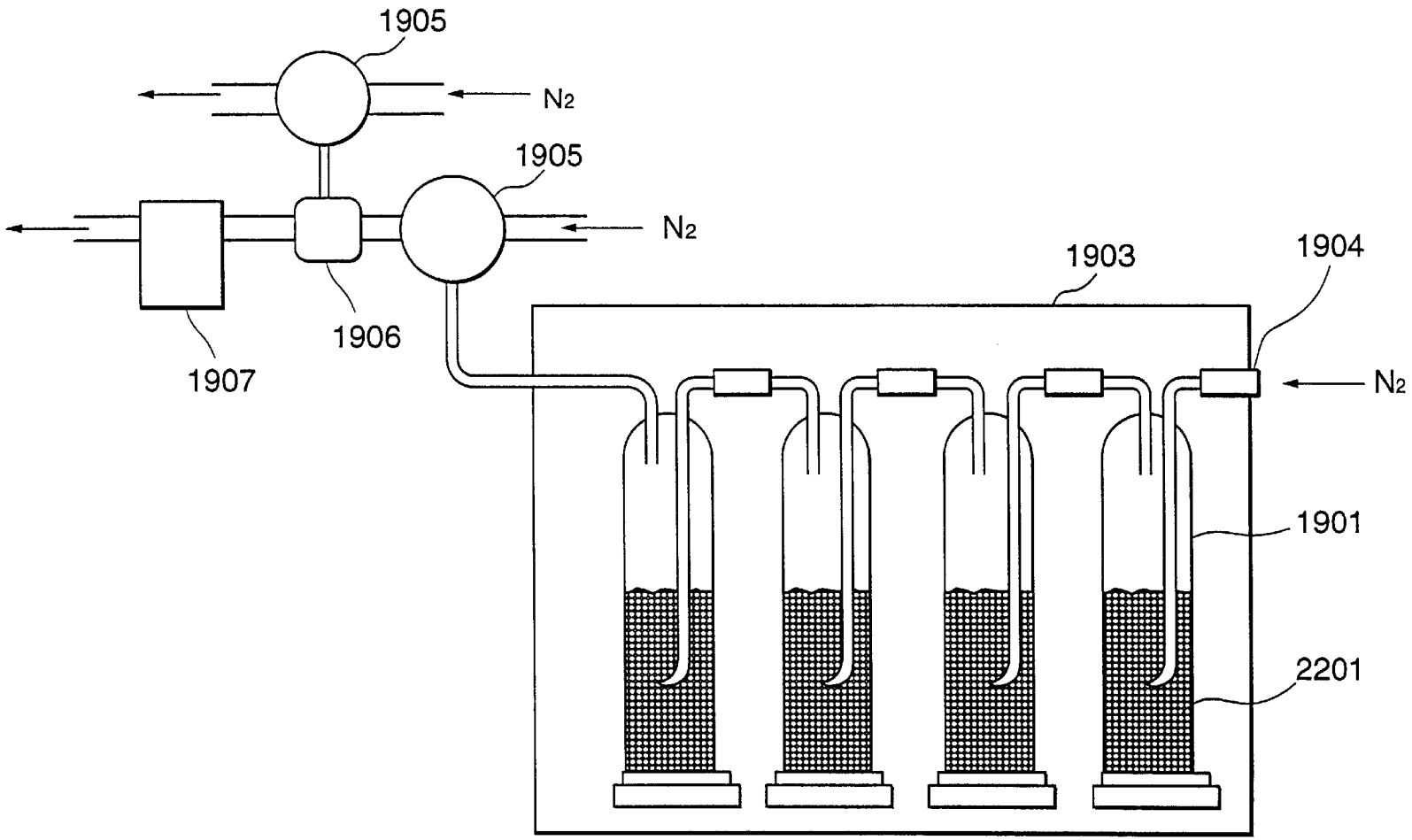
FIG. 19 is a schematic diagram showing an example of the structure of a bubbling apparatus used by the electron emission apparatus manufacture method according to the invention.

An $N_2$ gas containing acetone vapor was maintained at approximately an atmospheric pressure in the system shown in FIG. 17A. As shown in a schematic diagram of FIG. 19, the $N_2$ gas was obtained by passing $N_2$ gas through acetone 1902 in a multi-stage bubbling system 1901. The bubbling system was maintained at 25° C. in a constant temperature bath 1903, and $N_2$ gas was introduced from a gas inlet port 1904 so that the $N_2$ gas containing acetone vapor at a saturated vapor pressure was flowed at 1 $cm^3$/sec in one atmospheric pressure. The drained gas was mixed with high purity $N_2$ gas in a mixer 1905 to dilute it by a hundredfold, and distributed by 99:1 by a distributor 1906. The gas distributed toward a cold trap 1907 was drained after acetone was removed by the cold trap. The gas distributed to the other direction was again diluted by a hundredfold and then. diluted by a tenfold, in total by a $10^5$-fold. The saturated vapor pressure of acetone at 25° C. is about $3\times10^4$ Pa. Therefore, the partial pressure of acetone in the final gas introduced into the activating process chamber is about $3\times10^{-1}$ Pa. The high pure $N_2$ gas had a purity of 99.9999% (6N) by taking into consideration such a high dilution ratio.

The measurements under the same conditions as the third embodiment showed that the element current If was 4 mA, the emission current Ie was 4.4 $\mu$A, and the electron emission efficiency $\eta$ was 0.11%.

Fifth Embodiment

Figure 20:
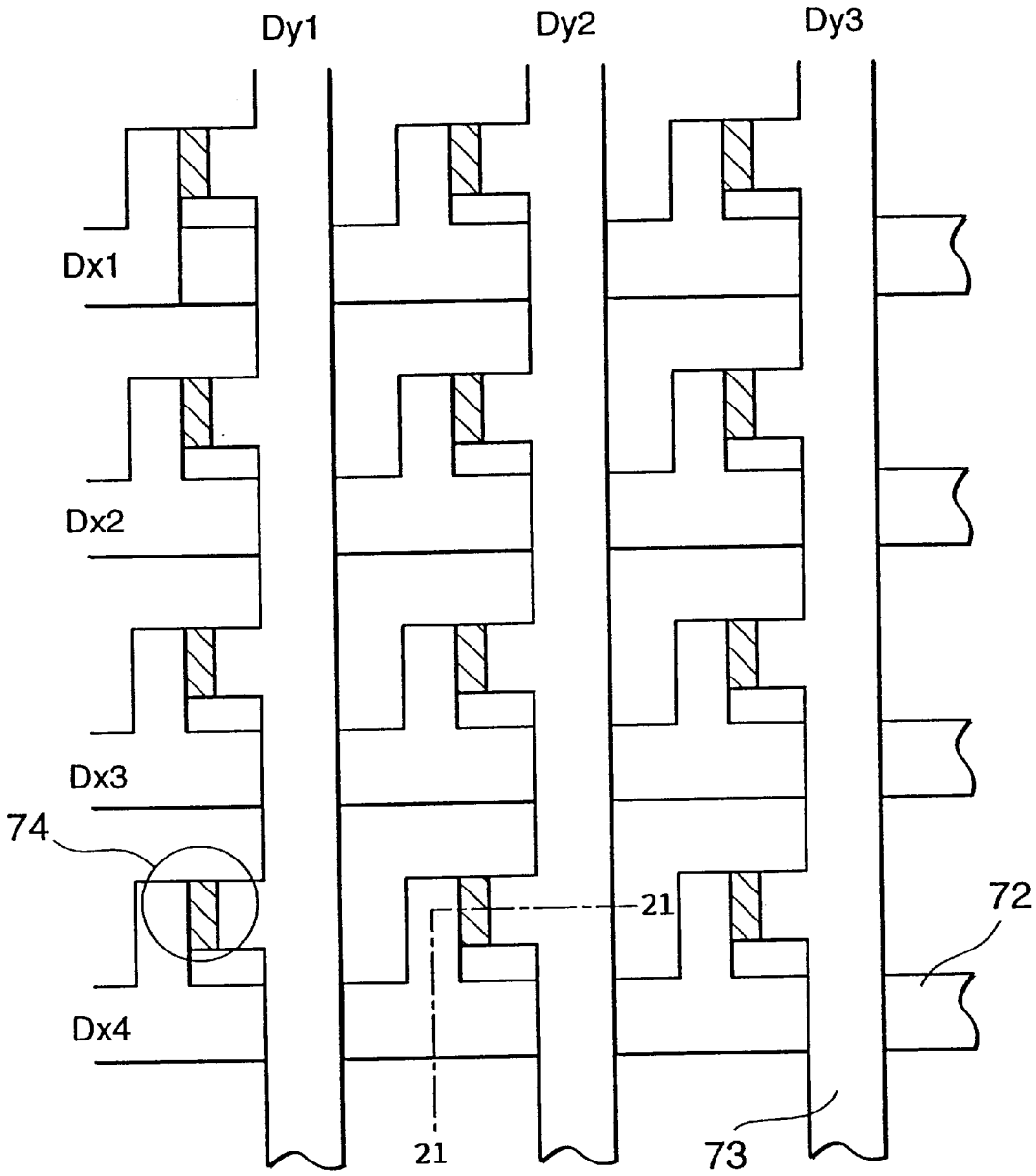
FIG. 20 is a schematic plan view showing the structure of an electron source with a matrix wiring pattern applicable to the invention.
Figure 21:
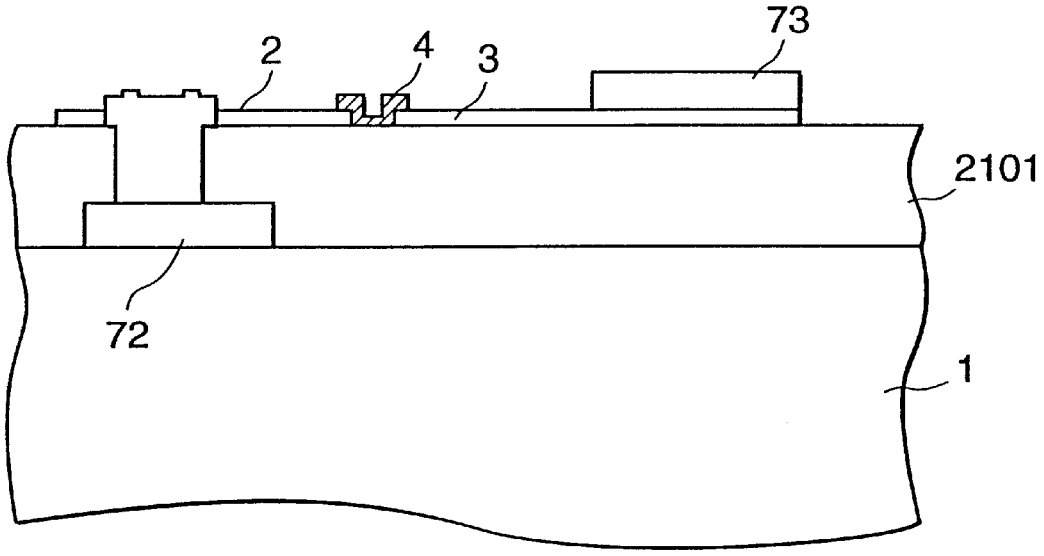
FIG. 21 is a schematic cross sectional view showing the structure of the electron source taken along a polygonal line of FIG. 20.
Figure 22:
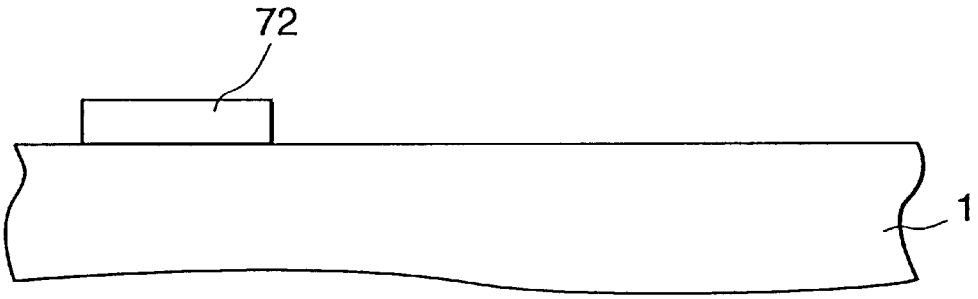
FIG. 22 is a diagram illustrating some of an electron source manufacture process according to the invention.

This embodiment shows an electron source having a matrix layout schematically shown in FIG. 8 and a manufacture method for an image forming apparatus using the electron source such as shown in FIG. 9. FIG. 20 is a partial schematic plan view showing the structure of an electron source having a matrix layout according to the fifth embodiment. The cross sectional structure taken along polygonal line 21—21 in FIG. 20 is shown in FIG. 21. With reference to FIGS. 22 to 28, the manufacture method for an electron source will be described and then a manufacture method for an image forming apparatus will be described.

(Process A)

On a cleaned blue plate glass, a silicon oxide film was formed to a thickness of 0.5 $\mu$m by sputtering. On this substrate, Cr and Au were sequentially deposited to thicknesses of 5 nm and 600 nm respectively through vacuum vapor deposition. Thereafter, a lower wiring pattern 72 was formed through photolithography by using photoresist AZ1370 manufactured by Hext Company) (FIG. 2A).

(Process B)

Figure 23:
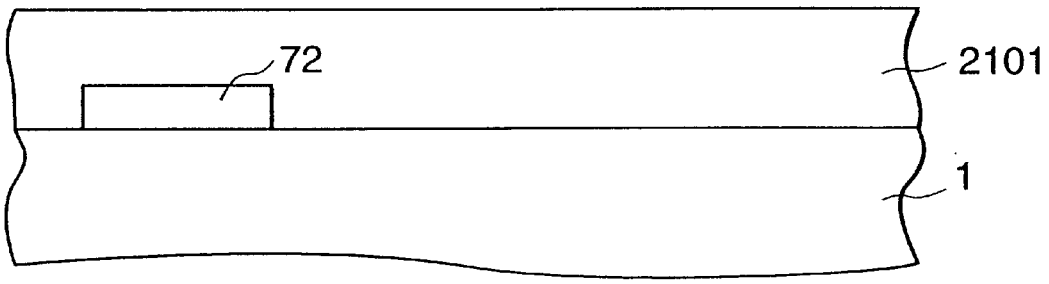
FIG. 23 is a diagram illustrating some of the electron source manufacture process according to the invention.

Next, an interlayer insulating film 2101 of silicon oxide was deposited through sputtering to a thickness of 1 $\mu$m (FIG. 23).

(Process C)

Figure 24:
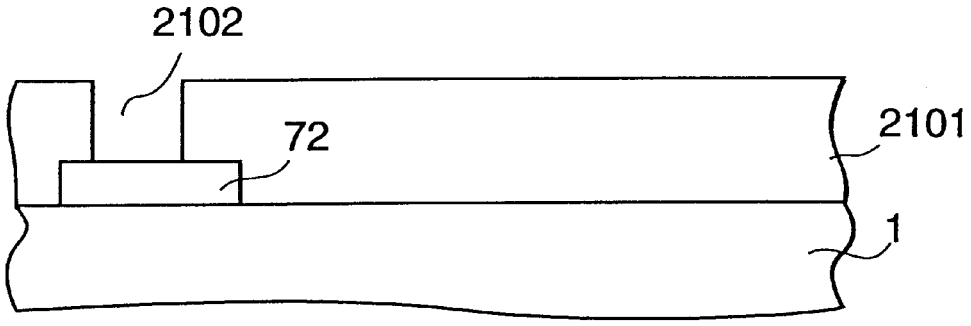
FIG. 24 is a diagram illustrating some of the electron source manufacture process according to the invention.

A photoresist pattern for forming contact holes 2102 through the interlayer insulating film was formed. By using the photoresist pattern as a mask, the interlayer insulating film 2101 was etched through reactive ion etching (RIE) using $CF_4$ and $H_2$ (FIG. 24).

(Process D)

Figure 25:
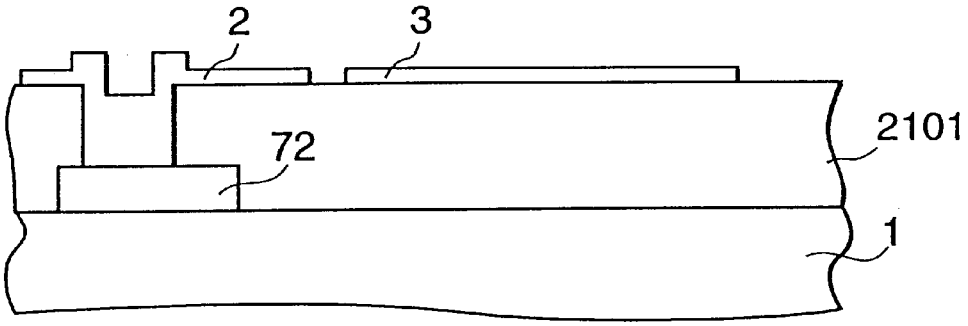
FIG. 25 is a diagram illustrating some of the electron source manufacture process according to the invention.

A mask pattern having openings corresponding to the pattern of element electrodes was formed by using photoresist (RD-2000N-41: manufactured by Hitachi Kasei Company). By using this mask pattern, Ti and Ni were sequentially deposited to thicknesses of 5 nm and 100 nm respectively through vacuum vapor deposition. Next, the photoresist was removed by organic solvent to form element electrodes 2 and 3 by lift-off (FIG. 25). The space between the element electrodes was 3 $\mu$m.

(Process E)

Figure 26:
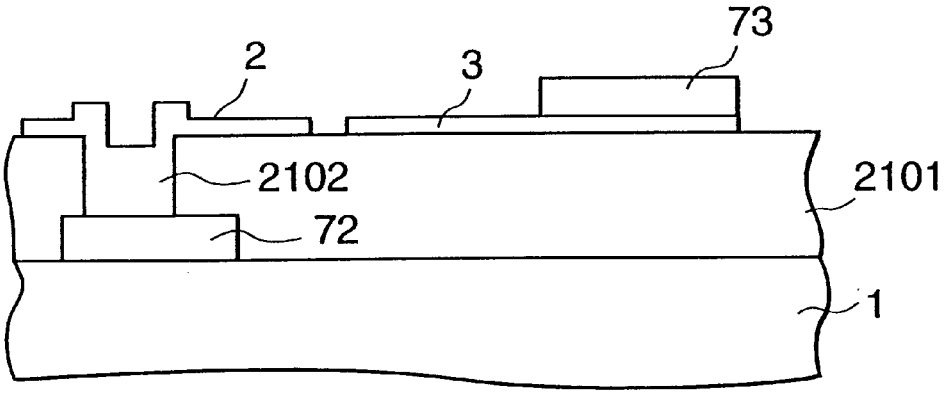
FIG. 26 is a diagram illustrating some of the electron source manufacture process according to the invention.

An upper wiring pattern 73 was formed by photolithography using photoresist similar to the process A, the upper wiring pattern 73 having a laminated structure of 5 nm thick Ti and 500 nm thick Au (FIG. 26).

(Process F)

Figure 27:
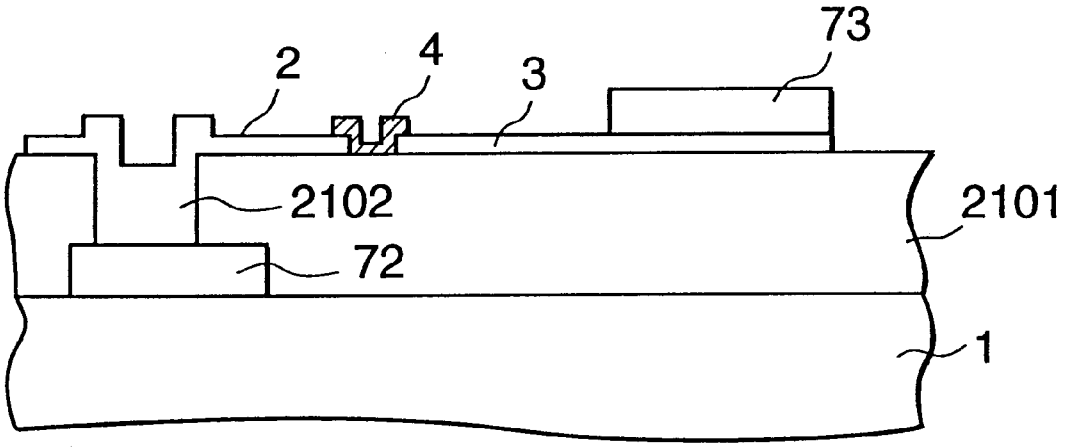
FIG. 27 is a diagram illustrating some of the electron source manufacture process according to the invention.

A conductive film 4 of PdO fine particles was formed through lift-off using a Cr mask similar to the process B of the third embodiment (FIG. 27).

(Process G)

Figure 28:
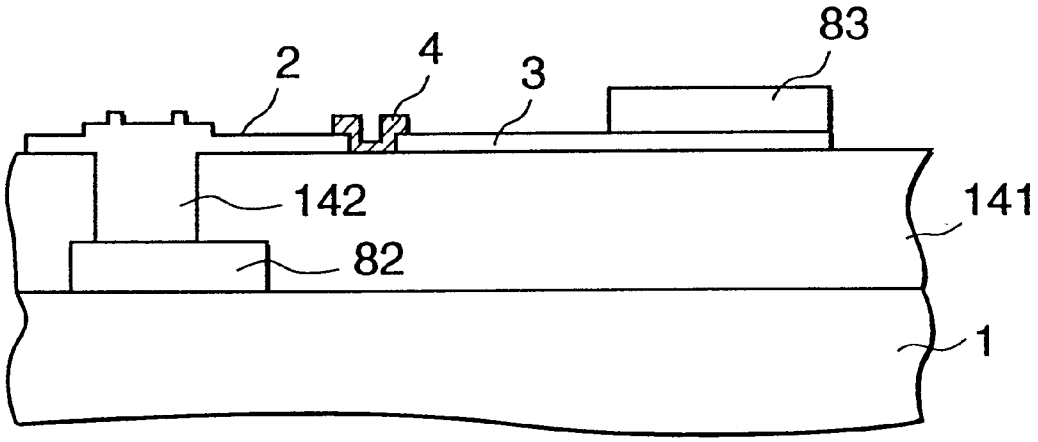
FIG. 28 is a diagram illustrating some of the electron source manufacture process according to the invention.

A resist pattern covering the substrate excepting contact holes 2102 was formed. Ti and Au were sequentially deposited to thicknesses 5 nm and 500 nm through vacuum vapor deposition. The resist pattern was removed, and unnecessary portions of the deposited films were removed to fill the inside of a recess formed over the contact hole 2102 (FIG. 28).

(Process H)

The electron source was placed in the vacuum process system. Similar to the process C of the third embodiment, triangular pulses were applied via wiring patterns to perform the forming process and form an electron emitting area.

(Process I)

The electron source was taken out of the vacuum process system, and the activating process was performed under the same conditions as the process D of the third embodiment, by using the system schematically shown in FIG. 17B.

(Process J)

Next, the electron source was again placed in the vacuum process system, and the stabilizing process was performed in the manner similar to the process E of the third embodiment. The pressure reached $1\times10^{-8}$ Torr in about 3 hours.

The electron emission characteristics were measured in a manner similar to the third embodiment. All the elements emitted electrons normally.

An image forming apparatus having the structure shown in FIG. 9 was manufactured by using the above-described electron source.

An electron source substrate 71 was fixed to a rear plate 81. A face plate was disposed on a support frame 82 at a position higher than the substrate by 5 mm. Frit glass was coated on junction areas and maintained in a nitrogen atmosphere at 400° C. for 10 minutes to adhere the substrate, support frame, and face plate and form an outer envelope. The inner surface of the face plate was provided with a fluorescent film 84 and a metal back 85. The fluorescent film 84 of a stripe shape (FIG. 10A) was formed through printing. As the black conductive body, the material whose main component was graphite was used. The metal back was formed by vapor depositing Al after the inner surface of the fluorescent film was smoothed (filmed).

In the above-described assembling process, the fluorescent film and electron emitting elements were sufficiently and correctly aligned in position. The outer envelope was provided with a getter (not shown).

The inside of the outer envelope of the image forming apparatus was evacuated. After the pressure was set to $1\times10^{-6}$ Torr or lower, the getter process was performed through high frequency heating, and the exhaust pipe was heated with a burner and the outer envelope was sealed.

A driver circuit was connected to the apparatus, and a TV signal was supplied and displayed. It was possible to stably display an image of high quality.

Sixth Embodiment

The processes similar to the processes A to I of the fifth embodiment were performed. In the process I, however, the system schematically shown in FIG. 17C was used. An outer envelope was formed by the assembling process. The stabilizing process was performed at 150° C. for 5 hours while the inside of the outer envelope was evacuated via the exhaust pipe, until the pressure reached $1\times10^{-6}$ Torr. Next, the getter process was performed and the exhaust pipe was sealed to complete an image forming apparatus. Similar to the fifth embodiment, it was possible to stably display an image of high quality.

Seventh Embodiment

Figure 29:
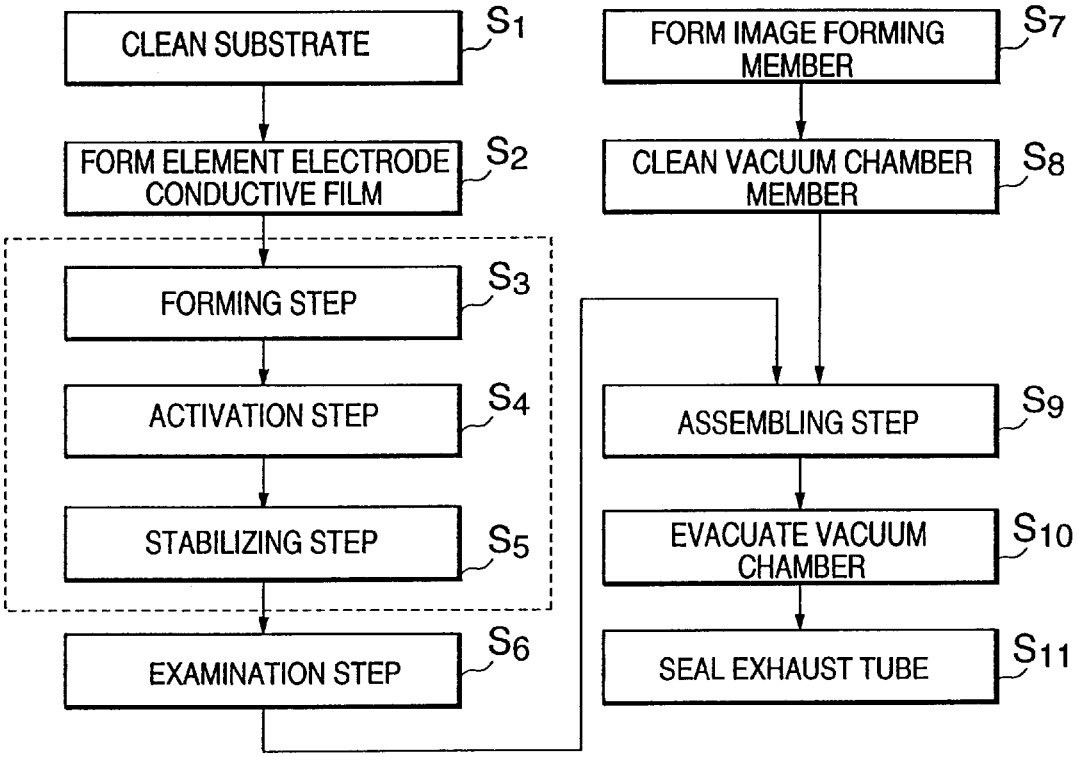
FIG. 29 is a flow chart illustrating an electron source manufacture method according to the invention.

A manufacture method of this embodiment constitutes processes illustrated in FIG. 29. "CLEAN SUBSTRATE" to "EXAMINATION STEP" at steps S1 to S5 shown in the left side are steps for manufacturing an electron emitting element or electron source. Steps "FORM IMAGE FORMING MEMBER" to "SEAL EXHAUST TUBE" at steps S7 to S11 shown in the right side are used for manufacturing an image forming apparatus using the electron source.

The first feature of this embodiment resides in that a forming step S3, an activating step S4, and a stabilizing step S5 are all performed at a pressure of approximately an atmospheric pressure. The stabilizing step S5 is not necessarily required to be performed at a pressure of approximately an atmospheric pressure. The term "approximately atmospheric pressure" means an atmospheric pressure or a pressure near the atmospheric pressure, which satisfies the conditions that a process container used for the process does not require a large system such as a vacuum process system in order to form and maintain the necessary inner atmosphere of the container. Specifically, the approximately atmospheric pressure is a pressure in a range from one several number-th of one atmospheric pressure to a several number atmospheric pressure, and preferably in a range from 0.5 to 1.5 atmospheric pressure, and more preferably in a range of +/− 20% of one atmospheric pressure.

In this embodiment, at least the forming step S3 and activating step S4 are performed at approximately an atmospheric pressure. It is preferable that the stabilizing step S5 is also performed at approximately an atmospheric pressure.

For the process to be performed at approximately an atmospheric pressure, a container used for the process is not required to be serious about small leak, such as in the case of a vacuum process chamber. Furthermore, there is a relatively small possibility that the conditions of the activating step are greatly affected by gas molecules attached to the inner wall of the container and released therefrom into the container. If the pressure is about one atmospheric pressure, it is not necessary to provide a mechanical strength of the container resistance to a pressure difference between the outside and inside of the container. Therefore, the process container can be simplified considerably.

Such a process is performed by introducing a gas into the container with an electron emitting element or an electron source to be processed, to thereby form a desired atmosphere in the container.

If the process continues long without supplying gas after the container is once filled with gas, the atmosphere around the electron emitting element may change. In order to prevent this, it is preferable to form a gas flow capable of being sufficiently introduced into the container and drained from the container.

Figure 30A:
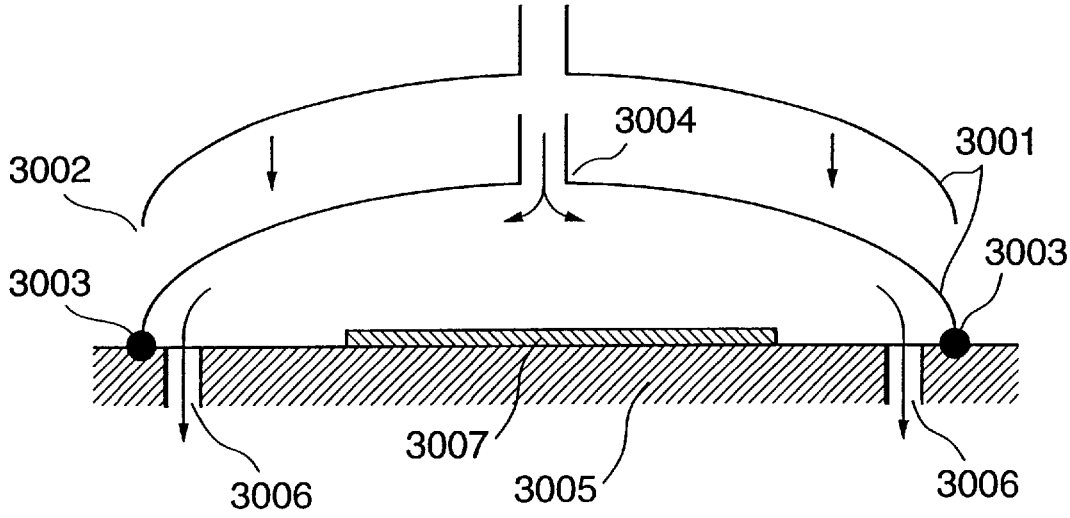
FIGS. 30A and 30B are schematic diagrams showing examples of the structure of a process chamber applicable to the invention.
Figure 30B:
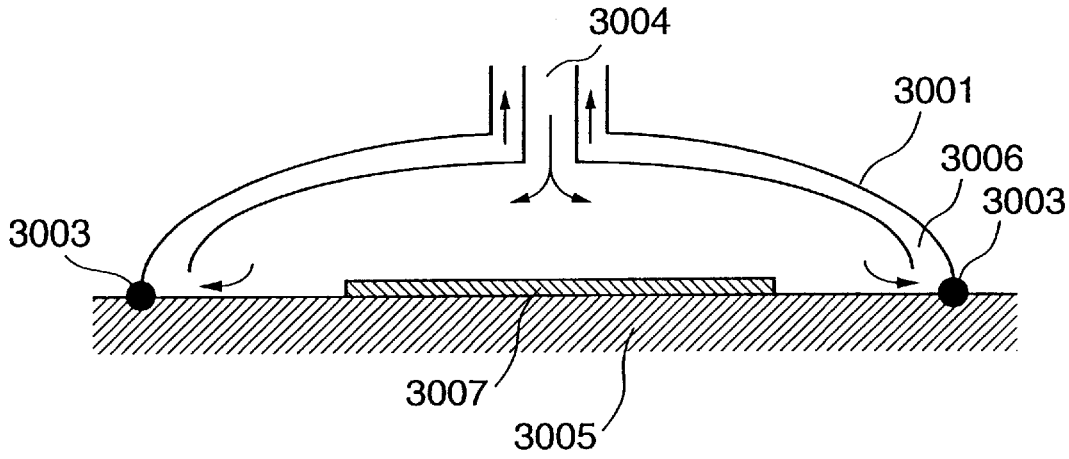

FIG. 30A is a schematic diagram showing an example of the structure of a container used for the processes of the seventh embodiment. A holder holding an electron emitting element or electron source 3007 is covered with a container 7001. The lower end 3002 of the container is pushed against an O-ring 3003 to prevent gas leak. The container 3001 is provided with a gas inlet port 3004, and the holder 3005 is provided with gas outlet ports 3006. A gas having desired compositions is introduced via the gas inlet port 3004 into the container and the same amount of gas is drained from the gas outlet ports 3006. Alternatively, as shown in FIG. 30B, a container 3001 may have a double structure to provide both gas inlet and outlet ports on the container side. Other structures may also be used if they can perform sufficiently the operation of introducing and draining desired gas.

Since there is no too large a pressure difference between the inside and outside of the container, the O-ring 3003 and corresponding lower end 3002 of the container are not required to have a strict air tightness. During the activating process using such a container, the pressure distribution of introduced gas becomes small and the characteristic variation of electron emitting elements can be suppressed.

Figure 31:
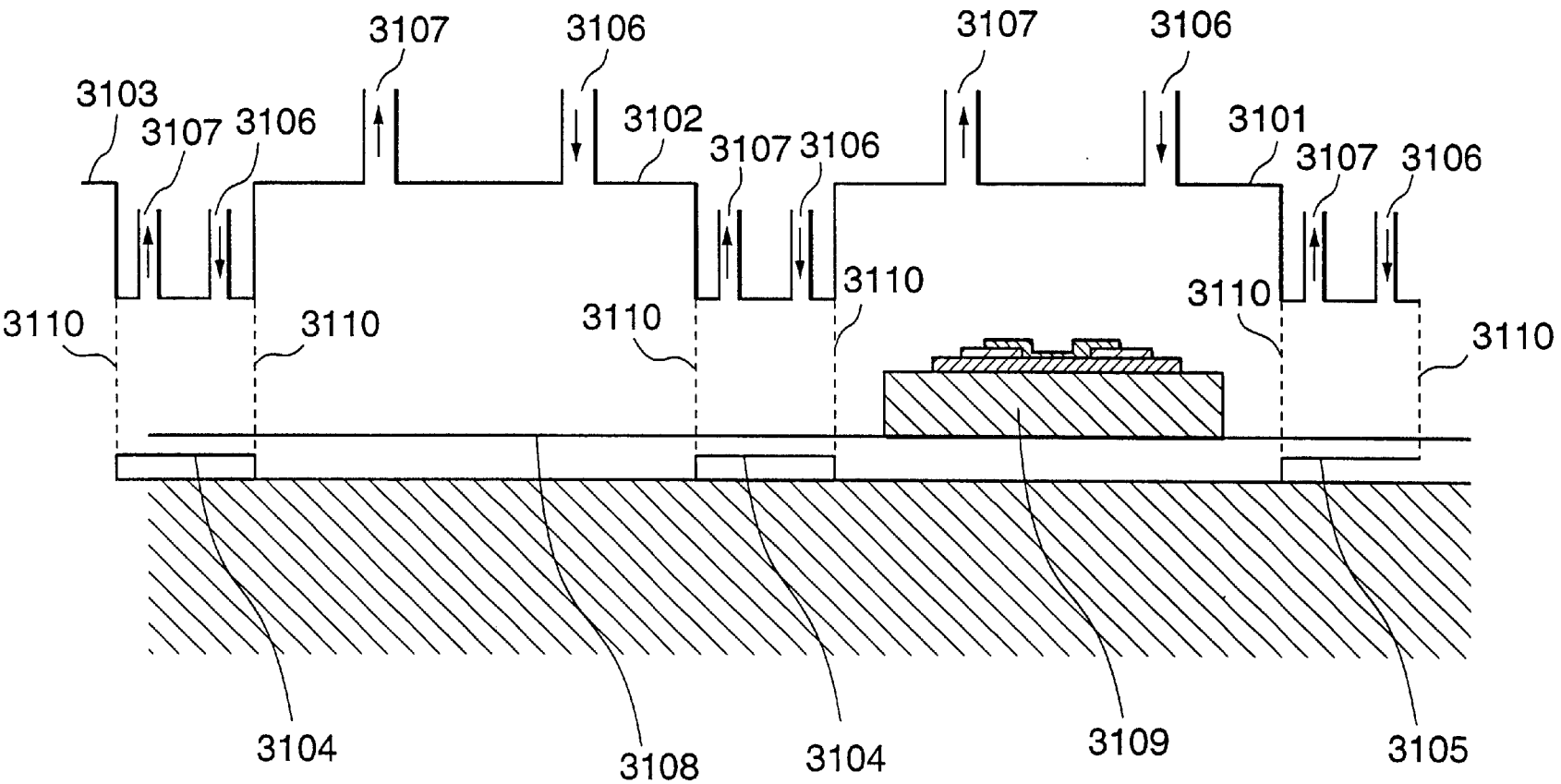
FIG. 31 is a schematic diagram showing the structure of a continuous process system applicable to the invention.

As shown in FIG. 31, instead of mounting or dismounting the container, the electron emitting element or electron source to be processed may be transported in and out of box-like containers having a transport inlet and a transport outlet. In this case, it is preferable to form a proper flow of gas such as inert gas not only in the containers 3101 to 3103 but also in the transport inlet (sample inlet) 3105, junctions 3104, and the transport outlet (sample outlet, not shown).

Although not shown in FIG. 31, connection terminals for applying a voltage to an electron emitting element or electron source are provided if necessary for the process.

The more specific description will be given hereinunder.

On a cleaned substrate, element electrodes, a conductive film, and a necessary wiring pattern of a surface conduction type electron element are formed. These components may be formed by vacuum vapor deposition, sputtering, patterning by photolithography, printing, or ink jetting.

After these components are formed, a degassing process is performed, for example, by heating the surface conduction type electron emitting element at a temperature not damaging the element electrodes, wiring pattern, and conductive film. Thereafter, the forming process is performed.

With the forming process, an electron emitting area is formed by applying a pulse voltage such as shown in FIGS. 5A or 5B. The atmosphere in the process chamber may be formed by various gases, depending upon the material of the conductive film or the like. For example, rare gas such as helium (He) or inert gas such as nitrogen ($N_2$) may be used. Although inert gas generally means only rare gas belonging to group O of the periodic table, inert gas includes both rare gas and $N_2$ gas and the like in this specification. A oxidizing atmosphere such as an atmosphere containing oxygen may be used. This atmosphere is particularly useful if the conductive film is made of metal oxide and it is necessary to prevent the metal oxide from being reduced by Joule heat generated by a pulse voltage application. A reducing atmosphere such as an atmosphere containing hydrogen gas may also be used. For example, if the conductive film is made of fine particles of metal oxide relatively likely to be reduced, such as PdO, the fine particles are reduced and facilitated to be aggregated by adding a small amount of hydrogen gas in the atmosphere while pulse voltages having a constant peak value (in the degree that the electron emitting area is hard to be formed by these voltages) such as shown in FIG. 5A are applied. In this manner, the electron emitting area can be formed even if the power of the pulse voltages is relatively small.

A completion of the forming process can be detected as in the following. During the period between forming pulse voltages, a pulse voltage having a peak value of about 0.1 V (in the degree that the conductive thin film is not broken, deformed, or decomposed) is applied, and current is measured to check the resistance value of the conductive film. When the resistance value per one element exceeds 1 MΩ, the forming process is terminated.

Next, the activating process is performed to deposit a deposit substance containing at least carbon in the electron emitting area formed by the forming process and in its nearby area. The electrical characteristics of an element can therefore be changed greatly. More specifically, an electron emitting element or electron source is placed in the process container. A mixture gas of organic material gas (or vapor) and inert gas (argon, helium, nitrogen, or the like) is introduced and drained. In the atmosphere of this mixture gas flow, pulse voltages are repetitively applied across the element electrodes. If the organic material of the mixture gas is a gas in a room temperature, such as methane, ethylene, and acetylene, the mixture ratio is adjusted by using a gas flow controller or the like. If the organic material of the mixture gas is a liquid in a room temperature, such as acetone and ethanol, inert gas is bubbled in the organic material liquid to add vapor to this liquid. After the temperature of the bubbling apparatus is controlled correctly and the organic material vapor at the saturated vapor pressure is formed, this vapor is mixed with inert gas not containing vapor to thereby control the mixture ratio.

Next, the stabilizing process is performed because of the following reason. Organic material molecules attached to the electron emitting element or electron source may become source material of the deposit substance on the electron emitting area. Therefore, the deposit substance containing at least carbon is deposited further and the electron emission characteristics may become unstable. The stabilizing process removes such unnecessary attached organic material molecules. This process is performed by heating the electron emitting element or electron source while proper gas is introduced and drained. Heating makes the attached organic material molecules easy to be detached. The detached molecules are transported by the gas flow to the outside of the container. If the detached organic material molecules again attach to the inner wall of the process container, they are difficult to be detached and may be left in the container if the container temperature is low. It is therefore preferable to heat also the container itself. If the heating process is performed while the voltage pulse having a peak value used in general is applied to the electron emitting element, this stabilizing process can be performed more effectively in some cases.

Gas having a proper oxidizing nature may be introduced into the container. In this case, attached organic material molecules are oxidized and changed mainly to $CO_2$, CO, $H_2O$ and the like. These gases are not always easy to be drained. However, as compared to organic material molecules polymerized to some extent, these gases are much easier to be drained and the goal of this process can be achieved easily.

The stabilizing process may be performed in a low vacuum of the container by using a simple evacuator. Although a large system for high vacuum such as a turbo pump and an ion pump may be used as the evacuator, the goal of this process can be achieved by a more simple evacuator used for a preliminary evacuation such as a scroll pump. Therefore, both the container and evacuator are not so bulky. It does not take a long time for evacuation, so that this process can be adopted as a constituent process of the invention without contradicting with the object of the invention.

In manufacturing an image forming apparatus by sealing the electron emitting element or electron source formed by the above processes in a glass vacuum container for example, it is preferable to confirm before the sealing whether the electron emitting element or electron source is formed normally.

In order to confirm this, the electrical characteristics of the electron emitting element, i.e., the relation between the element voltage Vf and element current If, are be measured. For more perfect confirmation, the electron emission characteristics are measured by placing the electron emitting element or electron source in a measuring vacuum system and actually emitting electrons. Although this latter method is very reliable, it takes a time to sufficiently evacuate the inside of the vacuum system and the system itself becomes bulky. Therefore, the confirmation method of lowest cost is adopted by considering all the processes.

Next, the electron emitting element or electron source formed by the above processes is sealed in a vacuum container, together with the image forming member and other necessary members which are also sufficiently degassed in advance through heating or the like. After the vacuum container with the members contained therein is formed, the inside of the vacuum container is evacuated and the exhaust pipe is heated with a burner or the like to seal the vacuum container. The evacuator to be used is an oil-free evacuator so as not to diffuse organic material in the vacuum.

The getter process may be performed thereafter. With this getter process, a getter (not shown) disposed at a predetermined position in the vacuum container is heated through resistance heating or high frequency heating, to thereby form a deposition film. The getter has usually Ba or the like as its main composition, and the atmosphere in the vacuum container is maintained by the absorption function of the deposition film. The getter process may be performed after the inside of the vacuum container is sufficiently evacuated, or before the exhaust pipe is melted for the sealing.

Instead of evacuating the inside of the vacuum container via the exhaust pipe, the assembling process may be performed by placing necessary members in a vacuum chamber capable of assembling the vacuum container therein.

As shown in FIG. 9, the electron source has electron emitting elements disposed in the X- and Y-directions in a matrix shape, ones of respective element electrodes of a plurality of electron emitting elements disposed in the same row are connected in common to the X-direction wiring pattern, and the others of the respective element electrodes of a plurality of electron emitting elements disposed in the same column are connected in common to the Y-direction wiring pattern. As shown in FIGS. 13 and 14, in the electron source of the ladder layout type, a number of electron emitting element rows are disposed in the row direction, the element electrodes of each of a plurality of electron emitting elements being connected to respective wiring patterns, and control electrodes (grids) are disposed in the column direction perpendicular to the wiring patterns above the electron emitting elements to thereby control the emission of electrons from each electron emitting element.

The seventh embodiment will be described more specifically.

This embodiment provides a method of manufacturing a single surface conduction type electron emitting element. The structure of a surface conduction type electron emitting element is shown in the schematic diagrams of FIGS. 2A and 2B. FIG. 2A is a plan view and FIG. 2B is a cross sectional view.

(Process A)

After a substrate 1 made of quartz glass was cleaned, Ti and Pt were sequentially deposited to thicknesses of 5 nm and 60 nm respectively through sputtering. Element electrodes 2 and 3 were formed by patterning the Ti and Pt films through ordinary photolithography (FIG. 2A). The space L between the electrodes was set to 2 $\mu$m.

(Process B)

Next, Cr was deposited to a thickness of 50 nm through sputtering and openings corresponding to a conductive film 4 was formed through the Cr film. Next, organic Pd compound solution (ccp-4320: manufactured by Okuno Pharmaceutical Industries CO., LTD.) was coated and cured at 300° C. for 12 minutes in the atmospheric air to form a PdO fine particle film. Next, the Cr film was removed by Cr etchant to form the conductive film 4 of a desired shape (FIG. 2B).

(Process C)

Next, the forming process was performed. The processes from the forming process to the stabilizing process were performed by using the process system having the process containers 3101 to 3103 interconnected by the junctions 3104. Each of the process containers, i.e., the forming process container 3101, activating process container 3102, and stabilizing process container 3103 (partially shown in FIG. 31), is provided with a gas inlet pipe 3106 and a gas outlet pipe 3107 for introducing and draining gas necessary for each process. The transport inlet 3105 is connected to the forming process container 3101, and the transport outlet (not shown) is connected to the stabilizing process container 3103. The junctions 3104, transport inlet 3105, and transport outlet are also provided with a gas inlet pipe 3106 and a gas outlet pipe 3107 to form a proper atmosphere therein. Reference numeral 3108 represents a transport device.

The element after the process B is held by a sample holder 3109. The holder 3109 has wiring leads to the element which are connected to power sources and the like outside of the process system. The sample holder 3109 with the element is placed in the transport inlet 3105 and mounted on the transport device 3108 to be transported to the forming process container 3101. The insides of the transport inlet 3105 and forming process container 3101 are filled with $N_2$ at one atmospheric pressure. To this end, $N_2$ gas was flowed through the gas inlet pipe 3106 and gas outlet pipe 3107.

Triangular voltage pulses gradually raising their peak value such as shown in FIG. 5B were applied across the element electrodes via connection terminals (not shown) to form the electron emitting area 5. Although not shown, rectangular pulses having a peak value of 0.1 V were applied during the periods between forming pulses, and current was then measured to check the element resistance. The forming process was terminated when the resistance exceeded 1 MΩ.

(Process D)

The sample holder 3109 was transported into the activating process container 3102 to perform the activating process. The inside of the activating process container 3109 was maintained approximately at one atmospheric pressure of the $N_2$ gas atmosphere containing acetone vapor. This gas was produced by passing $N_2$ gas through acetone 1902 in the multi-stage bubbling system 1901 schematically shown in FIG. 19. The bubbling system was maintained at 25° C. in a constant temperature bath 1903, and $N_2$ gas was introduced from the gas inlet port 1904 so that the $N_2$ gas containing acetone vapor at a saturated vapor pressure was flowed at 1 $cm^3$/sec at one atmospheric pressure. The drained gas was mixed with high purity $N_2$ gas in the mixer 1905 to dilute it by a hundredfold, and distributed by 99:1 by the distributor 1906. The gas distributed toward the cold trap 1907 was drained after acetone was removed by the cold trap. The gas distributed to the other direction was again diluted by a hundredfold and then diluted by a tenfold, in total by a $10^5$-fold. The saturated vapor pressure of acetone at 25° C. is about $3\times10^4$ Pa. Therefore, the partial pressure of acetone in the final gas introduced into the activating process chamber is about $3\times10^{-1}$ Pa. The high pure $N_2$ gas had a purity of 99.9999% (6N) by taking into consideration such a high dilution ratio.

Voltage pulses were applied across the element electrodes in the above-described gas flow. The voltage pulses had a rectangular wave, a peak value of 14 V, a pulse interval of 10 msec, and a pulse width of 1 msec. The activating process was terminated after the pulses were applied for 30 minutes.

(Process E)

Next, the sample holder was transported into the stabilizing process container 3103 to perform the stabilizing process. $N_2$ gas was introduced and drained through the container, and maintained at 150° C. and at approximately one atmospheric pressure. After the element was maintained in the stabilizing process container for 7 hours, it was placed in the measuring vacuum chamber 66 schematically shown in FIG. 6.

The anode electrode 54 for capturing electrons emitted from the element is provided facing the electron emitting elements. The distance L between the element and anode electrode was set to 5 mm. Reference numeral 56 represents an ultra high vacuum evacuator combined with an ion pump and a scroll pump. The inside of the vacuum chamber was evacuated with this evacuator to $10^{-8}$ Pa or lower.

Rectangular pulse voltages having a peak value of 14 V generated by a pulse generator 51 were applied across the element electrodes 2 and 3, and the element current If was measured with an ammeter 50. A high voltage of 1 kV from a high voltage source 53 was applied to an anode electrode 54, and the emission current Ie was measured with an ammeter 52.

COMPARSION EXAMPLE

The processes A and B of the seventh embodiment were performed. Next, the following processes were performed.

(Process D)

The element was placed in the vacuum process system and the inside thereof was evacuated to $10^{-3}$ Pa or lower. This vacuum process system is not only being capable of evacuating the vacuum chamber but also being capable of introducing proper gas, and has terminals for connecting to the wiring patterns of the element. It took 1 hour and 15 minutes to lower to the above-described pressure.

First, the forming process was performed. Triangular pulses with their peak value being gradually raised such as shown in FIG. 5B were applied across the element electrodes to form the electron emitting area.

(Process E)

Next, the activating process was performed. After the pressure in the vacuum chamber was lowered once to $1\times10^{-6}$ Pa, acetone was introduced and the pressure was set to $3\times10^{-1}$ Pa. Then, rectangular pulses of 14 V were applied across the element electrodes. It took 3 hours to obtain the pressure of $3\times10^{-1}$ Ps because of the first lowered pressure. The pulse interval and width were set to the same values as the seventh embodiment. After the pulses were applied for 30 minutes, the activating process was terminated.

(Process F)

Next, the stabilizing process was performed. While the inside of the vacuum chamber was evacuated, the vacuum chamber and element were heated to 150° C. and maintained at this temperature. After the heating and evacuation for 10 hours, the pressure lowered more than $1\times P^{-6}$ Pa so that the stabilizing process was terminated.

The element was taken out of the vacuum chamber and placed in the measuring vacuum chamber described above to perform the measurements same as the seventh embodiment.

All of the elements showed the characteristics shown in FIG. 7. Both the If-Vf and Ie-Vf characteristics had a definite threshold value and showed the monotonous increase characteristics (MI characteristics) at an element voltage not smaller than the threshold value. These characteristics did not change unless a voltage of 14V or higher was applied, and were independent from the pulse peak value (not higher than 14 V), pulse width and interval during the measurements. After the pulse application was stopped from some time, the measurements were resumed. Also in this case, a phenomenon that a large current flows temporarily was not found.

As above, although any of the elements had the characteristics stabilized to a similar extent, as compared to the comparison example, the seventh embodiment was able to greatly shorten the time required for evacuating the inside of the vacuum container and the manufacture cost was able to be prevented from becoming high. The manufacture system did not require the vacuum process system used by the comparison example, and was able to prevent the system from becoming bulky and the cost from becoming high.

Eighth Embodiment

The eighth embodiment provides an electron source having a number of surface conduction type electron emitting elements wired in a matrix shape and an image forming apparatus using such an electron source. The manufacture processes will be described with reference to FIGS. 32A to 32E.

(Process A)

On a cleaned blue plate glass, an $SiO_2$ layer having a thickness of 0.5 μm was formed through sputtering, and this was used as a substrate 1.

Figure 32A:
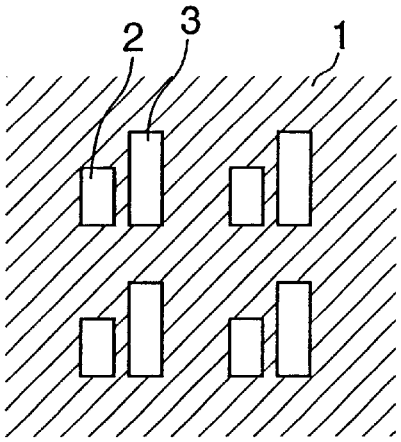
FIGS. 32A, 32B, 32C, 32D and 32E are schematic diagrams showing an example of a method of manufacturing an electron source with a matrix wiring pattern.

On this substrate, element electrodes 2 and 3 of a surface conduction type electron emitting element were formed through sputtering and photolithography. The material of the element electrodes was a lamination of 5 nm thick Ti and 100 nm thick Ni. The space between element electrodes was set to 2 μm (FIG. 32A).

(Process B)

Figure 32B:
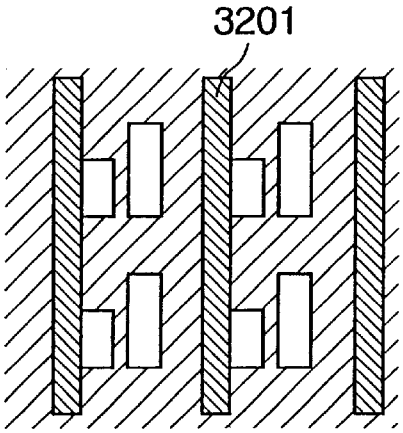

Next, Ag paste was printed to have a predetermined shape and cured to form Y-direction wiring patterns 91. The width of the wiring pattern was 100 μm and the thickness was about 10 μm (FIG. 32B).

(Process C)

Figure 32C:
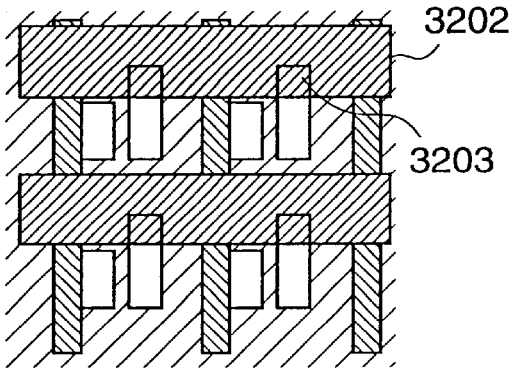

Next, an insulating film 3202 was formed through printing by using paste having PbO as its main composition and mixed with glass binder. This insulating film insulates the Y-direction wiring patterns 3201 from X-direction wiring patterns to be described later. The insulating film had a thickness of about 20 μm. A recess 3202 was formed in the insulating film in an area where the element electrode 3 overlapped, in order to ensure an electrical connection between the X-direction wiring pattern and element electrode (FIG. 32C).

(Process D)

Figure 32D:
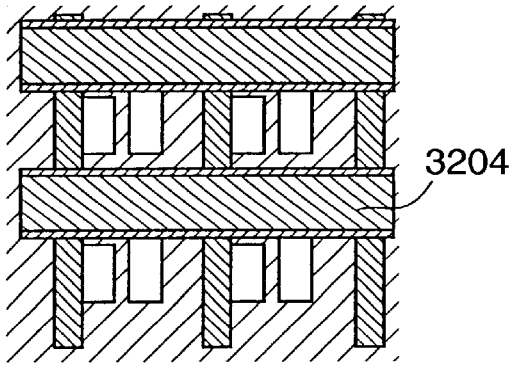

The X-direction wiring patterns 3204 were formed on the insulating film 3202 (FIG. 32D). The patterns 3204 were formed by the method same as that used for the Y-direction wiring patterns. The width of the pattern was 300 μm and the thickness thereof was about 10 μm.

(Process E)

Figure 32E:
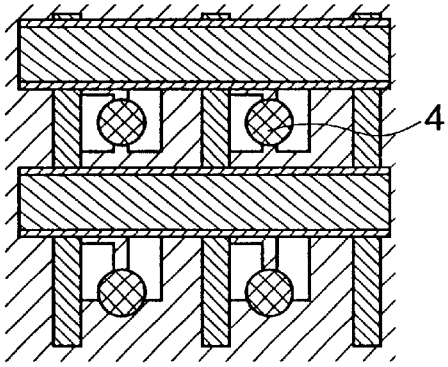

A conductive film 4 made of PdO fine particles was formed. Aqueous solution of organic Pd compound was applied as droplets to a predetermined area by using a bubble jet ink printer, and dried. Thereafter, a heating process was performed at 300° C. for 10 minutes in the atmospheric air to form a PdO fine particle film (FIG. 32E).

(Process F)

Next, the forming process was performed by using the process system same as that used by the seventh embodiment.

Figure 33:
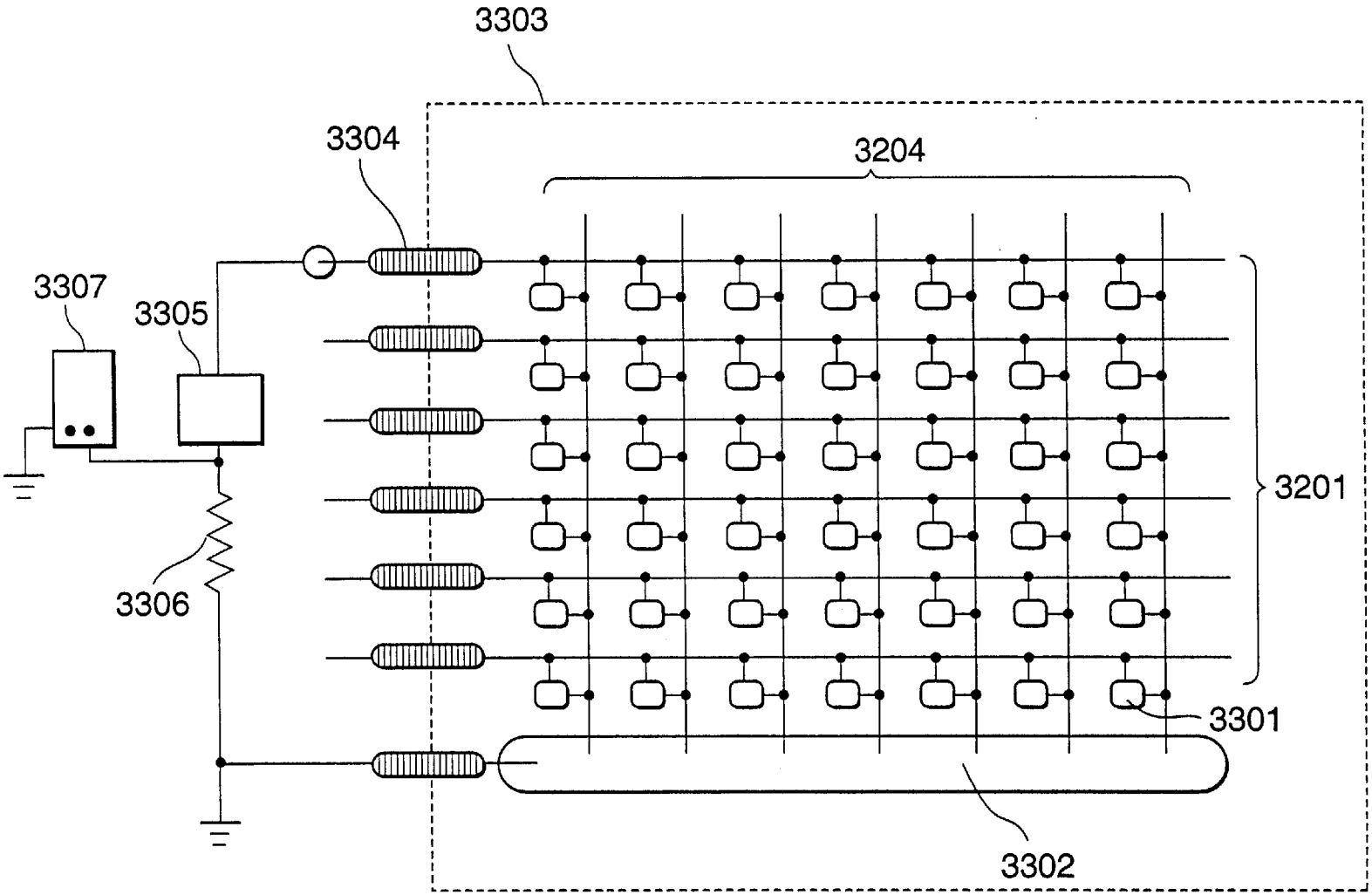
FIG. 33 is a schematic diagram illustrating a wiring method used by the electron source manufacture method according to the invention.

The electron source are wired as shown in FIG. 33 for the processes to follow. X-direction wiring patterns 3201 each have a lead extending to the outside of the process container 3303 via field through holes 3304. Y-direction wiring patterns 3204 are all connected to a common electrode 3302. A lead connected to the common electrode 3302 extends to the outside of the process container via a field through hole 3304. Reference numeral 3301 represents an electron emitting element. A pulse generator 3305 is connected between the common electrode and one of the X-direction wiring pattern. Reference numeral 3306 represents a current measuring resistor, and reference numeral 3307 represents a current monitor. Similar to the seventh embodiment, triangular pulses gradually raising their peak value were applied during the forming process, and during the period between forming pulses, a rectangular pulse having a peak value of 0.1 V was applied to measure current and check a resistance value. When the resistance value exceeded 100 kΩ, the forming process for the electron emitting elements connected to the X-direction wiring pattern was completed. Next, the pulse generator 3305 was connected to the next X-direction wiring pattern to repeat the above operations. In this manner, electron emitting areas were formed on all the electron emitting elements.

(Process G)

Next, the activating process was performed. Similar to the seventh embodiment, $N_2$ gas containing acetone was introduced and rectangular pulses having a peak value of 18 V were applied to each of the X-direction wiring patterns, using the circuit connection similar to the process F. When the detected current amount became roughly saturated, the next X-direction wiring pattern was connected to repeat the above operation and complete the activating process for all the electron emitting elements.

(Process H)

Next, the stabilizing process was performed. Similar to the seventh embodiment, the electron source was maintained at 150° C. for 7 hours in an $N_2$ gas flow.

(Process I)

The electrical characteristics of each element of the electron source were measured to confirm whether or not there is any short circuit.

(Process J)

A glass vacuum container and an image forming member were prepared for combining them with the electron source. The glass vacuum container is constituted of a face plate, a rear plate, and a support frame, and is provided with an exhaust pipe for evacuating the inside of the vacuum container. The image forming member is constituted of a fluorescent film and a metal back laminated on the inner surface of the face plate.

In this embodiment, the stripe structure shown in FIG. 10A was used as the fluorescent film. After the filming process was performed, Al was deposited through vacuum vapor deposition to form the metal back.

The face plate including the image forming member, rear plate, and support frame were subjected to a heat treatment at 450° C. for one hour in an $N_2$ gas flow to remove unnecessary attached substances.

The electron source was fixed to the rear plate, and then the rear plate, face plate, and exhaust pipe were assembled and fixed to form the vacuum container. In this case, the electron source and image forming member were precisely aligned in position. Frit glass was used as adhesive and heated at 400° C. in the atmospheric air to fix the assembly. The image forming apparatus manufactured by the above processes has the structure schematically shown in FIG. 9. Reference numeral 81 represents a rear plate, reference numeral 82 represents a support frame, and reference numeral 83 represents a face plate. With these components, a vacuum container (outer envelope) 88 is manufactured. Reference numeral 84 represents a fluorescent film, and reference numeral 85 represents a metal back. These components constitute the image forming member. Reference numeral 901 represents an exhaust pipe for evacuating the inside of the vacuum container 88. Reference numeral 87 represents a high voltage terminal connected to the metal back 85 to apply a voltage to the image forming member and accelerate electrons. A getter (not shown) is also disposed around the electron source.

(Process K)

The exhaust pipe was connected to an ultra high vacuum evacuator to evacuate the inside of the vacuum container to a pressure of $10^{-6}$ Pa or lower.

(Process L)

The exhaust pipe was heated with a burner to seal the vacuum container. Next, the getter was heated through high frequency heating to perform the getter process and complete the image forming apparatus.

A matrix driving operation was performed by applying a voltage of 5 kV to the high voltage terminal of the image forming apparatus. It was confirmed that the image forming apparatus operated normally.

Ninth Embodiment

The ninth embodiment provides an electron source and an image forming apparatus using the electron source, similar to the eighth embodiment. The processes A to E of the eighth embodiment were performed.

(Process F)

The forming process was performed. The electron source was placed in a forming process chamber into which $N_2$ gas was introduced. The connection is fundamentally the same as that shown in FIG. 33, excepting that a switching device is connected between the pulse generator 3305 and the X-direction wiring patterns to sequentially switch between the X-direction wiring patterns each time one pulse is applied. Rectangular pulses having a peak value of 5 V and a pulse width of 100 $\mu$sec were sequentially applied to each X-direction wiring pattern.

Next, the gas introduced into the chamber was changed to a mixture gas of 99% $N_2$ and 1% $H_2$.

The resistance of each element increased first very little, then gradually lowered, and thereafter increased abruptly to make a high resistance. In this manner, the electron emitting area was formed. A lower limit of explosion concentration of $H_2$ is 4% in the atmospheric air. Therefore, a specific anti-explosion installation was not used for the mixture gas, with ordinary ventilation around the chamber.

(Process G)

The activation process was performed. A mixture gas of 99% $N_2$ and 1% $CH_4$ was introduced into an activating process chamber. Since a lower limit of explosion concentration of methane $CH_4$ is 5% in the atmospheric air, a specific anti-explosion installation was not used for the mixture gas.

Similar to the process F, pulse voltages were applied. The pulse voltage had a peak value of 5 V at the start time, gradually raised at a rate of 0.5 V/min, and was fixed when the peak value of 18 V was obtained.

This process was terminated when an increase of a monitored current value became generally saturated.

(Process H)

Next, the stabilizing process was performed. $N_2$ gas was introduced into a stabilizing process chamber, and the stabilizing process continued at 150° C. for 5 hours. During the first one hour, pulses having a peak value of 18 V were applied similar to the process G.

(Process I)

The If-Vf characteristics of each electron emitting element were measured. It was confirmed that all the elements operated normally.

Thereafter, similar to the eighth embodiment, the electron source, an image forming member, and a vacuum container were combined to form an image forming apparatus. The normal operation was confirmed while a voltage of 5 kV was applied to the high voltage terminal. The emission current of each electron emitting element was slightly larger than the eighth embodiment.

Tenth Embodiment

The tenth embodiment provides an electron source and an image forming apparatus using the electron source, similar to the eighth embodiment. The processes A to E of the eighth embodiment were performed.

(Process F)

The electron source was placed in a forming process chamber into which dried air was introduced. The electron forming area was formed by the forming method similar to the eighth embodiment.

(Process G)

The electron source was placed in an activating process chamber into which a mixture gas of 99.95% $N_2$ and 0.05% $C_2H_2$ was introduced. Similar to the eighth embodiment, pulse voltages were applied to the electron source to perform the activating process.

(Process H)

The electron source was placed in a stabilizing process chamber into which a mixture gas of 95% $N_2$ and 5% $O_2$ was introduced. The inside of the chamber was maintained at 150° C. for 3 hours.

Thereafter, each electron emitting element was inspected in the manner similar to that described earlier, and similar to the eighth embodiment, the image forming apparatus was manufactured. The operation was checked, and the results generally the same as the eighth embodiment were obtained.

Eleventh Embodiment

After the processes up to the process G of the eighth embodiment were performed, the stabilizing process was performed in the following manner.

(Process H)

The electron source was placed in a vacuum chamber the inside of which was evacuated by a scroll pump to a pressure of $10^{-3}$ Pa. It took minutes to obtain this pressure. Next, after the vacuum chamber was heated to 150° C., it was maintained for 10 hours while the evacuation was conducted. The vacuum chamber had a very simple structure connected to the scroll pump via a simple valve.

Thereafter, each electron emitting element was inspected in the manner similar to that described earlier, and similar to the eighth embodiment, the image forming apparatus was manufactured. The operation was checked, and the results generally the same as the eighth embodiment were obtained.

In each embodiment described above, activating source material can be supplied uniformly and quickly. Since a high vacuum atmosphere is not used during the activating process, it is not necessary to evacuate and if necessary drain after the activating process the inside of an activating process chamber in which an electron emitting element or electron source is placed, prior to the activating process. It is therefore possible to shorten greatly the total process time, and it is particularly suitable for mass production. Since the process is not performed by connecting a vacuum chamber by a vacuum transport path, it is not necessary to use such a bulky and very expensive manufacture system.

If the activating process and following process are performed in the same vacuum chamber, organic material is introduced into the vacuum chamber for the activating process, and it is drained in the stabilizing process. The organic material introduced into the vacuum chamber in the stabilizing process is attached greatly in amount not only to the electron emitting element or electron source but also to the inner wall of the vacuum chamber. It takes a long time to remove the attached organic material. However, in the embodiment, a container in an atmosphere in the activating process is different from a container used in the following process. Therefore, even if organic material is attached to the container used for the activating process, the following process is not adversely affected so that the manufacture process time can be shortened.

As described so far, according to the present invention, a time required for manufacturing an electron emitting element, an electron source, or an image forming apparatus can be shortened and the manufacture cost can be lowered.

What is claimed is:

1. A method of manufacturing an electron source with an electron emitting element, comprising the steps of:

depositing a deposit substance in an area including at least an area of the electron ruining element from which area electrons are emitted, wherein said depositing step is performed in an atmosphere of a gas containing at least a source material of the deposit substance, the gas having a mean free path allowing the gas to take a viscous flow state, and wherein the gas atmosphere has a pressure of 100 Pa or higher, and said depositing step deposits the deposit substance by applying a voltage across the area from which electrons are emitted, under the atmosphere.

2. A method of manufacturing an electron source with an electron emitting element, comprising the steps of:

depositing a deposit substance in an area including a least an area of the electron emitting element from which area electrons are emitted, wherein said depositing step is performed in an atmosphere of a gas containing at least a source material of the deposit substance, the gas atmosphere having a pressure of 100 Pa or higher, and said depositing step deposits the deposit substance by applying a voltage across the area from which electrons are emitted, under the atmosphere.

3. A method of manufacturing an electron source according to claim 2, wherein the gas atmosphere has 1.5 atmospheric pressure or lower.

4. A method of manufacturing an electron source according to claim 2, wherein the gas atmosphere has 0.5 atmospheric pressure or lower.

5. A method of manufacturing an electron source according to claim 2, wherein the gas atmosphere has approximately an atmospheric pressure.

6. A method of manufacturing an electron source according to claim 2, wherein the gas is a gas made of a source material of the deposit substance diluted with dilution gas.

7. A method of manufacturing an electron source according to claim 6, wherein the dilution gas is an inert gas.

8. A method of manufacturing an electron source according to claim 2, wherein the gas contains a source material of the deposit substance and a gas of nitrogen.

9. A method of manufacturing an electron source according to claim 2, wherein the gas contains carbon or carbon compound and a gas of nitrogen.

10. A method of manufacturing an electron source according to claim 2, wherein the area from which electrons are emitted is near at a first gapped area between conductive materials facing each other, and said depositing step deposits the deposit substance over the facing conductive materials to from a second gapped area narrower than the first gapped area.

11. A method of manufacturing an electron source according to claim 10, further comprising a first gapped area forming step of forming the first gapped area.

12. A method of manufacturing an electron source according to claim 11, wherein said first gapped area forming step forms the first gapped area by supplying a power to the conductive film where the first gapped area is formed.

13. A method of manufacturing an electron source according to claim 2, wherein said depositing step is performed in a container capable of being evacuated into the atmosphere.

14. A method of manufacturing an electron source according to claim 13, wherein said depositing step is performed by introducing the gas into the container.

15. A method of manufacturing an electron source according to claim 14, wherein said depositing step is performed by flowing the gas through the container.

16. A method of manufacturing an electron source according to claim 13, wherein said depositing step is performed in a container having an inlet port and an outlet port for the gas.

17. A method of manufacturing an electron source according to claim 13, wherein during said depositing step, the gas drained from the container is again introduced into the container.

18. A method of manufacturing an electron source according to claim 11, wherein before the gas is again introduced into the container, unnecessary substances are reduced from the gas drained from the container.

19. A method of manufacturing an electron source according to claim 11, wherein before the gas is again introduced into the container, moisture is reduced from the gas drained from the container.

20. A method of manufacturing an electron source according to claim 2, further comprising a step of reducing an amount of the gas in the atmosphere after said depositing step.

21. A method of manufacturing an electron source according to claim 2, wherein the electron emitting element is a cold cathode element.

22. A method of manufacturing an electron source according to claim 2, wherein the electron emitting element is a surface conduction type electron element.

23. A method of manufacturing an electron source according to claim 2, wherein a plurality of electron emitting elements are formed.

24. A method of manufacturing an image forming apparatus having an electron source and an image forming member for forming an image by using electrons radiated from the electron source, comprising the step of integrating the image forming member with an electron source manufactured by the method recited in claim 2.

* * * * *

UNITED STATES PATENT AND TRADEMARK OFFICE

CERTIFICATE OF CORRECTION

PATENT NO. : 6,416,374 B1 
DATED : July 9, 2002
INVENTOR(S) : Masanori Mitome et al.

It is certified that error appears in the above-identified patent and that said Letters Patent is hereby corrected as shown below:

Title page,
Item [56], FOREIGN PATENT DOCUMENTS,
"JP 9-330654 12/1997" should be deleted; and
"9330654" should read -- 9-330654 --.
OTHER PUBLICATIONS, after "Yamaguchi et al.", "tion-Emitter" should read -- tron-Emitter --.

Column 1,
Line 30, "Recio" should read -- Radio --;
Line 63, "decompose" should read -- decompose the conductive thin film 4 --.

Column 2,
Line 21, "been" should be deleted.
Line 22, "since" should be deleted.

Column 3,
Line 31, "carbons" should read -- carbon --.

Column 5,
Line 53, "may" should read -- may form --.

Column 7,
Line 31, "example of the voltage waveform" should read -- examples of the voltage waveforms --.

Column 10,
Line 45, "partial" should read -- particle --;
Line 66, "cluster."" should read -- "cluster." --.

Column 12,
Line 10, "are" should read -- is --;
Line 61, "tens" should read -- tens of --.

Column 13,
Line 49, "king" should read -- kind --.

Column 14,
Line 65, "bout" should read -- about --.

UNITED STATES PATENT AND TRADEMARK OFFICE

CERTIFICATE OF CORRECTION

PATENT NO. : 6,416,374 B1
DATED : July 9, 2002
INVENTOR(S) : Masanori Mitome et al.

It is certified that error appears in the above-identified patent and that said Letters Patent is hereby corrected as shown below:

Column 15,
Line 62, “preferable” should read -- preferably --.

Column 16,
Line 6, “$H_2$)” should read -- $H_2$ --.

Column 17,
Line 43, “ones” should read -- one --;
Line 45, “are” should read -- is --;
Line 46, “others” should read -- other --;
Line 48, “are” should read -- is --.

Column 19,
Line 45, “precipating,” should read -- precipitating, --.

Column 21,
Line 65, “shows” should read -- shown --.

Column 22,
Line 27, “a.” should read -- a --.

Column 32,
Line 24, “no” should read -- not --.

Column 33,
Lines 30 and 33, “in a” should read -- at --.

Column 38,
Line 36, “source” should read -- sources --.

UNITED STATES PATENT AND TRADEMARK OFFICE

CERTIFICATE OF CORRECTION

PATENT NO. : 6,416,374 B1 
DATED : July 9, 2002
INVENTOR(S) : Masanori Mitome et al.

It is certified that error appears in the above-identified patent and that said Letters Patent is hereby corrected as shown below:

Column 43,
Line 14, "claim 11," should read -- claim 17, --;
Line 19, "claim 11," should read -- claim 17, --.

Column 44,
Line 10, "electron" should read -- electron emitting --.

Signed and Sealed this

First Day of April, 2003

JAMES E. ROGAN
*Director of the United States Patent and Trademark Office*